US007867066B2

(12) United States Patent
Suzuki

(10) Patent No.: US 7,867,066 B2
(45) Date of Patent: Jan. 11, 2011

(54) POLISHING PAD

(75) Inventor: Tatsutoshi Suzuki, Yokkaichi (JP)

(73) Assignees: Toho Engineering Kabushiki Kaisha (JP); Inoac Corporation (JP)

( * ) Notice: Subject to any disclaimer, the term of this patent is extended or adjusted under 35 U.S.C. 154(b) by 358 days.

(21) Appl. No.: 11/813,141

(22) PCT Filed: Dec. 19, 2005

(86) PCT No.: PCT/JP2005/023255

§ 371 (c)(1),
(2), (4) Date: Jun. 29, 2007

(87) PCT Pub. No.: WO2006/070629

PCT Pub. Date: Jul. 6, 2006

(65) Prior Publication Data

US 2008/0064311 A1 Mar. 13, 2008

(30) Foreign Application Priority Data

Dec. 29, 2004 (JP) ..... 2004-383013

(51) Int. Cl.
*B24D 11/00* (2006.01)

(52) U.S. Cl. ..... 451/527; 451/528; 451/529

(58) Field of Classification Search ..... 451/527–530
See application file for complete search history.

(56) References Cited

U.S. PATENT DOCUMENTS

| | | | | |
|---|---|---|---|---|
| 5,441,598 | A * | 8/1995 | Yu et al. | 438/692 |
| 5,725,420 | A | 3/1998 | Torii | |
| 5,913,713 | A * | 6/1999 | Cheek et al. | 451/41 |
| 6,976,910 | B2 * | 12/2005 | Hosaka et al. | 451/530 |
| 7,192,340 | B2 | 3/2007 | Ono et al. | |
| 2004/0198056 | A1 | 10/2004 | Suzuki | |
| 2004/0259479 | A1 * | 12/2004 | Sevilla | 451/41 |
| 2005/0113011 | A1 | 5/2005 | Miyauchi et al. | |

FOREIGN PATENT DOCUMENTS

| | | | |
|---|---|---|---|
| JP | 11-156701 | A | 6/1999 |
| JP | 11-235656 | A | 8/1999 |
| JP | 2001-18165 | A | 1/2001 |
| JP | 2004-202666 | A | 7/2004 |
| JP | 2005-294410 | A | 10/2005 |
| WO | 03-083918 | A1 | 10/2003 |

OTHER PUBLICATIONS

Relevant Portion of International Search Report issued in International Application No.PCT/JP2005/023255, with mailing date Mar. 14, 2006.

International Preliminary Report on Patentability and written opinion issued in the corresponding application No. PCT/JP2005/023255, mailed on Jul. 12, 2007.

* cited by examiner

*Primary Examiner*—Maurina Rachuba
(74) *Attorney, Agent, or Firm*—Rossi, Kimms & McDowell LLP

(57) ABSTRACT

A polishing pad having a novel structure, which is applicable to highly accurate various polishing process, such as a CMP process, is provided. An annular rear plane groove (22) extending in a circumferential direction is formed on a rear plane (20) of the polishing pad.

3 Claims, 29 Drawing Sheets

POLISHING PAD

This is a U.S. National Phase Application of PCT International Application PCT/JP2005/023255 filed on Dec. 19, 2005 which is based on and claims priority from JP 2004-383013, filed on Dec. 29, 2004.

TECHNICAL FIELD

The present invention relates to polishing pads, and more specifically to a polishing pad for use in polishing a surface of a processing object, such as a semiconductor wafer, a semiconductor substrate and a glass substrate, which needs an extremely high processing accuracy.

BACKGROUND ART

In the process of fabricating semiconductor devices such as LSI devices, a lamination of various kinds of thin layers including metallic layers and insulative layers are formed on a silicon wafer, for example, in order to fabricate a semiconductor substrate. During this fabrication process, a surface of each thin layer is planarized. As one major for planarizing the surface of each thin layer, chemical mechanical polishing (hereinafter referred to as "CMP") is known. According to the CMP process, a thin disk-shaped polishing pad of synthetic resin material or expanded material thereof may be employed, and the polishing pad and the wafer (semiconductor substrate) are made to undergo relative rotation while supplying between the wafer and the pad a slurry consisting of fine particles and a suitable kind of liquid, for effect polishing.

In order to realize a highly integrated, high-precision semiconductor device, it is required to produce multiple layers of intricate patterns of extremely fine lines. To meet this end, the CMP process is required to ensure polishing precision, i.e. the ability to polish an entire wafer surface with highly precise planarization. Higher circuit densities seen in semiconductor devices in recent years have raised the bar still further as regards polishing precision in the CMP process, as well as polishing efficiency.

To realize such an advance polishing precision and planarization capacity, the polishing pad, as well known, needs somewhat elasticity depending on materials of the pad and the wafer, a required polishing precision, and the like. Namely, with the somewhat elasticity given to the polishing pad, the surface of the polishing pad is able to meet in accordance with the irregularities on the surface of the wafer, making it possible to enhance the polishing precision. However, one surface of the polishing pad, which is actually utilized for polishing (a processing surface), is required to be hard for the purpose of securing durability of the polishing pad and polishing efficiency, thereby making it difficult to give sufficient elasticity to the polishing pad. In short, for polishing pads of conventional structure, it was still exceedingly difficult to achieve both "polishing precision" and "polishing efficiency" at levels adequate to meet requirements.

In the field of super LSI in particular, metallic interconnect or metallization width of lines formed on the wafer (line patterns with metal line) is extremely narrow, i.e. 0.1 μm or smaller, and polishing is carried out at an uniformity of 2% or smaller. Also, the use of recently soft metal such as copper and gold for metallization has entered the stage of research directed to practical application. In view of the above, still further improvements are required to polishing pads in order to achieve satisfactory levels of polishing precision and polishing efficiency.

In view of the aforementioned problems, a multi-layered polishing pad has been proposed (see Patent Document No. 1). Such a multi-layered polishing pad generally has a multi-layered structure wherein a front layer made of a material rigid enough to realize physical properties required for a processing layer and a back layer made of an elastic material like a compression fiber material impregnated with resin are bonded together. That is, the back layer will exhibit elasticity and the front layer will ensure polishing efficiency, whereby both "polishing precision" and "polishing efficiency" can be achieved.

However, such a multi-layered polishing pad has the problem that it is difficult to manufacture, and the problem that there is a likelihood of interface debonding between the layers. Thus, the multi-layered polishing pad still has a room for improvement.

Patent Document No. 2 (JP-A-2001-18165), on the other hand, discloses a single-layer polishing pad made of a single material, wherein linear grooves are formed into the back surface in order to produce elasticity tending to lack. According to this polishing pad, the elasticity of the pad can be enhanced mechanically by means of the groove open in the pad back surface, so that this polishing pad is able to improve polishing precision by the given elasticity, while maintaining polishing efficiency by its front surface. Unlike the multi-layered polishing pad, this type of polishing pad is free from the problem of difficulty in manufacture and the problem of interface debonding.

However, the polishing pad as disclosed in Patent Document No. 2, has several inherent problems, and it is not enough for practical use.

Namely, the conventional polishing pad as disclosed in Patent Document No. 2 has the following problems (1)-(4):

(Problem 1) Depending on a material of the polishing pad, it is difficult to realize sufficient elasticity by just forming grooves into the back surface of the pad. In particular, if a plurality of grooves are formed into the back surface of the pad in order to exhibit desired elasticity, a surface area of the back surface where no groove is formed is made small substantially. This makes it difficult to obtain a sufficient bonding surface of the polishing pad against a rotational platen. Therefore, a possible number of grooves to be formed into the back surface of the pad may be limited.

(Problem 2) In order to compensate the elasticity of the polishing pad which tends to be insufficient only by a groove formation on the back surface, it is possible to form grooves also in the front surface of the pad. However, the groove formation on both the front and back surfaces of the polishing pad makes it very complicate to manufacture the polishing pad, leading to anxiety about the sharp decline in production efficiency.

(Problem 3) In the case of the polishing pad in which the front and back surfaces are distinguished from each other depending on molding conditions or the like, once grooves are formed on both the front and back surfaces of the pad, it becomes difficult to distinguish the front and back surfaces from each other. Therefore, the polishing pad may be placed on the platen upside down, possibly causing insufficient polishing.

(Problem 4) The groove formation on the back surface of the polishing pad causes decrease in the bonding surface area of the polishing pad against the rotational platen by an area of openings of the grooves. In addition, when a polishing process is carried out using slurry or the like, as in the CMP process, the slurry is likely to be spread over a wide area on the back surface of the polishing pad. As a result, the polishing pad is likely to be separate from the rotational platen or the like.

(Patent Document No. 1)

JP 11-156701A (Patent Document No. 2)

JP 2001-18165 A

DISCLOSURE OF THE INVENTION

Object of the Invention

The present invention has been developed in order to solve the above-described problems, and it is therefore one object of this invention to provide a polishing pad of novel construction, and which is adoptable in various kinds of highly precise polish processes including the CMP process.

Regarding aspects of the present invention have been developed to solve especially the aforementioned problem 2 and problem 4 effectively.

Regarding one aspect of the present invention as defined in claim 2 has been developed to solve especially the aforementioned problem 3 and problem 4 effectively.

Regarding one aspect of the present invention, has been developed to solve especially the aforementioned problem 1 and problem 4 effectively.

Arrangement for Attaining Object of the Invention

There will be described modes of the invention that have been developed in an effort to achieve at least one of these objects of the invention. Every elements employed in the following modes may be adoptable in any other possible combinations. It is to be understood that principle or technical features of the invention are not limited to the following modes of the invention and combinations of the technical features, but may otherwise be recognized based on the concepts of the present invention disclosed in the entire specification and FIG.s or that may be recognized by those skilled in the art in the light of the present disclosure.

A first mode of the invention provides a polishing pad having a thin-disk shape, adapted to be mounted on a polishing apparatus with a back surface thereof bonded on a support surface of the polishing apparatus, and adapted to perform a polishing action with a front surface thereof on a processing object like a semiconductor wafer, the polishing pad being characterized in that: a plurality of annular grooves are formed concentrically about a center axis of the polishing pad on both of the front surface and the back surface of the polishing pad, with a same cross-sectional shape, at a same radial pitch and at a same number.

In the polishing pad of construction according to the first mode, not only the back surface of the polishing pad, but also the front surface is formed with the grooves, whereby the elasticity of the polishing pad can be enhanced by the grooves on the front surface in addition to the grooves on the back surface. This makes it possible to establish an improved polishing precision owing to the elasticity of the pad, while well maintaining polishing efficiency owing to rigidity of a material itself of the pad substrate. In particular, enhanced elasticity of the polishing pad can be realized by means of the grooves on the front surface, without considerably increasing or enlarging the grooves on the back surface. Thus, it is possible to effectively obtain the bonding surface area of the back surface of the pad against the rotational platen.

Furthermore, in the polishing pad as defined in the first mode, the grooves on both of the front surface and the back surface of the polishing pad are formed with the same cross-sectional shape and at the same radial pitch, making it possible to carry out the grooving process on the both front and back surfaces of the pad on the same condition. Therefore, it is possible to efficiently execute polishing pad processing with a simple machine structure and simple operation control.

Additionally, in the polishing pad as defined in the first mode, the grooves formed on the back surface are the annular grooves. Thus, when the polishing pad is placed on the mounting surface, such as the rotational platen, of the polishing apparatus, the grooves on the back surface provide hollow spaces substantially hermetically closed from the external area, without opening in the outer circumferential surface of the polishing pad. Thus, if a polishing liquid (slurry) is supplied to the pad front surface upon polishing process, invasion of the liquid between the pad back surface and the mounting surface like the rotational platen is effectively prevented. This prevents the polishing pad from being dislodging from or dislocated on the polishing apparatus, effectively.

In the case where a pad substrate for a polishing pad has no difference between the front and back surfaces, the first mode of the present invention is able to provide a polishing pad whose both sides including the grooves formed thereon can be optionally used. According to this polishing pad, even if the polishing pad is mounted reversely on the polishing apparatus, the possible drawback caused by this can be completely avoided. Thus, a load of work of an operator can be reduced in comparison with the case where the operator needs to distinguish the front surface from the back surface. In the polishing pad according to the first mode, the annular grooves formed on the front surface just need to be the same as the annular grooves formed on the back surface in terms of the radial pitch or a radial distance between adjacent grooves, but these grooves on the front and back surfaces do not need to be located on the same positions. For instance, the annular grooves on the front surface and the annular grooves on the back surface may be dislocated in the radial direction. The advantages of the present invention as defined in the first mode can be exhibited effectively even if the locations of the annular grooves on the front and back surfaces are the same or not.

A second mode of the invention provides a polishing pad having a thin-disk shape, adapted to be mounted on a polishing apparatus with a back surface thereof bonded on a support surface of the polishing apparatus, and adapted to perform a polishing action with a front surface thereof on a processing object like a semiconductor wafer, the polishing pad being characterized in that: a plurality of annular grooves are formed concentrically about a center axis of the polishing pad on the back surface of the polishing pad, while a plurality of linear grooves parallel to one another are formed on the front surface of the polishing pad so as to extend in one direction at least.

In the polishing pad of construction according to the second mode, the polishing efficiency is advantageously established owing to the grooves formed on the front and back surfaces, like in the first mode of the invention, while the polishing precision can be enhanced owing to suitable elasticity. In addition, the invasion of the polish liquid to the mounting side (back surface) against the polishing apparatus may also be prevented.

Additionally, in the polishing pad as defined in the second mode, the grooves having different shapes visibly distinguished from each other are formed on the front and back surfaces, respectively. Thus, when the polishing pad is mounted on the polishing apparatus, the front surface is efficiently distinguished from the back surface, thereby enhancing operation efficiency, and occurrence of reverse mounting of the pad can be avoided easily and much more certainly.

A third mode of the invention provides a polishing pad having a thin-disk shape, adapted to be mounted on a polishing apparatus with a back surface thereof bonded on a support surface of the polishing apparatus, and adapted to perform a polishing action with a front surface thereof on a processing object like a semiconductor wafer, the polishing pad being characterized in that: a plurality of back-side annular grooves are formed concentrically about a center axis of the polishing pad on the back surface of the polishing pad at predetermined radial intervals, while a plurality of front-side annular grooves are formed concentrically about the center axis of the polishing pad on the front surface of the polishing pad at predetermined radial intervals such that at least one of the front-side annular grooves or the back-side annular grooves is located between adjacent ones of the back-side annular grooves or the front-side annular grooves in a radial direction.

In the polishing pad of construction according to the third mode, the polishing efficiency is advantageously established owing to the grooves formed on the front and back surfaces, like in the first mode of the invention, while the polishing precision can be enhanced owing to suitable elasticity. In addition, the invasion of the polish liquid to the mounting side (back surface) against the polishing apparatus may also be prevented.

Furthermore, by specifying the positional relationship between the front-side annular grooves and the back-side annular grooves in the radial direction, the elasticity given by the back-side annular grooves to the polishing pad is able to effectively provide on the front surface of the polishing pad, making it possible to realize further enhanced polishing precision.

A fourth mode of the invention provides the polishing pad according to the third mode, wherein the front-side annular grooves are formed at the same radial intervals as the back-side annular grooves, and each of the front-side annular grooves is located at a central portion between corresponding adjacent ones of the back-side annular grooves in the radial direction.

In the polishing pad of construction according to the fourth mode, each front-side annular groove is arranged to be located at the radially central portion between adjacent ones of the back-side annular grooves, so that a portion of the front surface which is brought into contact with the processing object backs to the back-side annular grooves formed on the back surface of the polishing pad. As a result, when the polishing pad is subjected to a load applied thereto in its thickness direction, portions located between adjacent ones of the annular grooves on the front and back surfaces of the polishing pad will undergo shear deformation, so that the polishing pad will exhibit further effective elasticity even if the material of the pad is the same.

A fifth mode of the invention provides the polishing pad according to the fourth mode, wherein the polishing pad is of construction according to the first mode.

A sixth mode of the invention provides the polishing pad according to the third mode, wherein the back-side annular grooves are formed at the predetermined radial intervals smaller than that of the front-side annular grooves.

In the polishing pad of construction according to the sixth mode, since the back-side annular grooves are formed at the predetermined radial intervals smaller than that of the front-side annular grooves, the elasticity of the polishing pad can be effectively realized by the back-side annular grooves. This makes it possible to carry out polishing processing with high precision advantageous in terms of uniformity and planarity. In particular, by making small the radial pitch of the back-side annular grooves that is less likely to affect on polishing capability or the like, in comparison with the front surface that is more likely to affect on polishing pad and polishing capability, the elasticity of the pad can be improved further, while maintaining polishing capability efficiently.

A seventh mode of the invention provides the polishing pad according to any one of the third through sixth modes, wherein a sum of a depth dimension of each of one of the back-side annular grooves and the front-side annular grooves and a depth dimension of each of an other annular grooves located between radially adjacent ones of the one of annular grooves is greater than an entire thickness dimension of the pad.

In the polishing pad of construction according to the seventh mode, it is possible to enlarge a free surface area defined by inner faces of the grooves on the front and back surfaces of the pad. This makes it possible to further enhance elasticity of the polishing pad, even if the material of the pad is the same.

An eighth mode of the invention provides the polishing pad according to the third mode, wherein a sum of a depth dimension of each of the back-side annular grooves and a depth dimension of each of the front-side annular grooves is smaller than an entire thickness dimension of the pad.

In the polishing pad of construction according to the present mode, it is possible to design the front-side and back-side annular grooves with a large degree of freedom, without taking into consideration mutual positions, sizes or the like. This makes it possible to readily achieve both of the elasticity realized by the grooves on the back surface and the polishing capability like polishing precision and planarity realized by the grooves on the front surface.

A ninth mode of the invention provides a polishing pad having a thin-disk shape, adapted to be mounted on a polishing apparatus with a back surface thereof bonded on a support surface of the polishing apparatus, and adapted to perform a polishing action with a front surface thereof on a processing object like a semiconductor wafer, the polishing pad being characterized in that: a plurality of back-side annular grooves are formed concentrically about a center axis of the polishing pad on the back surface of the polishing pad, and each of the plurality of back-side annular grooves is a slant groove extending circumferentially over an entire circumference with a substantially constant cross sectional shape wherein either an inner circumferential face and an outer circumferential face are slant with respect to the center axis with a substantially constant slant angle while being parallel to each other.

In the polishing pad of construction according to the ninth mode, the back-side annular grooves are formed as the slant grooves, making it possible to provide shear component upon deformation of the polishing pad during input of external load in the thickness direction of the polishing pad. As a result, the polishing pad is exhibit further enhanced elasticity effectively. Furthermore, since each back-side annular groove is of annular shape, if it undergoes shear deformation, the direction of the deformation is entirely balanced. This makes it possible to prevent the polishing surface from being deformed in the specific direction, so that the polishing pad is able to exhibit excellent elasticity, while maintaining stable polishing surface precision.

In addition, like in the polishing pad in the first mode, the polishing pad according to the ninth mode enjoys an advantage that invasion of the polishing liquid to the wearing side (back surface) over the polishing apparatus may be prevented.

A tenth mode of the invention provides the polishing pad according to the ninth mode, wherein the polishing pad is of construction according to any one of the first through eighth modes.

An eleventh mode of the invention provides a polishing pad having a thin-disk shape, adapted to be mounted on a polishing apparatus with a back surface thereof bonded on a support surface of the polishing apparatus, and adapted to perform a polishing action with a front surface thereof on a processing object like a semiconductor wafer, the polishing pad being characterized in that: a plurality of annular grooves are formed concentrically about a center axis of the polishing pad on the back surface of the polishing pad, while a plurality of front-side grooves are formed on the front surface of the polishing pad, each of the front-side grooves being a slant groove having both side walls whose inner faces are slant substantially parallel to each other.

In the polishing pad of construction according to the eleventh mode, like in the first mode of the invention, the polishing efficiency is advantageously established owing to the grooves formed on the front and back surfaces, while the polishing precision can be enhanced owing to suitable elasticity. In addition, invasion of the polishing liquid to the wearing side (back surface) over the polishing apparatus may be prevented.

Furthermore, in the polishing pad of construction according to the eleventh mode especially, the front-side grooves are formed as the slant grooves, making it possible to provide shear component upon deformation of the polishing pad during input of external load in the thickness direction of the polishing pad. As a result, the polishing pad is exhibit further enhanced elasticity effectively.

A twelfth mode of the invention provides the polishing pad according to the eleventh mode, wherein the polishing pad is of construction according to any one of the first through tenth modes.

A thirteenth mode of the invention provides the polishing pad according to the first mode, wherein each of the plurality of annular grooves formed on the back surface of the polishing pad has a width dimension B, a depth dimension D, and a radial pitch P which are defined in following equalities:

$0.005\ \text{mm} \leqq B \leqq 3.0\ \text{mm}$ $0.1\ \text{mm} \leqq D \leqq 2.0\ \text{mm}$ $0.1\ \text{mm} \leqq P \leqq 5.0\ \text{m}$ In the polishing pad of construction according to the thirteenth mode, by limiting each dimension of the annular groove formed on the back surface within the aforementioned ranges, the bonding surface of the polishing pad against the polishing apparatus upon installation can be obtained, while further effectively enhancing elasticity required for the polishing pad.

EFFECT OF THE INVENTION

As will be understood from the aforementioned description, the polishing pad of construction according to any one of the first, eighth, ninth and thirteenth modes is able to solve the conventional problems (Problem 2 and Problem 4).

The polishing pad of construction according to the second mode is able to solve the conventional problems (Problem 3 and Problem 4).

The polishing pad of construction according to any one of the third through eighth modes and eleventh through thirteenth modes of the invention is able to solve the conventional problems (Problem 1 and Problem 4).

EXPLANATION OF NUMERALS

10: Polishing pad; 14: Front surface; 16: Front-side grooves; 18: Center axis; 20: Back surface; 22: Back-side grooves; 36: Front-side grooves; 38: Back-side grooves; 40: Front inside wall face; 42 Front outside wall face; 44: Back inside wall face; 46: Back outside wall face; 48: Polishing pad; 50: Front-side grooves; 74: Polishing pad; 98: Polishing pad; 100: Polishing pad; 110: Polishing pad; 112: Polishing pad.

BEST MODE FOR CARRYING OUT THE INVENTION

In order to illustrate the invention more concretely, the embodiments of the invention are described in detail hereinbelow, making reference to the accompanying drawings.

Embodiment A

Figure 1:
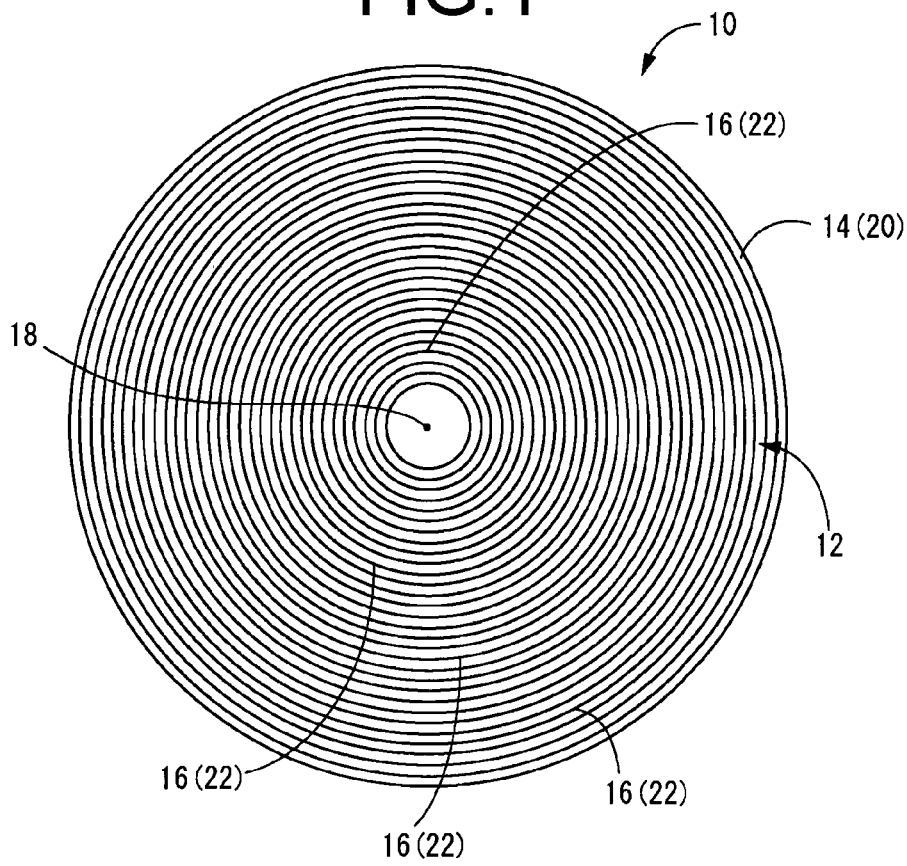
[FIG. 1] It is a top plane view showing a polishing pad of construction according to one embodiment of the invention.
Figure 2:
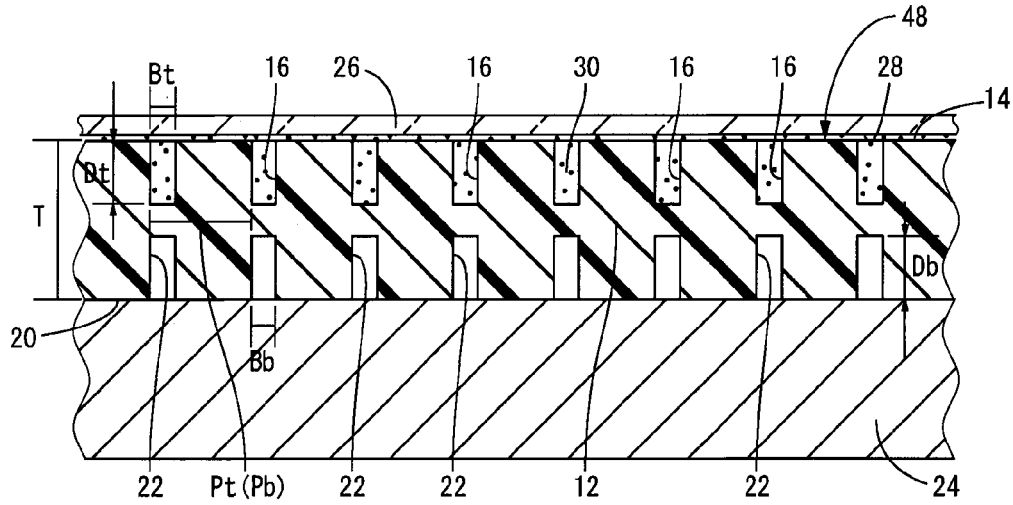
[FIG. 2] It is a vertical cross sectional view of the polishing pad shown in FIG. 1 in a state of being mounted on a polishing apparatus.

Referring first to FIG. 1, shown is a polishing pad 10 of construction according to one embodiment of the present invention as defined in any one of claims 1-13.

More specifically, the polishing pad 10 is constituted by a thin disk shaped pad substrate 12 having a constant thickness dimension T overall. The pad substrate 12 is advantageously formed of rigid expanded or non-expanded synthetic resin material, rigid rubber material, textile material, inorganic material, or other possible material. In the present embodiment, the pad substrate 12 is formed of an expanded urethane, for example. The pad thickness dimension is not particularly limited, and may be selected appropriately depending not only on the material of the pad substrate 12 but also the material of the wafer being polished, the required degree of polishing precision, and the like.

One surface of the pad substrate 12, i.e. a front surface 14 has front-side grooves 16 serving as front-side annular grooves formed thereon so as to extend in a circumferential direction about a center axis 18 of the pad substrate 12, and to be open in the front surface 14.

The front-side grooves 16 are composed of a plurality of circular grooves 16, 16, 16 . . . each extending about the center axis 18 as its center of curvature, but at mutually different radii of curvature, as shown in FIG. 1.

On the other hand, like the front surface 14, the other surface of the pad substrate 12, i.e. a back surface 20 has back-side grooves 22 serving as back-side annular grooves formed thereon so as to extend in a circumferential direction about the center axis 18 of the pad substrate 12, and to be open in the back surface 20. In the present embodiment, the back-side grooves 22 are composed of a plurality of circular grooves 22, 22, 22 . . . each having the same configuration as the front-side grooves 16.

In the present embodiment, the groove depth Dt, the groove width Bt and the radial pitch of the front-side grooves 16 are made identical with the groove depth Db, the groove width Bb and the radial pitch of the back-side grooves 22, respectively, and the forming positions of the front-side grooves 16 and the forming positions of the back-side grooves 22 are identical to each other in the radial direction.

With this arrangement, the front-side grooves 16 formed on the front surface 14 of the pad substrate 12 and the back-side grooves 22 formed on the back surface 20 of the pad substrate 12 have the same configuration each other.

Specific design values for the various dimensions, for the front-side grooves 16 and the back-side grooves 22, may be selected giving overall consideration to the material, thickness dimension, and outside diameter dimension of the pad substrate 12, as well as the material of the wafer being polished, the configuration and material of metallization deposited on the wafer, the required polishing precision and the like, and as such are not particularly limited. Preferably, however, values for the front-side and back-side grooves 16, 22, e.g., the groove width Bt, Bb, the depth Dt, Db, and the radial pitch Pt, Pb may fall within the following ranges.

[For Circumferential Groove of Generally Circular Shape]

$0.005\ \text{mm} \leqq Bt = Bb \leqq 3.0\ \text{mm}$ $0.1\ \text{mm} \leqq Dt = Db \leqq 2.0\ \text{mm}$ $0.1\ \text{mm} \leqq Pt = Pb \leqq 5.0\ \text{mm}$ More preferably, the values may fall within the following range.

[For Circumferential Groove of Generally Circular Shape]

$0.005\ \text{mm} \leqq Bt = Bb \leqq 2.0\ \text{mm}$ (Yet more preferably $0.005\ \text{mm} \leqq Bt = Bb \leqq 1.0\ \text{mm}$)

$0.1\ \text{mm} \leqq Dt = Db \leqq 1.0\ \text{mm}$ $0.2\ \text{mm} \leqq Pt = Pb \leqq 1.0\ \text{mm}$ It should be appreciated that if the groove width Bt, Bb for the front-side and back-side grooves 16, 22 is too small, the front-side grooves 16 will tend to become clogged with polishing residues and the like, so that consistent effect is not readily achieved, and it becomes difficult to achieve the sufficient elasticity by the front-side and back-side grooves 16, 22. On the other hand, if the groove width Bt, Bb for the front-side and back-side grooves 16, 22 is too large, the edge portions (edges of the opening) of the front-side grooves 16 will have increased contact pressure against the wafer, tending to bite into the workpiece during polishing, making it difficult to achieve consistent polishing. In addition, excess elasticity is produced by means of the front-side and back-side grooves 16, 22, leading to a likelihood of deterioration in polishing precision.

If the groove depth Dt, Db for the front-side and back-side grooves 16, 22 is too small, the rigidity in the front surface 14 of the polishing pad 10 will become too large to exhibit elasticity of the polishing pad 10 in the front surface 14 effectively, whereby it will tend to become difficult to execute precise polishing. Also, it become difficult to give sufficient elasticity to the polishing pad 10 by means of the front-side and back-side grooves 16, 22. On the other hand, if the groove depth Dt, Db for the front-side and back-side grooves 16, 22 is too large, not only is the pad difficult to manufacture, but the front surface 14 of the polishing pad 10 will tend to deform easily, and there is a risk of stick slip, whereby polishing tends to be inconsistent. In addition, the polishing pad 10 will be likely suffer from deterioration in polishing precision due to excessive elasticity provided thereto by means of the front-side and back-side grooves 16, 22.

If the radial pitch Pt, Pb for the front-side and back-side grooves 16, 22 is too small, the pad becomes difficult to manufacture, and the front and back surfaces 14, 20 of the polishing pad 10 will tend to deform or become damaged easily, making it difficult to achieve consistent polishing. If on the other hand radial pitch Pt, Pb for the front-side and back-side grooves 16, 22 is too large, it becomes difficult to give sufficient elasticity to polishing pad 10, making it difficult to realize desired polishing precision.

In the present embodiment, the sum of the groove depth Dt for the front-side grooves 16 and the groove depth Db for the back-side grooves 22 (i.e. the total value of (Dt+Db)) is made smaller than the thickness T of the pad substrate 12. More specifically, in the present embodiment, the thickness T may fall within the following ranges.

$0.5\ \text{mm} \leqq T \leqq 10.0\ \text{mm}$

More preferably, the value may fall within the following range.

$1.0\ \text{mm} \leqq T \leqq 3.0\ \text{mm}$

Figure 3:
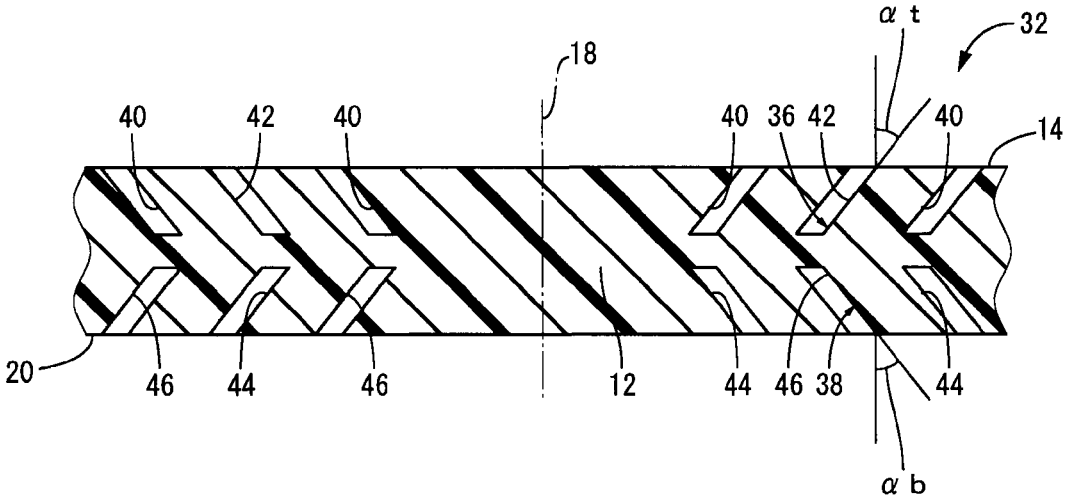
[FIG. 3] It is a vertical cross sectional view of a polishing pad of construction according to another embodiment of the invention.

The polishing pad 10 having the front surface 14 and the back surface 20 as discussed above, is used for polishing a wafer or the like in the conventional manner. More specifically, as shown in FIG. 3, for example, the polishing pad 10 is arranged on the support face of a rotation plate (support plate) 24 of a polishing apparatus, and clamped against the rotation plate by air-reduced negative pressure suction, double-sided bonding or other means. Next, while rotating the polishing pad 10 about its center axis 18, a wafer 26 is juxtaposed against the front surface 14 for polishing. Generally, during this polishing process, an abrasive liquid (hereinafter referred to as "slurry") 30 is supplied to the opposing faces, i.e. the front surface 14 of the polishing pad 10 and the process face 28 of the wafer 26, like the conventional manner, while also rotating the wafer 26 itself about its center axis. The slurry 30 is supplied, for example, to the front surface 14 of the polishing pad 10 from the vicinity of the central portion of the polishing pad 10 so as to be spread out over the surface of the polishing pad 10 due to the action of centrifugal force created by rotation of polishing pad 10 about the center axis 18.

The polishing pad 10 of construction according to the present embodiment is able to solve (Problem 1), (Problem 2) and (Problem 4) selected from among the conventional problems as stated above.

Namely, by providing not only the back-side grooves 22 on the back surface 20 but the front-side grooves 16 on the front surface 14 also, the elasticity of the polishing pad 10 is able to be improved not only by the back-side grooves 22 but the front-side grooves 16 also. Therefore, the polishing efficiency can be advantageously obtained owing to rigidity of the material itself of the pad substrate 12, and the polishing precision can be enhanced owing to elasticity too.

Furthermore, since the front-side grooves 16 formed on the front surface 14 and the back-side grooves 22 on the back surface 20 are generally identical in cross sectional shape, in radial pitch and in the number of formed grooves, the groove processing can be readily done in comparison with the case where the front-side and back-side grooves have different shape. Thus, maintenance and management of the processing apparatus become easy.

Moreover, since the shape and material of the front surface 14 is approximately the same as those of the back surface 20, it is possible to utilize both of the front surface and the back surface as the processing surface (polishing surface), depending on the clamping manner of the pad against the rotation plate 24. There is no need to distinguish the front/back of the polishing pad 10 upon mounting the polishing pad 10 on the support face of the rotation plate (support plate) 24. Thus, the polishing pad 10, which is able to realize high precision polishing, can be readily and securely mounted, while avoiding misplacement between front and back surfaces thereof.

Also, the back-side grooves 22 are the annular grooves extending in the circumferential direction. This makes it possible to effectively prevent that the slurry 30 supplied on the front surface 14 is led along an outer circumferential surface of the pad into the back surface 20. This arrangements may prevent occurrence of problems such as dislodging of the polishing pad 10 from the rotation plate 24, or displacement of the polishing pad 10 on the rotation plate 24, making it possible to execute polishing process with high stability.

In addition, by setting for the back-side grooves 22 the groove width Bb, the depth Db, and the radial pitch Pb within the given ranges, a sufficient elasticity of the polishing pad 10 can be realized, while a sufficient bonding force between the back surface 20 and the rotation plate 24, thereby realizing high reliability.

Moreover, the sum of the groove depth Dt for the front-side grooves 16 and the groove depth Db for the back-side grooves 22 (i.e. the total value of (Dt+Db) is made smaller than the thickness of the pad substrate 12. This makes it possible to give appropriate elasticity to the polishing pad 10, while keeping sufficient rigidity, whereby polishing precision can be realized advantageously.

Figure 4:
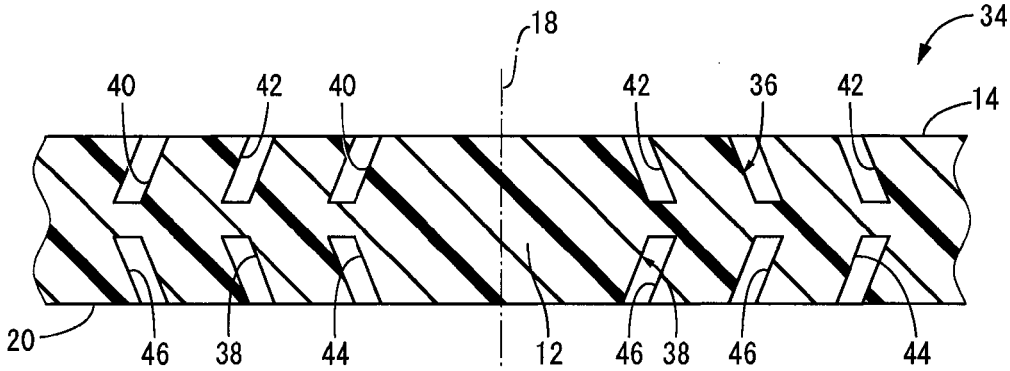
[FIG. 4] It is a vertical cross sectional view of a polishing pad of construction according to another embodiment of the invention.

Referring first to FIGS. 3 and 4, shown are polishing pads 32, 34 of construction according to another embodiment of the present invention as defined in any one of claims 1, 9, 10, 11, 12 and 13. In the interest of brevity and simplification, the same reference numerals as used in the first embodiment will be used in the following embodiments to identify the corresponding components, and redundant description of these components will not be provided.

More specifically described, on the front surface 14 of the pad substrate 12 constituting the polishing pads 32, 34, there are formed front-side grooves 36 serving as front-side annular grooves composed of a plurality of circular grooves each extending circumferentially in a concentric fashion. On the back surface 20 of the pad substrate 12, likewise, there are formed back-side grooves 38 serving as back-side annular grooves composed of a plurality of circular grooves each extending circumferentially in a concentric fashion.

In the present embodiment, the front-side grooves 36 are formed as slant grooves that are slant by a given angle with respect to the center axis 18 of the pad substrate. More specifically, an inner circumferential face 40 of each front-side groove 36 (hereinafter referred to as "front inside wall face") 40, and an outer circumferential face 42 of each front-side groove 36 (hereinafter referred to as "front outside wall face") 42 are both made slant faces that are slant by a given angle $\alpha t$ with respect to the center axis 18. In short, in the front-side grooves 36 in the present embodiment, the front inside wall face 40 and the front outside wall face 42 are mutually parallel faces, with the front-side grooves 36 having a substantially constant width dimension Bt over the entirety of the front-side grooves 36, not only in the circumferential direction but also the depthwise direction thereof. In the polishing pad 32 as shown in FIG. 3, the front-side grooves 36 going towards the opening thereof moves gradually further away toward the outer diameter side from the center axis 18 to open diagonally outward in the diametric direction of pad substrate 12. In the polishing pad 34 as shown in FIG. 4, the front-side grooves 36 going towards the opening thereof moves gradually closer to the center axis 18 to open diagonally inward in the diametric direction of pad substrate 12.

According to the present embodiment, the back-side grooves 38 are formed as slant grooves that are slant by a given angle with respect to the center axis of the pad substrates, also. More specifically, an inner circumferential face 44 of each back-side groove 38 (hereinafter referred to as "back inside wall face") 44, and an outer circumferential face 46 of each back-side groove 38 (hereinafter referred to as "back outside wall face") 44 are both made slant faces that are slant by an given angle αb with respect to the center axis 18. In short, in the back-side grooves 38 in the present embodiment, the back inside wall face 44 and the back outer circumferential face 46 are mutually parallel faces, with the back-side grooves 38 having a substantially constant width dimension Bb over the entirety of groove 16, not only in the circumferential direction but also the depthwise direction thereof. In the polishing pad 32 as shown in FIG. 3, the back-side grooves 38 going towards the opening thereof moves gradually further away toward the outer diameter side from the center axis 18 to open diagonally outward in the diametric direction of pad substrate 12. In the polishing pad 34 as shown in FIG. 4, the back-side grooves 38 going towards the opening thereof moves gradually closer to the center axis 18 to open diagonally inward in the diametric direction of pad substrate 12.

In the present embodiment, the front-side grooves 36 and the back-side grooves 38 are identical with each other in terms of the depth Dt, Db, the groove width Bt, Bb, the radial pitch Pt, Pb and the slant angle αt, αb, respectively, and they are formed with the same shape on the front surface 14 and the back surface 20. Accordingly, the polishing pads 32, 34 in the present embodiment have the same shape at both front surface 14 and the back surface 20.

Specific design values for the various dimensions, for the front-side grooves 36 and the back-side grooves 38, may be selected giving overall consideration to the material, thickness dimension, and outside diameter dimension of the pad substrate 12, as well as the material of the wafer being polished, the configuration and material of metallization deposited on the wafer, the required polishing precision and the like, and as such are not particularly limited. Preferably, however, values for the front-side and back-side grooves 36, 38, e.g., the groove width Bt, Bb, the depth Dt, Db, and the radial pitch Pt, Pb may fall within the following ranges.

[For Circumferential Groove of Generally Circular Shape]

$0.005\ \text{mm} \leqq Bt = Bb \leqq 3.0\ \text{mm}$ $0.1\ \text{mm} \leqq Dt = Db \leqq 2.0\ \text{mm}$ $0.1\ \text{mm} \leqq Pt = Pb \leqq 10.0\ \text{mm}$ $-50° \leqq \alpha t = \alpha b \leqq 50°$ More preferably, the values may fall within the following range.

[For Circumferential Groove of Generally Circular Shape]

$0.005\ \text{mm} \leqq Bt = Bb \leqq 2.0\ \text{mm}$ (Yet more preferably $0.005\ \text{mm} \leqq Bt = Bb \leqq 1.0\ \text{mm}$)

$0.1\ \text{mm} \leqq Dt = Db \leqq 1.0\ \text{mm}$ $0.2\ \text{mm} \leqq Pt = Pb \leqq 2.0\ \text{mm}$ $-45° \leqq \alpha t = \alpha b \leqq 45°$ If the slant angle αt, αb for the front inside and outside wall faces 40, 42 (the back inside and outside wall faces 44, 46) is too small, it becomes difficult to give sufficient elasticity to the polishing pads 32, 34, leading to a likelihood of malfunction of the pads. On the other hand, if the slant angle αt, αb for the front inside and outside wall faces 40, 42 (the back inside and outside wall faces 44, 46) is too large, the pads become difficult to manufacture. In addition, the strength of side wall portions of the front-side grooves 36 (back-side grooves 38) become lower, leading to unstable surface pressure distribution, or insufficient durability of the polishing pads 32, 34.

The polishing pads 32, 34 of construction according to the present embodiment are able to solve (Problem 1), (Problem 2) and (Problem 4) selected from among the conventional problems as stated above. In particular, since the front-side grooves 36 and the back-side grooves 38 are formed as the slant grooves sloped with respect to the center axis 18, it is possible to provide the polishing pads 32, 34 with a relatively large elasticity effectively.

Embodiment B

Figure 5:
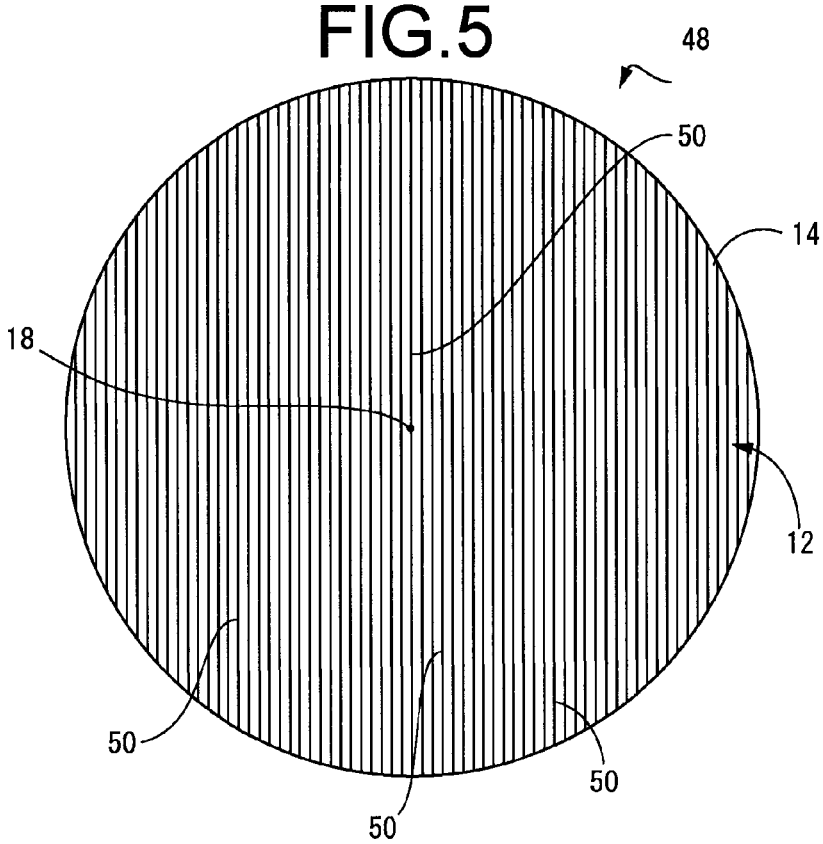
[FIG. 5] It is a top plane view showing a polishing pad of construction according to one embodiment of the invention.
Figure 6:
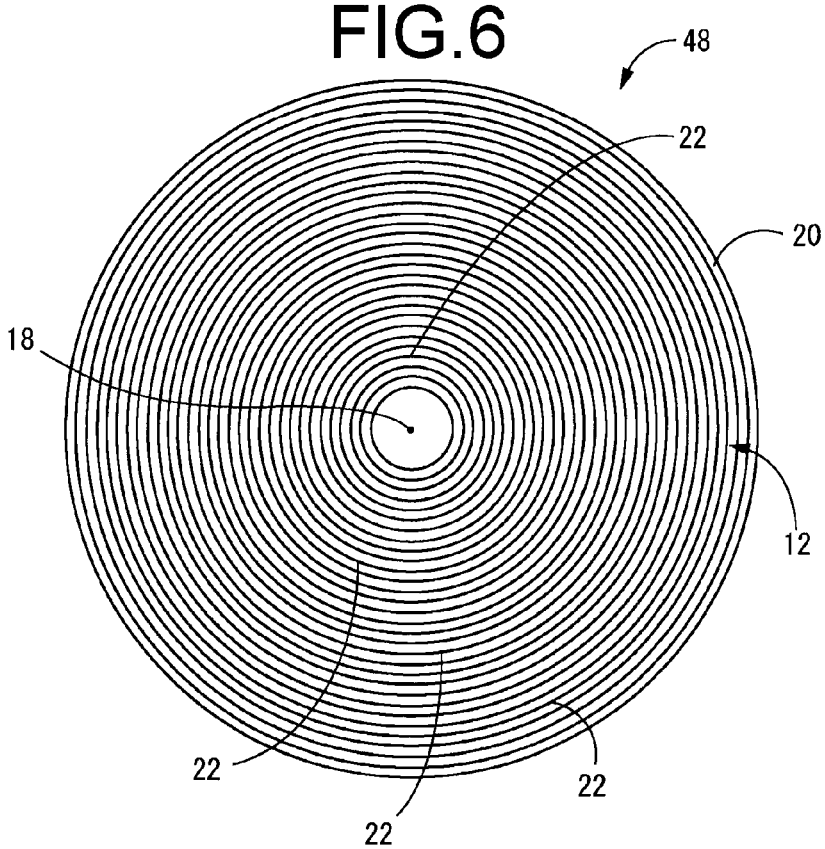
[FIG. 6] It is a bottom plane view of the polishing pad shown in FIG. 5.
Figure 7:
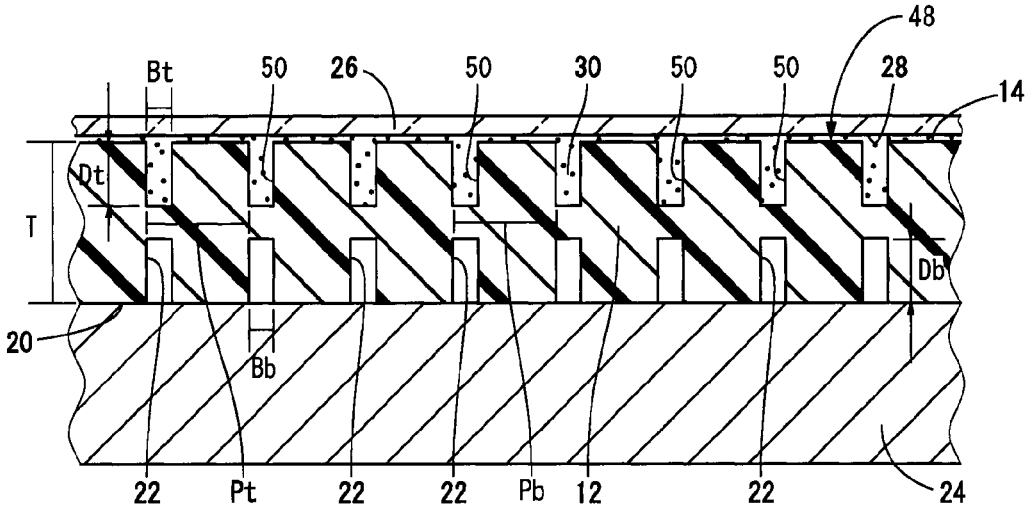
[FIG. 7] It is a vertical cross sectional view of the polishing pad shown in FIG. 5 in a state of being mounted on a polishing apparatus.

Referring next to FIGS. 5-7, shown is a polishing pad 48 of construction according to one embodiment of the present invention.

More specifically, the polishing pad 48 is constituted by a thin disk shaped pad substrate 12 having a constant thickness dimension T overall. The pad substrate 12 is advantageously formed of rigid expanded or non-expanded synthetic resin material, rigid rubber material, textile material, inorganic material, or other possible material. In the present embodiment, the pad substrate 12 is formed of an expanded urethane, for example. The pad thickness dimension is not particularly limited, and may be selected appropriately depending not only on the material of the pad substrate 12 but also the material of the wafer being polished, the required degree of polishing precision, and the like.

One surface of the pad substrate 12, i.e. the front surface 14 has front-side grooves 50 serving as linear grooves composed of a plurality of grooves 50, 50, 50 . . . extending linearly in one diametric direction while being parallel to each other, and to be open in the front surface 14, as shown in FIG. 5.

Specific design values for the various dimensions, for the front-side grooves 50 may be selected giving overall consideration to the material, thickness dimension, and outside diameter dimension of the pad substrate 12, as well as the material of the wafer being polished, the configuration and material of metallization deposited on the wafer, the required polishing precision and the like, and as such are not particularly limited. Preferably, however, values for the front-side grooves 50, e.g., the groove width Bt, the groove depth Dt, and the radial pitch Pt may fall within the following ranges.

[For Linear Groove]

$0.005\ \text{mm} \leqq Bt \leqq 5.0\ \text{mm}$ $0.1\ \text{mm} \leqq Dt \leqq 2.0\ \text{mm}$ $0.1\ \text{mm} \leqq Pt \leqq 60.0\ \text{mm}$ More preferably, the values may fall within the following range.

[For Linear Groove]

$0.005\ \text{mm} \leqq Bt \leqq 3.0\ \text{mm}$ $0.1\ \text{mm} \leqq Dt \leqq 1.0\ \text{mm}$ $0.2\ \text{mm} \leqq Pt \leqq 10.0\ \text{mm}$ Namely, if the groove width Bt is too small, it becomes difficult to achieve the slurry flow controlling action afforded by the front-side grooves 50, and the front-side grooves 50 will tend to become clogged with polishing residues and the like, so that consistent effect is not readily achieved. On the other hand, if groove width Bt is too large, the elasticity of the polishing pad 48 owing to the front-side grooves 50 become too large. In addition, the edge portions (edges of the opening) of the front-side grooves 50 will have increased contact pressure against the wafer, tending to bite into the workpiece during polishing, making it difficult to achieve consistent polishing.

If the groove depth Dt of the front-side grooves 50 is too small, the rigidity in the front surface 14 of the polishing pad 10 will become too large to exhibit elasticity of the polishing pad 48 in the front surface 14 effectively, whereby it will tend to become difficult to execute precise polishing. On the other hand, if the groove depth Dt, of the front-side grooves 50 is too large, excess elasticity is given to the polishing pad 48 owing to the front-side grooves 50. In addition, the polishing pad 48 will become difficult to manufacture and the front surface 14 thereof will tend to deform easily, and there is a risk of stick slip, whereby polishing tends to be inconsistent.

If the radial pitch Pt of the front-side grooves 50 is too small, the pad becomes difficult to manufacture, and the front surface 14 of the polishing pad 48 will tend to deform or become damaged easily, making it difficult to achieve consistent polishing. If, on the other hand, the radial pitch Pt of the front-side grooves 50 is too large, it becomes difficult to realize desired polishing precision, resulting in deterioration in polishing efficiency.

On the other hand, the other surface of the pad substrate 12, i.e. a back surface 20 has a plurality of back-side grooves 22 serving as back-side annular grooves formed thereon so as to extend in a circumferential direction about the center axis 18 of the pad substrate, and to be open in the back surface 20. In the present embodiment, as shown in FIG. 6, the back-side grooves 22 are composed of a plurality of circular grooves 22, 22, 22 . . . extending coaxially about the center axis 18 with respective radii of curvatures different from each other.

Specific design values for the various dimensions, for the back-side grooves 22 may be selected giving overall consideration to the material, thickness dimension, and outside diameter dimension of the pad substrate 12, as well as the material of the wafer being polished, the configuration and material of metallization deposited on the wafer, the required polishing precision and the like, and as such are not particularly limited. Preferably, however, values for the back-side grooves 22, e.g., the groove width Bb, the groove depth Db, and the radial pitch Pb may fall within the following ranges.

[For Circumferential Groove of Generally Circular Shape]

$0.005\ \text{mm} \leqq Bb \leqq 3.0\ \text{mm}$ $0.1\ \text{mm} \leqq Db \leqq 2.0\ \text{mm}$ $0.1\ \text{mm} \leqq Pb \leqq 5.0\ \text{mm}$ More preferably, the values may fall within the following range.

[For Circumferential Groove of Generally Circular Shape]

$0.005\ \text{mm} \leqq Bb \leqq 2.0\ \text{mm}$ (Yet more preferably $0.005\ \text{mm} \leqq Bb \leqq 1.0\ \text{mm}$)

$0.1\ \text{mm} \leqq Db \leqq 1.0\ \text{mm}$ $0.2\ \text{mm} \leqq Pb \leqq 1.0\ \text{mm}$ Namely, if the groove width and depth Bb, Db for the back-side grooves 22 is too small, it become difficult to provide the polishing pad 48 with sufficient elasticity, making it difficult to realize desired polishing precision. On the other hand, if the groove width Bb, Db for the back-side grooves 22 are too large, the front surface 14 of the polishing pad 48 will exhibit excess elasticity, leading to a likelihood of deterioration in polishing precision.

If the radial pitch Pb for the back-side grooves 22 is too small, the pad becomes difficult to manufacture, and will tend to become damaged easily, making it difficult to achieve consistent polishing. If on the other hand radial pitch Pb for the back-side grooves 22 is too large, the number of the circular grooves 22 composing the back-side grooves 22 get reduced. Therefore, elasticity generated on the front surface 14 of the polishing pad 48 will vary depending on the radial position of the polishing pad 48, making it difficult to carry out uniform polishing efficiently.

Bottom faces of the front-side grooves 50 and the back-side grooves 22 may have a variety of shapes including a curved face and a flat face, but not limited to a specific shape. In the present embodiment, the bottom faces of the front-side grooves 50 and the back-side grooves 22 are flat faces perpendicular to the center axis 18 of the polishing pad 48. By forming the bottom faces of the front-side and back-side grooves 50, 22 to be parallel to the surface of the polishing pad 48, a gap between bottom wall portions of the front-side and back-side grooves 50, 22 is effectively obtained to ensure excellent rigidity of the pad, even if the effective depth for the front-side and back-side grooves 50, 22 is made large.

Moreover, the sum of the groove depth Dt for the front-side grooves 50 and the groove depth Db for the back-side grooves 22 (i.e. the total value of (Dt+Db)) is made smaller than the thickness T of the pad substrate 12. More specifically, in the present embodiment, the thickness T may fall within the following ranges.

$0.5\ \text{mm} \leqq T \leqq 10.0\ \text{mm}$

More preferably, the value may fall within the following range.

$1.0\ \text{mm} \leqq T \leqq 3.0\ \text{mm}$

The polishing pad 48 having the front surface 14 and the back surface 20 as discussed above, is used for polishing a wafer or the like in the conventional manner. More specifically, as shown in FIG. 7, for example, the polishing pad 48 is arranged on the support face of a rotation plate (support plate) 24 of a polishing apparatus, and clamped against the rotation plate by air-reduced negative pressure suction, double-sided bonding or other means. Next, while rotating the polishing pad 48 about its center axis 18, a wafer 26 is juxtaposed against the front surface 14 for polishing. Generally, during this polishing process, an abrasive liquid (slurry) 30 is supplied to the opposing faces, i.e. the front surface 14 of the polishing pad 48 and the process face 28 of the wafer 26, like the conventional manner, while also rotating the wafer 26 itself about its center axis. The slurry 30 is supplied, for example, to the surface of the polishing pad 48 from the vicinity of the central portion of the polishing pad 48 so as to be spread out over the surface of the polishing pad 48 due to the action of centrifugal force created by rotation of polishing pad 48 about the center axis 18.

The polishing pad 48 of construction according to the present embodiment is able to solve (Problem 1), (Problem 3) and (Problem 4) selected from among the conventional problems as stated above.

Namely, in the present embodiment, the front-side grooves 50 extend linearly on the front surface 14, while the back-side grooves 22 extend circumferentially on the back surface 20 of the polishing pad 48. The front surface 14 and the back surface 20 of the polishing pad 48 can be readily distinguished from each other by viewing. Accordingly, the polishing pad 48 can be mounted securely while avoiding being mounted upside down.

Further, the back-side grooves 22 are the annular grooves extending in the circumferential direction. This makes it possible to effectively prevent that the slurry 30 supplied on the front surface 14 is led along an outer circumferential surface of the pad into the back surface 20. This arrangements may prevent occurrence of problems such as dislodging of the polishing pad from the rotation plate 24, or displacement of the polishing pad on the rotation plate 24, making it possible to execute polishing process with high stability.

In addition, by setting for the back-side grooves 22 the groove width Bb, the depth Db, and the radial pitch Pb within the given ranges, a sufficient elasticity of the polishing pad 48 can be realized, while a sufficient bonding force between the back surface 20 and the rotation plate 24, thereby realizing high reliability.

Moreover, the sum of the groove depth Dt for the front-side grooves 50 and the groove depth Db for the back-side grooves 22 (i.e. the total value of (Dt+Db)) is made smaller than the thickness of the pad substrate 12. This makes it possible to give appropriate elasticity to the polishing pad 48, while keeping sufficient rigidity, whereby polishing precision can be realized advantageously.

Figure 8:
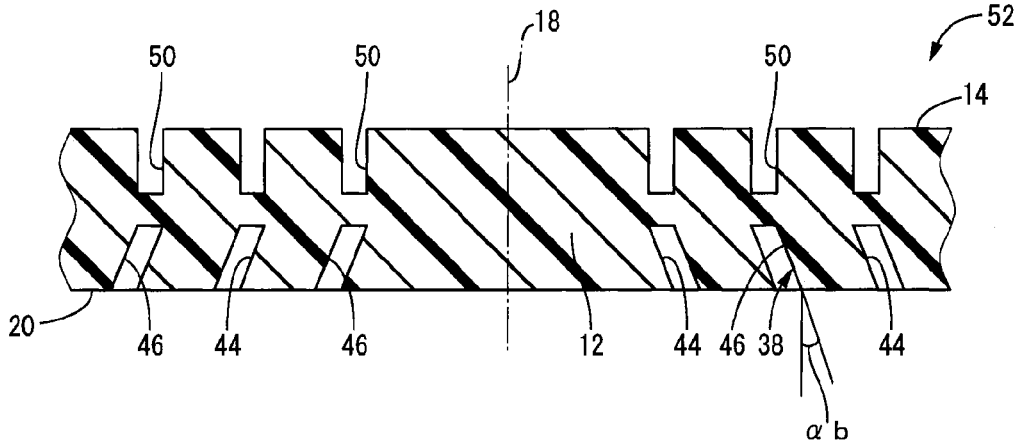
[FIG. 8] It is a vertical cross sectional view of a polishing pad of construction according to another embodiment of the invention.
Figure 9:
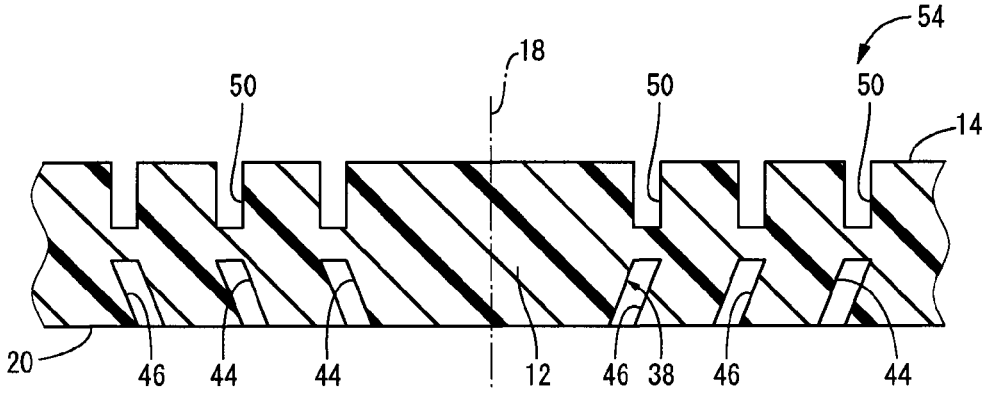
[FIG. 9] It is a vertical cross sectional view of a polishing pad of construction according to another embodiment of the invention.

Referring next to FIGS. 8 and 9, shown are polishing pads 52, 54 of construction according to another embodiment of the present invention as defined in any one of claims 2, 9, 10, and 13. In the interest of brevity and simplification, the same reference numerals as used in the foregoing embodiment will be used in the following embodiments to identify the corresponding components, and redundant description of these components will not be provided.

One surface of the pad substrate 12, i.e. the front surface 14 has front-side grooves 50 serving as linear grooves composed of a plurality of grooves extending linearly in one diametric direction while being parallel to each other, and to be open in the front surface 14.

On the other hand, the other surface of the pad substrate 12, i.e. the back surface 20 has a plurality of back-side grooves 38 formed thereon so as to extend in a circumferential direction about the center axis 18 of the pad substrate 12, and to be open in the back surface 20. In the present embodiment, the back-side grooves 38 are composed of a plurality of circular grooves 38, 38, 38 . . . extending coaxially about the center axis 18 with respective radii of curvatures different from each other.

In the present embodiment, the back-side grooves 38 are formed as slant grooves that are slant by a given angle with respect to the center axis 18 of the pad substrate. More specifically, an inner circumferential face 44 of each back-side groove 38 (hereinafter referred to as "back inside wall face") 44, and an outer circumferential face 46 of each back-side groove 38 (hereinafter referred to as "back outside wall face" ) 46 are both made slant faces that are slant by a given angle $\alpha$ b with respect to the center axis 18. In short, in the back-side grooves 38 in the present embodiment, the back inside wall face 44 and the back outside wall face 46 are mutually parallel faces, with the back-side grooves 38 having a substantially constant width dimension Bb over the entirety of the back-side grooves 38, not only in the circumferential direction but also the depthwise direction thereof. In the polishing pad 52 as shown in FIG. 8, the back-side grooves 38 going towards the opening thereof moves gradually further away toward the outer diameter side from the center axis 18 to open diagonally outward in the diametric direction of pad substrate 12. In the polishing pad 54 as shown in FIG. 9, the back-side grooves 38 going towards the opening thereof moves gradually closer to the center axis 18 to open diagonally inward in the diametric direction of pad substrate 12.

Specific design values for the various dimensions, for the back-side grooves 38 may be selected giving overall consideration to the material, thickness dimension, and outside diameter dimension of the pad substrate 12, as well as the material of the wafer being polished, the configuration and material of metallization deposited on the wafer, the required polishing precision and the like, and as such are not particularly limited. Preferably, however, values for the back-side grooves 38, e.g., the groove width Bb, the groove depth Db, and the radial pitch Pb may fall within the following ranges.

$0.005\ \text{mm} \leqq Bb \leqq 3.0\ \text{mm}$ $0.1\ \text{mm} \leqq Db \leqq 2.0\ \text{mm}$ $0.1\ \text{mm} \leqq Pb \leqq 5.0\ \text{mm}$ $-50° \leqq \alpha b \leqq 50°$ More preferably, the values may fall within the following range.

$0.005\ \text{mm} \leqq Bb \leqq 2.0\ \text{mm}$ (Yet more preferably $0.005\ \text{mm} \leqq Bb \leqq 1.0\ \text{mm}$)

$0.1\ \text{mm} \leqq Db \leqq 1.0\ \text{mm}$ $0.2\ \text{mm} \leqq Pb \leqq 2.0\ \text{mm}$ $-45° \leqq \alpha b \leqq -20°$ or $20° \leqq \alpha b \leqq 45°$ If the slant angle $\alpha$b for the back inside and outside wall faces 44, 46 is too small, it becomes difficult to give sufficient elasticity to the polishing pads 52, 54, leading to a likelihood of malfunction of the pads. On the other hand, if the slant angle $\alpha$b for the back inside and outside wall faces 44, 46 is too large, the pads become difficult to manufacture. In addition, the strength of side wall portions of the back-side grooves 38 become lower, leading to unstable surface pressure distribution, or insufficient durability of the polishing pads 52, 54.

The polishing pads 52, 54 of construction according to the present embodiment are able to solve (Problem 1), (Problem 2) (Problem 3) and (Problem 4) selected from among the conventional problems as stated above.

Figure 10:
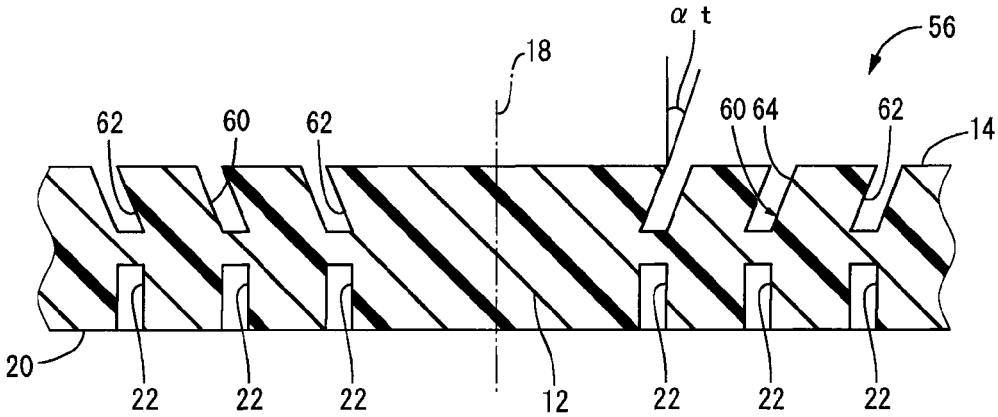
[FIG. 10] It is a vertical cross sectional view of a polishing pad of construction according to another embodiment of the invention.
Figure 11:
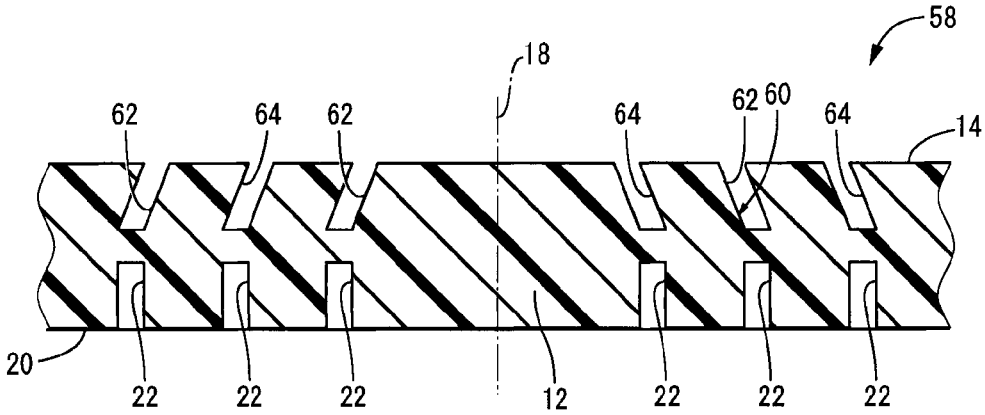
[FIG. 11] It is a vertical cross sectional view of a polishing pad of construction according to another embodiment of the invention.

Referring next to FIGS. 10 and 11, shown are polishing pads 56, 58 of construction according to another embodiment of the present invention as defined in any one of claims 2, 11, 12 and 13. In the interest of brevity and simplification, the same reference numerals as used in the foregoing embodiment will be used in the following embodiments to identify the corresponding components, and redundant description of these components will not be provided.

One surface of the pad substrate 12, i.e. the front surface 14 has front-side grooves 60 serving as linear grooves composed of a plurality of grooves extending linearly in one diametric direction while being parallel to each other, and to be open in the front surface 14.

In the present embodiment, the front-side grooves 60 are formed as slant grooves that are slant with a constant slant angle with respect to the center axis of the pad substrate 12 (i.e. a straight line parallel to the center axis 18). More specifically, an inner circumferential face 62 of each front-side groove 60 (hereinafter referred to as "front inside wall face") 62, and an outer circumferential face 64 of each front-side groove 60 (hereinafter referred to as "front outside wall face") 64 are both made slant faces that are slant by a given angle $\alpha$t with respect to the center axis 18 (i.e. $\alpha$t=an angle of intersection against the straight line parallel to the center axis 18). In short, in the front-side grooves 60 in the present embodiment, the front inside wall face 62 and the front outside wall face 64 are mutually parallel faces, with the front-side grooves 60 having a substantially constant width dimension Bt over the entirety of the front-side grooves 60, not only in the circumferential direction but also in the depthwise direction thereof. In the polishing pad 56 as shown in FIG. 10, the front-side grooves 60 going towards the opening thereof moves gradually further away toward the outer diameter side from the center axis 18 to open diagonally outward in the diametric direction of pad substrate 12. In the polishing pad 58 as shown in FIG. 11, the front-side grooves 60 going towards the opening thereof moves gradually closer to the center axis 18 to open diagonally inward in the diametric direction of pad substrate 12.

Specific design values for the various dimensions, for the front-side grooves 60 may be selected giving overall consideration to the material, thickness dimension, and outside diameter dimension of the pad substrate 12, as well as the material of the wafer being polished, the configuration and material of metallization deposited on the wafer, the required polishing precision and the like, and as such are not particularly limited. Preferably, however, values for the front-side grooves 60, e.g., the groove width Bt, the groove depth Dt, the radial pitch Pt, and the slant angle $\alpha$t may fall within the following ranges.

[For Linear Groove]

0.005 mm≦Bt≦5.0 mm 0.1 mm≦Dt≦2.0 mm 0.1 mm≦Pt≦60.0 mm

−30°≦αb≦30°

More preferably, the values may fall within the following range.

[For Linear Groove]

0.005 mm≦Bt≦3.0 mm 0.1 mm≦Dt≦1.0 mm 0.2 mm≦Pt≦10.0 mm

−30°≦αt≦−10° or 10°≦αt≦30°

If the slant angle αt for the front inside and outside wall faces 62, 64 is too small, it becomes difficult to give sufficient elasticity to the polishing pads 56, 58, leading to a likelihood of malfunction of the pads. On the other hand, if the slant angle αt for the front inside and outside wall faces 62, 64 is too large, the pads become difficult to manufacture. In addition, the strength of side wall portions of the front-side grooves 60 become lower, leading to unstable surface pressure distribution, or insufficient durability of the polishing pads 56, 58.

On the other hand, the other surface of the pad substrate 12, i.e. the back surface 20 has a plurality of back-side grooves 22 composed of a plurality of circular grooves 22, 22, 22 . . . extending coaxially about the center axis 18 while being open in the back surface 20.

The polishing pads 56, 58 of construction according to the present embodiment are able to solve (Problem 1), (Problem 3) and (Problem 4) selected from among the conventional problems as stated above.

Referring next to FIGS. 12-15, shown are polishing pads 66, 68, 70 and 72 of construction according to another embodiment of the present invention as defined in any one of claims 2, 9, 10, 11, 12 and 13. In the interest of brevity and simplification, the same reference numerals as used in the foregoing embodiment will be used in the following embodiments to identify the corresponding components, and redundant description of these components will not be provided.

More specifically, in the polishing pads 66, 68, 70 and 72, the front surface 14 has front-side grooves 60 composed of a plurality of slant grooves extending linearly in one diametric direction, while the back surface 20 has back-side grooves 38 composed of a plurality of slant grooves extending circumferentially.

Figure 12:
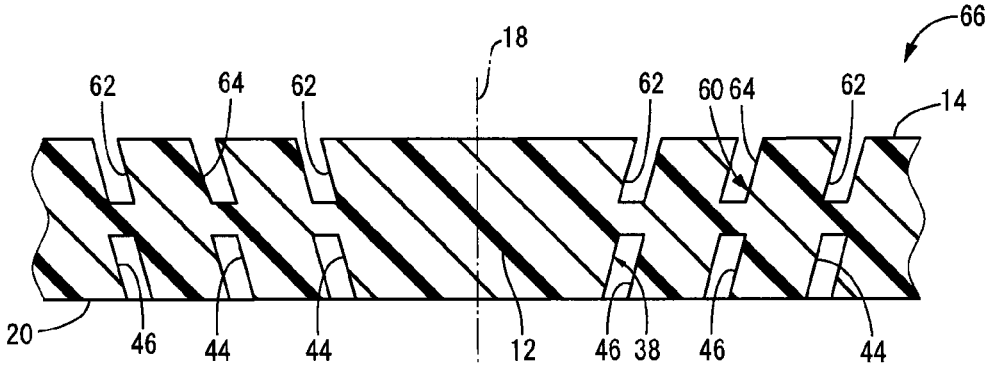
[FIG. 12] It is a vertical cross sectional view of a polishing pad of construction according to another embodiment of the invention.

In the polishing pad 66, as shown in FIG. 12, the front-side grooves 60 are formed opening diagonally outward in the diametric direction, and the back-side grooves 38 are formed opening toward diagonally inward in the diametric direction.

Figure 13:
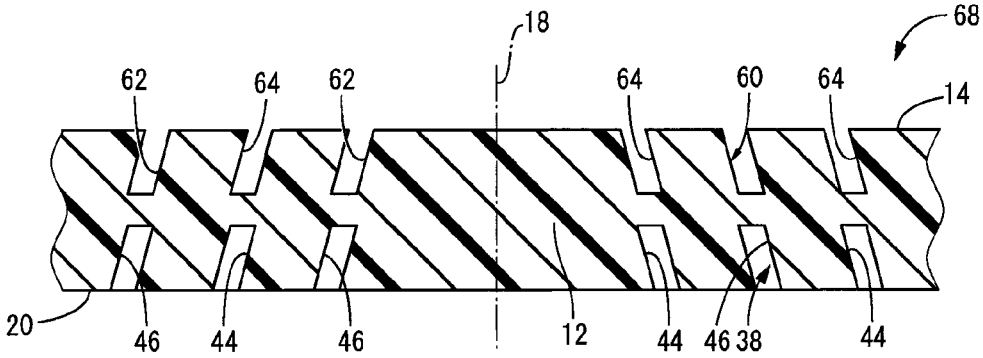
[FIG. 13] It is a vertical cross sectional view of a polishing pad of construction according to another embodiment of the invention.

In the polishing pad 68, as shown in FIG. 13, the front-side grooves 60 are formed opening toward diagonally inward in the diametric direction, and the back-side grooves 38 are formed opening toward diagonally outward in the diametric direction.

Figure 14:
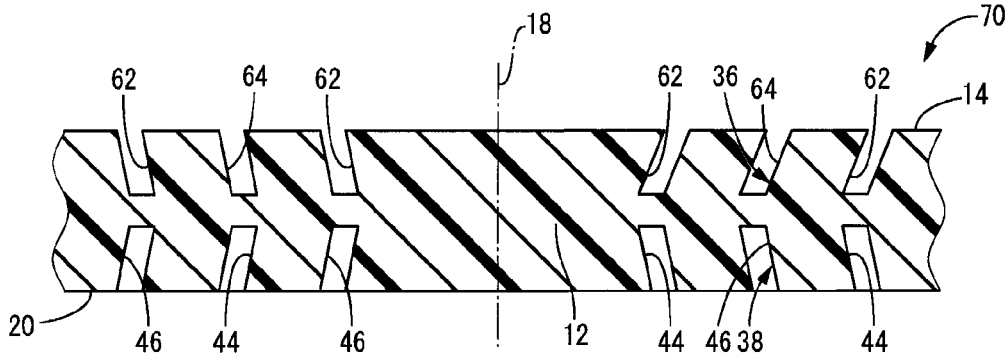
[FIG. 14] It is a vertical cross sectional view of a polishing pad of construction according to another embodiment of the invention.

In the polishing pad 70, as shown in FIG. 14, the front-side grooves 60 are formed opening toward diagonally outward in the diametric direction, and the back-side grooves 38 are formed opening toward diagonally outward in the diametric direction.

Figure 15:
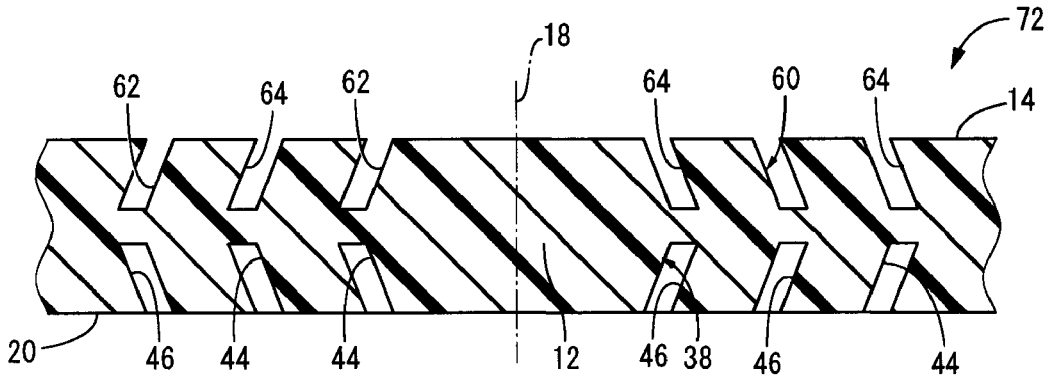
[FIG. 15] It is a vertical cross sectional view of a polishing pad of construction according to another embodiment of the invention.

In the polishing pad 72, as shown in FIG. 15, the front-side grooves 60 are formed opening toward diagonally inward in the diametric direction, and the back-side grooves 38 are formed opening toward diagonally inward in the diametric direction.

The polishing pads 66, 68, 70 and 72 of construction according to the present embodiment are able to solve (Problem 1), (Problem 2), (Problem 3) and (Problem 4) selected from among the conventional problems as stated above.

Embodiment C

Figure 16:
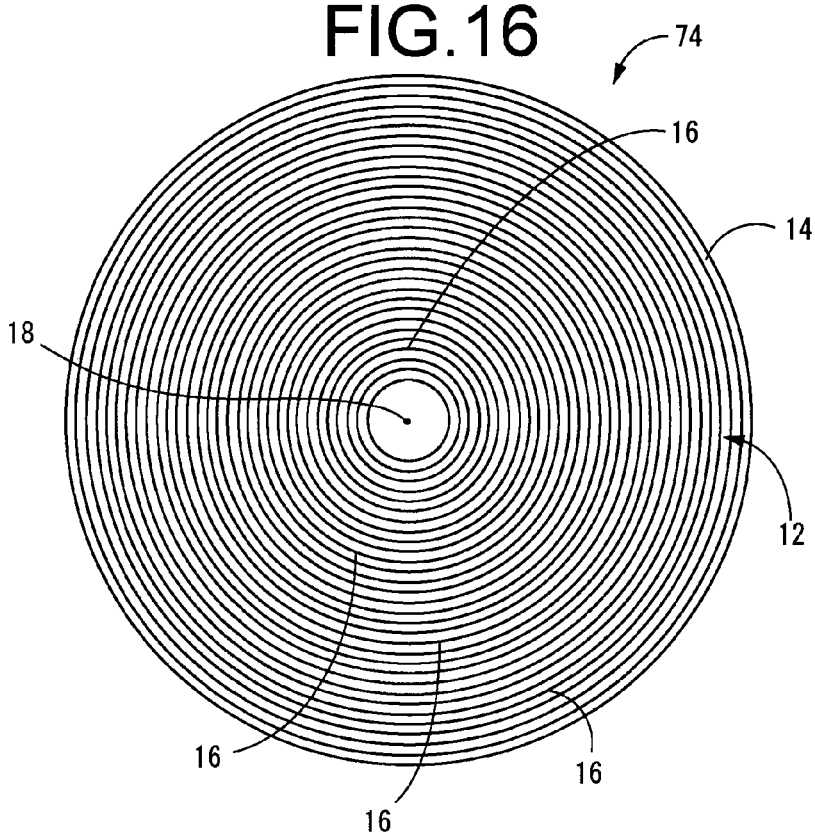
[FIG. 16] It is a top plane view showing a polishing pad of construction according to one embodiment of the invention.
Figure 17:
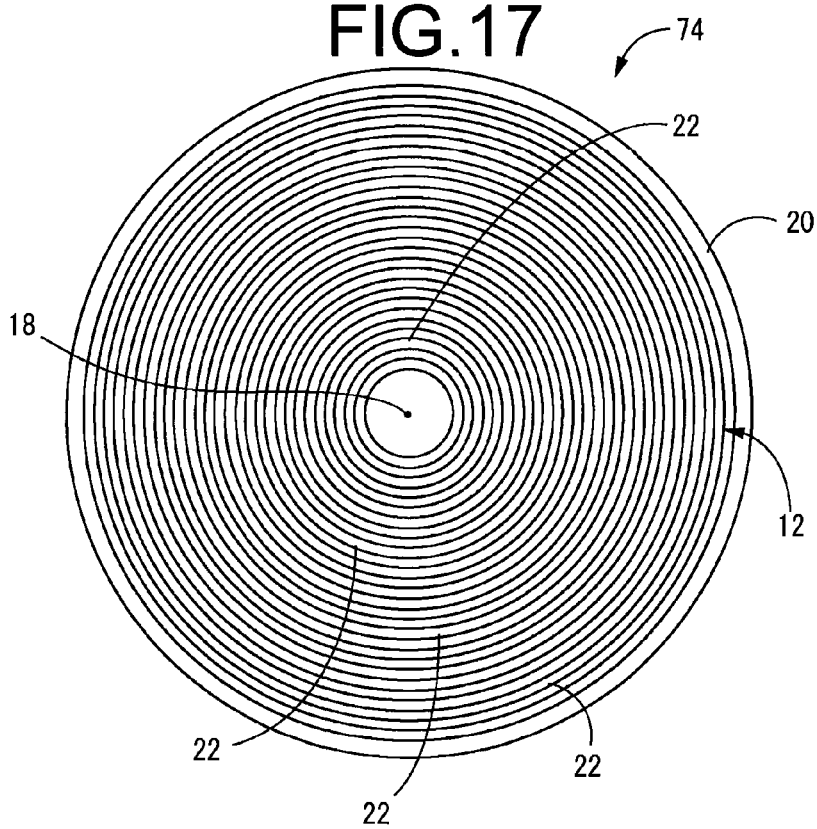
[FIG. 17] It is a bottom plane view of the polishing pad shown in FIG. 16.
Figure 18:
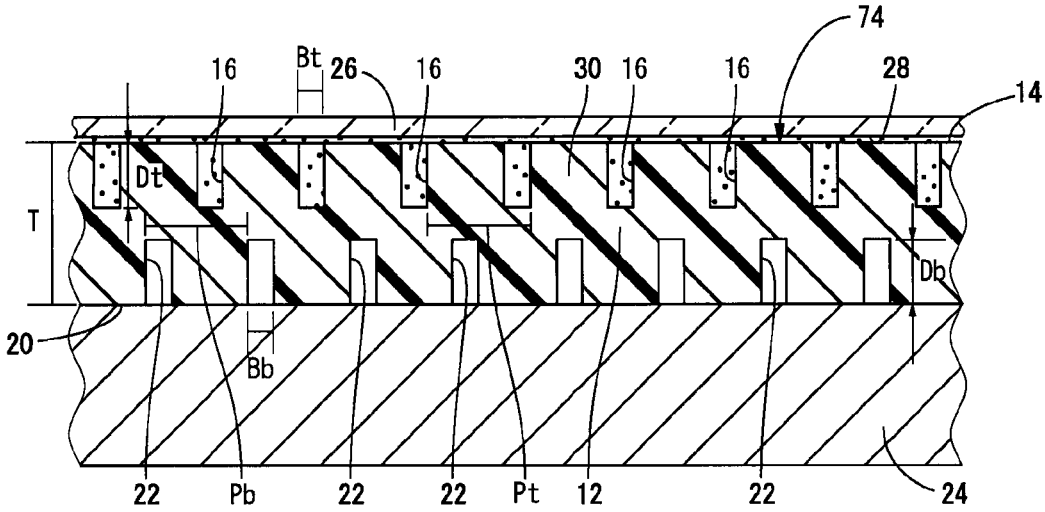
[FIG. 18] It is a vertical cross sectional view of the polishing pad shown in FIG. 16 in a state of being mounted on a polishing apparatus.

Referring next to FIGS. 16-18, shown is a polishing pad 74 of construction according to another embodiment of the present invention as defined in any one of claims 1, 3, 4, 5, 8 and 13.

More specifically, the polishing pad 74 is constituted by a thin disk shaped pad substrate 12 having a constant thickness dimension T overall. The pad substrate 12 is advantageously formed of rigid expanded or non-expanded synthetic resin material, rigid rubber material, textile material, inorganic material, or other possible material. In the present embodiment, the pad substrate 12 is formed of an expanded urethane, for example. The pad thickness dimension is not particularly limited, and may be selected appropriately depending not only on the material of the pad substrate 12 but also the material of the wafer being polished, the required degree of polishing precision, and the like.

One surface of the pad substrate 12, i.e. the front surface 14 has front-side grooves 16 serving as front-side annular grooves formed thereon composed of annular grooves extending in a circumferential direction about a center axis 18 of the pad substrate 12, and to be open in the front surface 14.

In this embodiment, the front-side grooves 16 are composed of a plurality of circular grooves 16, 16, 16 . . . each extending about the center axis 18 as its center of curvature, but at mutually different radii of curvature, as shown in FIG. 16.

Specific design values for the various dimensions, for the front-side grooves 16 may be selected giving overall consideration to the material, thickness dimension, and outside diameter dimension of the pad substrate 12, as well as the material of the wafer being polished, the configuration and material of metallization deposited on the wafer, the required polishing precision and the like, and as such are not particularly limited. Preferably, however, values for the front-side grooves 16, e.g., the groove width Bt, the depth Dt, and the radial pitch Pt, may fall within the following ranges.

[For Circumferential Groove of Generally Circular Shape]

0.005 mm≦Bt≦3.0 mm 0.1 mm≦Dt≦2.0 mm 0.1 mm≦Pt≦10.0 mm

More preferably, the values may fall within the following range.

[For Circumferential Groove of Generally Circular Shape]

0.005 mm≦Bt≦2.0 mm (Yet more preferably 0.005 mm≦Bt≦1.0 mm)

0.1 mm≦Dt≦1.0 mm 0.2 mm≦Pt≦2.0 mm

Namely, if the groove width Bt for the front-side grooves 16 is too small, the front-side grooves 16 will tend to become clogged with polishing residues and the like, so that consistent effect is not readily achieved, and it becomes difficult to achieve the sufficient. On the other hand, if the groove width Bt for the front-side grooves 16 is too large, excess elasticity is given to the polishing pad 74 owing to the front-side grooves 16, the edge portions (edges of the opening) of the front-side grooves 16 will have increased contact pressure against the wafer, tending to bite into the workpiece during polishing, making it difficult to achieve consistent polishing.

If the groove depth Dt, for the front-side grooves 16 is too small, the rigidity in the front surface 14 of the polishing pad 74 will become too large to exhibit elasticity of the polishing pad 74 in the front surface 14 effectively, whereby it will tend to become difficult to execute precise polishing. On the other hand, if the groove depth Dt for the front-side grooves 16 is too large, excess elasticity is given to the polishing pad 74 owing to the front-side grooves 16, not only is the pad difficult to manufacture, but the front surface 14 of the polishing pad 10 will tend to deform easily, and there is a risk of stick slip, whereby polishing tends to be inconsistent.

If the radial pitch Pt for the front-side grooves 16 is too small, the pad becomes difficult to manufacture, and the front surface 14 of the polishing pad 74 will tend to deform or become damaged easily, making it difficult to achieve consistent polishing. If on the other hand radial pitch Pt for the front-side grooves 16 is too large, there is a risk of deterioration in polishing precision and polishing efficiency.

On the other hand, the other surface of the pad substrate 12, i.e. the back surface 20 has back-side grooves 22 serving as back-side annular grooves composed of circular grooves extending in a circumferential direction about the center axis 18 of the pad substrate 12, and to be open in the back surface 20.

In the present embodiment, the back-side grooves 22 are composed of a plurality of circular grooves 22, 22, 22 . . . each extending about the center axis 18 as its center of curvature, but at mutually different radii of curvature, as shown in FIG. 17.

Specific design values for the various dimensions, for the back-side grooves 22 may be selected giving overall consideration to the material, thickness dimension, and outside diameter dimension of the pad substrate 12, as well as the material of the wafer being polished, the configuration and material of metallization deposited on the wafer, the required polishing precision and the like, and as such are not particularly limited. Preferably, however, values for the back-side grooves 22, e.g., the groove width Bb, the depth Db, and the radial pitch Pb may fall within the following ranges.

[For Circumferential Groove of Generally Circular Shape]

$0.005\ \text{mm} \leqq Bb \leqq 3.0\ \text{mm}$ $0.1\ \text{mm} \leqq Db \leqq 2.0\ \text{mm}$ $0.1\ \text{mm} \leqq Pb \leqq 5.0\ \text{mm}$ More preferably, the values may fall within the following range.

[For Circumferential Groove of Generally Circular Shape]

$0.005\ \text{mm} \leqq Bb \leqq 2.0\ \text{mm}$ (Yet more preferably $0.005\ \text{mm} \leqq Bb \leqq 1.0\ \text{mm}$)

$0.1\ \text{mm} \leqq Db \leqq 1.0\ \text{mm}$ $0.2\ \text{mm} \leqq Pb \leqq 2.0\ \text{mm}$ Namely, if the groove width and depth Bb, Db for the back-side grooves 22 is too small, it become difficult to provide the polishing pad 74 with sufficient elasticity, making it difficult to realize desired polishing precision. On the other hand, if the groove width and depth Bb, Db for the back-side grooves 22 are too large, the front surface 14 of the polishing pad 74 will exhibit excess elasticity, leading to a likelihood of deterioration in polishing precision.

If the radial pitch Pb for the back-side grooves 22 is too small, the pad becomes difficult to manufacture, and will tend to become damaged easily, making it difficult to achieve consistent polishing. If on the other hand radial pitch Pb for the back-side grooves 22 is too large, the number of the circular grooves 22, 22, 22, . . . composing the back-side grooves 22 get reduced. Therefore, elasticity generated on the front surface 14 of the polishing pad 48 will vary depending on the radial position of the polishing pad 48, making it difficult to carry out uniform polishing efficiently.

Bottom faces of the front-side grooves 16 and the back-side grooves 22 may have a variety of shapes including a curved face and a flat face, but not limited to a specific shape. In the present embodiment, the bottom faces of the front-side grooves 16 and the back-side grooves 22 are flat faces perpendicular to the center axis 18 of the polishing pad 48. By forming the bottom faces of the front-side and back-side grooves 16, 22 to be parallel to the surface of the polishing pad 74, a gap between bottom wall portions of the front-side and back-side grooves 16, 22 is effectively obtained to ensure excellent rigidity of the pad, even if the effective depth for the front-side and back-side grooves 16, 22 is made large.

Moreover, the sum of the groove depth Dt for the front-side grooves 16 and the groove depth Db for the back-side grooves 22 is made smaller than the thickness T of the pad substrate 12. This arrangement will provide the polishing pad 74 with appropriate elasticity, making it possible to enhance polishing precision. In the present embodiment, the thickness T may fall within the following ranges.

$0.5\ \text{mm} \leqq T \leqq 10.0\ \text{mm}$

More preferably, the value may fall within the following range.

$1.0\ \text{mm} \leqq T \leqq 3.0\ \text{mm}$

In the present embodiment, the front-side grooves 16 and the back-side grooves 22 are formed in a specific mutual positional relationship. Described in detail, each front-side groove 16 is formed on the front-surface 14 side at a location between adjacent back-side grooves 22, 22 in the radial direction. In the present embodiment, one front-side groove 16 is formed on the front surface 14 side at a radially central portion between adjacent back-side grooves 22, 22. Likewise, one back-side groove 22 is formed on the back surface 20 side at a radially central portion between adjacent front-side grooves 16. That is, the front-side grooves 16 and the back-side grooves 22 are offset in the diametric direction from each other and appeared by turn in the diametric direction on the front and back surfaces of the pad substrate 12.

The polishing pad 74 having the front surface 14 and the back surface 20 as discussed above, is used for polishing a wafer or the like in the conventional manner. More specifically, as shown in FIG. 18, for example, the polishing pad 74 is arranged on the support face of a rotation plate (support plate) 24 of a polishing apparatus, and clamped against the rotation plate by air-reduced negative pressure suction, double-sided bonding or other means. Next, while rotating the polishing pad 74 about its center axis 18, a wafer 26 is juxtaposed against the front surface 14 for polishing. Generally, during this polishing process, an abrasive liquid (slurry) 30 is supplied to opposing the faces, i.e. the front surface 14 of the polishing pad 74 and the process face 28 of the wafer 26, like the conventional manner, while also rotating the wafer 26 itself about its center axis. The slurry 30 is supplied, for example, to the surface of the polishing pad 74 from the vicinity of the central portion of the polishing pad 74 so as to be spread out over the surface of the polishing pad 74 due to the action of centrifugal force created by rotation of polishing pad 74 about the center axis 18.

The polishing pad 74 of construction according to the present embodiment is able to solve (Problem 1), (Problem 2) and (Problem 4) selected from among the conventional problems as stated above.

Namely, once a surface pressure is applied to a portion of the front surface 14 of the polishing pad 74 (contact surface) that is brought into contact with a processing object, i.e. a member to be polished, a load applied to the contact surface is transmitted in the axially downward direction. In the present embodiment, a portion which defines the contact surface on the front surface 14 side is formed with the back-side groove 22 on the back surface 20 side, thereby providing elasticity. Accordingly, the polishing pad 74 will undergo elastic deformation so as to eliminate the load applied to its contact surface. That is, by forming the back-side grooves, a desired elasticity can be exhibited on the front surface, while a sufficient bonding surface area of the back surface 20 against the rotation plate (support plate) 24 can be obtained. This makes it possible to execute a polishing process with high planarity and uniformity.

Furthermore, since the front-side grooves 16 and the back-side grooves 22 formed respectively on the front surface 14 and the back surface 20 of the polishing pad 74 are composed of circular grooves extending in the circumferential direction, these grooves can be produced with ease, thereby enhancing production efficiency of the polishing pad.

Further, the back-side grooves 22 are the annular grooves extending in the circumferential direction. This makes it possible to effectively prevent that the slurry 30 supplied on the front surface 14 is led along an outer circumferential surface of the pad into the back surface 20. This arrangements may prevent occurrence of problems such as dislodging of the polishing pad 74 from the rotation plate 24, or displacement of the polishing pad 74 on the rotation plate 24, making it possible to execute polishing process with high stability.

In addition, by setting for the back-side grooves 22 the groove width Bb, the depth Db, and the radial pitch Pb within the given ranges, a sufficient elasticity of the polishing pad 74 can be realized, while a sufficient bonding force between the back surface 20 and the rotation plate 24, thereby realizing high reliability.

Moreover, the sum of the groove depth Dt for the front-side grooves 16 and the groove depth Db for the back-side grooves 22 (i.e. the total value of (Dt+Db)) is made smaller than the thickness of the pad substrate 12. This makes it possible to give appropriate elasticity to the polishing pad 48, while keeping sufficient rigidity, whereby polishing precision can be realized advantageously.

Figure 19:
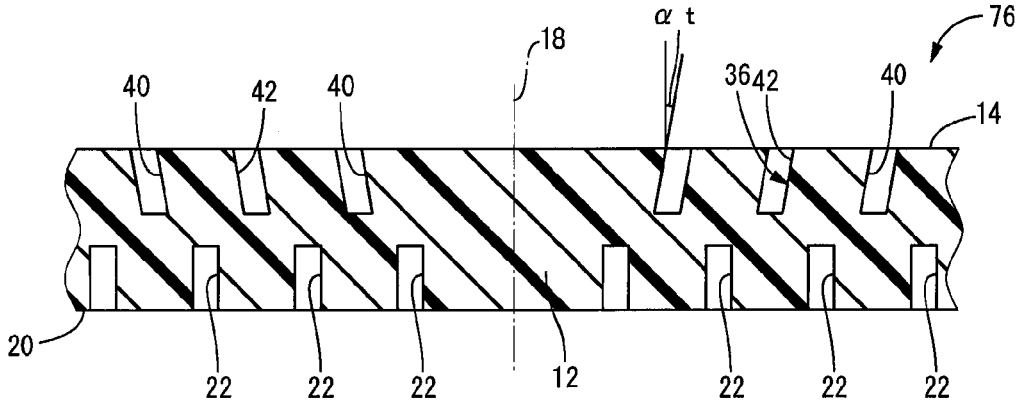
[FIG. 19] It is a vertical cross sectional view of a polishing pad of construction according to another embodiment of the invention.
Figure 20:
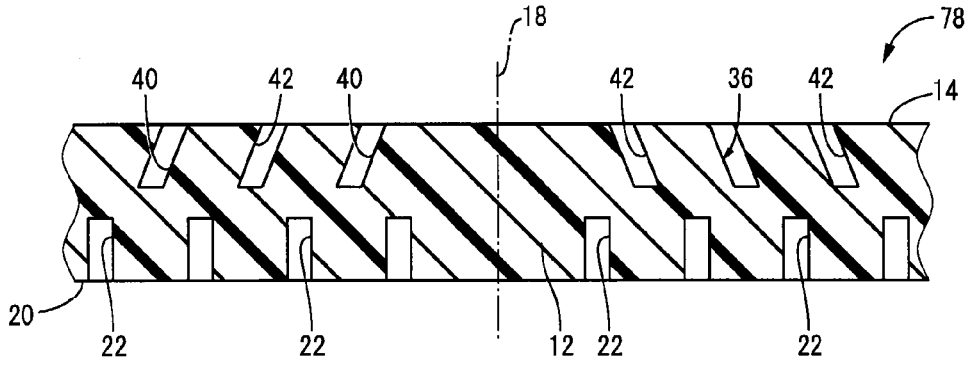
[FIG. 20] It is a vertical cross sectional view of a polishing pad of construction according to another embodiment of the invention.

Referring next to FIGS. 19 and 20, shown are polishing pads 76, 78 of construction according to another embodiment of the present invention as defined in any one of claims 3, 4, 8, and 11-13. In the interest of brevity and simplification, the same reference numerals as used in the foregoing embodiment will be used in the following embodiments to identify the corresponding components, and redundant description of these components will not be provided.

One surface of the pad substrate 12, i.e. the front surface 14 has front-side grooves 36 composed of a plurality of circular grooves 36, 36, 36 . . . extending in a circumferential direction about the center axis 18 of the pad substrate 12, and to be open in the front surface 14.

In the present embodiment, the front-side grooves 36 are formed as slant grooves that are slant with a constant slant angle with respect to the center axis of the pad substrate 12 (i.e. a straight line parallel to the center axis 18). More specifically, an inner circumferential face 40 of each front-side groove 36 (hereinafter referred to as "front inside wall face") 40, and an outer circumferential face 42 of each front-side groove 36 (hereinafter referred to as "front outside wall face") 42 are both made slant faces that are slant by a given angle $\alpha t$ with respect to the center axis 18 (i.e. $\alpha t$=an angle of intersection against the straight line parallel to the center axis 18). In short, in the front-side grooves 36 in the present embodiment, the front inside wall face 40 and the front outside wall face 42 are mutually parallel faces, with the front-side grooves 36 having a substantially constant width dimension Bt over the entirety of the front-side grooves 36, not only in the circumferential direction but also in the depthwise direction thereof. In the polishing pad 76 as shown in FIG. 19, the front-side grooves 36 going towards the opening thereof moves gradually further away toward the outer diameter side from the center axis 18 to open diagonally outward in the diametric direction of pad substrate 12. In the polishing pad 78 as shown in FIG. 20, the front-side grooves 36 going towards the opening thereof moves gradually closer to the center axis 18 to open diagonally inward in the diametric direction of pad substrate 12.

Specific design values for the various dimensions, for the front-side grooves 36 may be selected giving overall consideration to the material, thickness dimension, and outside diameter dimension of the pad substrate 12, as well as the material of the wafer being polished, the configuration and material of metallization deposited on the wafer, the required polishing precision and the like, and as such are not particularly limited. Preferably, however, values for the front-side grooves 36, e.g., the groove width Bt, the groove depth Dt, the radial pitch Pt, and the slant angle $\alpha t$ may fall within the following ranges.

[For Circumferential Groove of Generally Circular Shape]

$0.005\ \text{mm} \leqq Bt \leqq 3.0\ \text{mm}$ $0.1\ \text{mm} \leqq Dt \leqq 2.0\ \text{mm}$ $0.1\ \text{mm} \leqq Pt \leqq 10.0\ \text{mm}$ $-30° \leqq \alpha t \leqq 30°$ More preferably, the values may fall within the following range.

[For Circumferential Groove of Generally Circular Shape]

$0.005\ \text{mm} \leqq Bt \leqq 2.0\ \text{mm}$ (Yet more preferably $0.005\ \text{mm} \leqq Bt \leqq 1.0\ \text{mm}$)

$0.1\ \text{mm} \leqq Dt \leqq 1.0\ \text{mm}$ $0.2\ \text{mm} \leqq Pt \leqq 2.0\ \text{mm}$ $-30° \leqq \alpha t \leqq -10°$ or $10° \leqq \alpha t \leqq 30°$ If the slant angle $\alpha t$ for the front inside and outside wall faces 40, 42 is too small, it becomes difficult to give sufficient elasticity to the polishing pads 76, 78, leading to a likelihood of malfunction of the pads. On the other hand, if the slant angle $\alpha t$ for the front inside and outside wall faces 40, 42 is too large, the pads become difficult to manufacture. In addition, the strength of side wall portions of the front-side grooves 36 become lower, leading to unstable surface pressure distribution, or insufficient durability of the polishing pads 76, 78.

On the other hand, the other surface of the pad substrate 12, i.e. the back surface 20 has a plurality of back-side grooves 22 composed of a plurality of circular grooves extending in the circumferential direction about the center axis 18 of the pad substrate, and to be open in the back surface 20. In the present embodiment, the back-side grooves 22 are composed of a plurality of circular grooves 22, 22, 22 . . . extending coaxially about the center axis 18 with respective radii of curvatures different from each other.

The polishing pads 76, 78 of construction according to the present embodiment is able to solve (Problem 1) and (Problem 4) selected from among the conventional problems as stated above.

Figure 21:
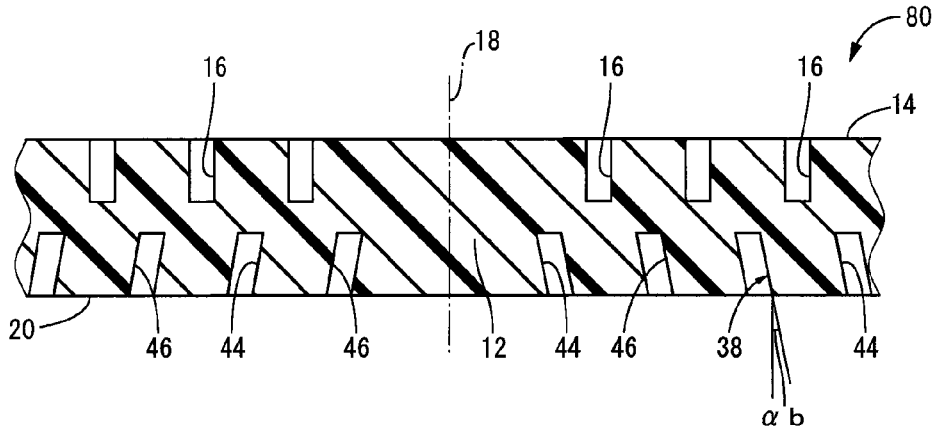
[FIG. 21] It is a vertical cross sectional view of a polishing pad of construction according to another embodiment of the invention.
Figure 22:
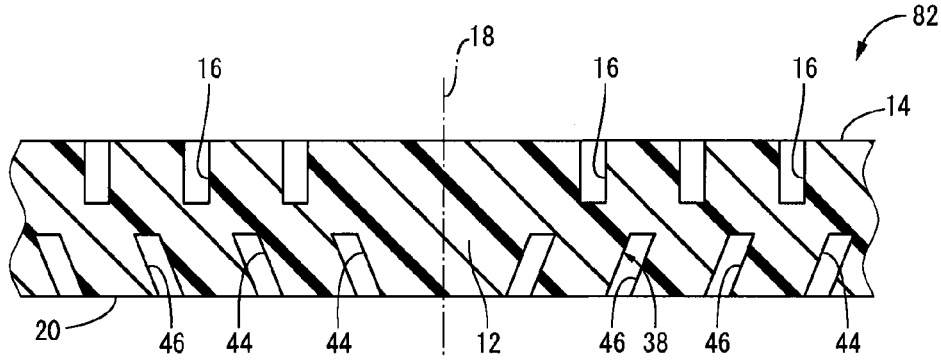
[FIG. 22] It is a vertical cross sectional view of a polishing pad of construction according to another embodiment of the invention.

Referring next to FIGS. 21 and 22, shown are polishing pads 80, 82 of construction according to another embodiment of the present invention as defined in any one of claims 3, 4, 8, 9, 10 and 13.

More specifically, one surface of the pad substrate 12, i.e. the front surface 14 has front-side grooves 16 composed of a plurality of circular grooves 16, 16, 16 . . . each extending about the center axis 18 as its center of curvature, but at mutually different radii of curvature, and to be open in the front surface 14.

On the other hand, the other surface of the pad substrate 12, i.e. a back surface 20 has a plurality of back-side grooves 38 composed of a plurality of circular grooves extending in the circumferential direction about the center axis 18 of the pad substrate, and to be open in the back surface 20. In the present embodiment, the back-side grooves 38 are composed of a plurality of circular grooves 38, 38, 38 . . . extending coaxially about the center axis 18 with respective radii of curvatures different from each other.

In the present embodiment, the back-side grooves 38 are formed as slant grooves that are slant with a constant slant angle with respect to the center axis 18 of the pad substrate (i.e. a straight line parallel to the center axis 18). More specifically, an inner circumferential face 44 of each back-side groove 38 (hereinafter referred to as "back inside wall face") 44, and an outer circumferential face 46 of each front-side groove 38 (hereinafter referred to as "back outside wall face") 46 are both made slant faces that are slant by a given angle $\alpha t$ with respect to the center axis 18 (i.e. $\alpha t$=an angle of intersection against the straight line parallel to the center axis 18). In short, in the back-side grooves 38 in the present embodiment, the back inside wall face 44 and the back outside wall face 46 are mutually parallel faces, with the back-side grooves 38 having a substantially constant width dimension Bt over the entirety of the back-side grooves 38, not only in the circumferential direction but also in the depthwise direction thereof. In the polishing pad 80 as shown in FIG. 21, the back-side grooves 38 going towards the opening thereof moves gradually further away toward the outer diameter side from the center axis 18 to open diagonally outward in the diametric direction of pad substrate 12. In the polishing pad 82 as shown in FIG. 22, the back-side grooves 38 going towards the opening thereof moves gradually closer to the center axis 18 to open diagonally inward in the diametric direction of pad substrate 12.

Specific design values for the various dimensions, for the back-side grooves 38 may be selected giving overall consideration to the material, thickness dimension, and outside diameter dimension of the pad substrate 12, as well as the material of the wafer being polished, the configuration and material of metallization deposited on the wafer, the required polishing precision and the like, and as such are not particularly limited. Preferably, however, values for the back-side grooves 38, e.g., the groove width Bb, the groove depth Db, and the radial pitch Pb may fall within the following ranges.

[For Circumferential Groove of Generally Circular Shape]

$0.005\ \text{mm} \leqq Bb \leqq 3.0\ \text{mm}$ $0.1\ \text{mm} \leqq Db \leqq 2.0\ \text{mm}$ $0.1\ \text{mm} \leqq Pb \leqq 5.0\ \text{mm}$ $-50° \leqq \alpha b \leqq 50°$ More preferably, the values may fall within the following range.

[For Circumferential Groove of Generally Circular Shape]

$0.005\ \text{mm} \leqq Bb \leqq 2.0\ \text{mm}$ (Yet more preferably $0.005\ \text{mm} \leqq Bt \leqq 1.0\ \text{mm}$)

$0.1\ \text{mm} \leqq Db \leqq 1.0\ \text{mm}$ $0.2\ \text{mm} \leqq Pb \leqq 2.0\ \text{mm}$ $-45° \leqq \alpha b \leqq -20°$ or $20° \leqq \alpha b \leqq 45°$ If the slant angle $\alpha b$ for the back inside and outside wall faces 44, 46 is too small, it becomes difficult to give sufficient elasticity to the polishing pads 80, 82 leading to a likelihood of malfunction of the pads. On the other hand, if the slant angle $\alpha b$ for the back inside and outside wall faces 44, 46 is too large, the pads become difficult to manufacture. In addition, the strength of side wall portions of the back-side grooves 38 become lower, leading to unstable surface pressure distribution, or insufficient durability of the polishing pads 80, 82.

The polishing pads 80, 82 of construction according to the present embodiment is able to solve (Problem 1), (Problem 2) and (Problem 4) selected from among the conventional problems as stated above.

Figure 23:
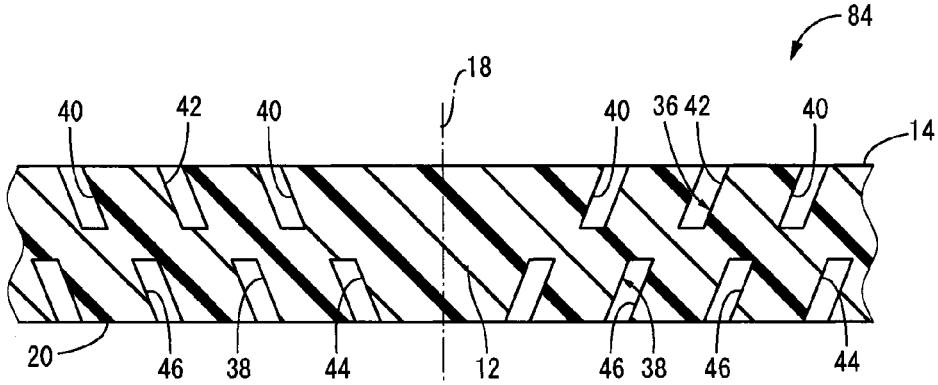
[FIG. 23] It is a vertical cross sectional view of a polishing pad of construction according to another embodiment of the invention.
Figure 24:
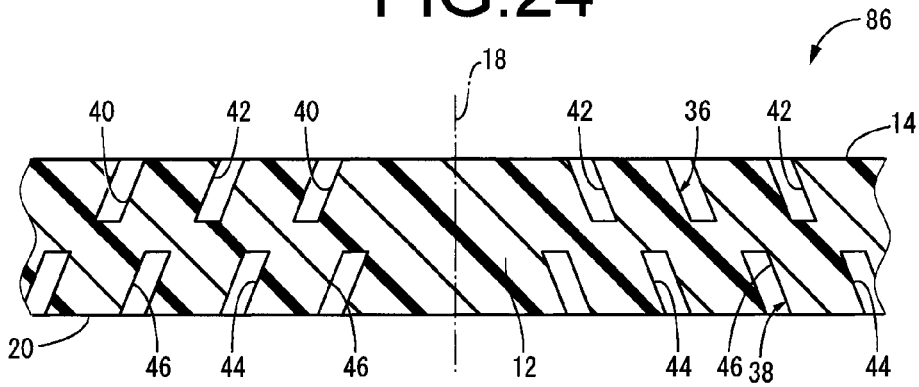
[FIG. 24] It is a vertical cross sectional view of a polishing pad of construction according to another embodiment of the invention.

Referring next to FIGS. 23 and 24, shown are polishing pads 84 and 86 of construction according to another embodiment of the present invention as defined in any one of claims 3, 4, and 8-13. In the interest of brevity and simplification, the same reference numerals as used in the foregoing embodiment will be used in the following embodiments to identify the corresponding components, and redundant description of these components will not be provided.

More specifically, in the polishing pads 84, 86, the front surface 14 has front-side grooves 36 composed of a plurality of circular slant grooves extending coaxially about the center axis 18 as its center of curvature, and the back surface 20 has a plurality of back-side grooves 38 composed of a plurality of slant grooves extending circumferentially and coaxially about the center axis 18 as its center of curvature.

In the polishing pad 84 as shown in FIG. 23, the front-side grooves 36 are formed opening toward diagonally outward in the diametric direction, and the back-side grooves 38 are formed opening toward diagonally inward in the diametric direction.

In the polishing pad 86, as shown in FIG. 24, the front-side grooves 36 are formed opening toward diagonally inward in the diametric direction, and the back-side grooves 38 are formed opening toward diagonally outward in the diametric direction.

The polishing pads 84, 86 of construction according to the present embodiment are able to solve (Problem 1), (Problem 2) and (Problem 4) selected from among the conventional problems as stated above.

Figure 25:
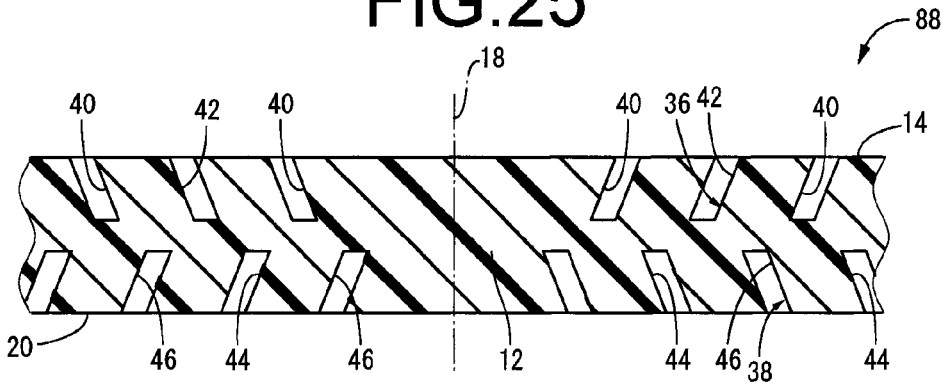
[FIG. 25] It is a vertical cross sectional view of a polishing pad of construction according to another embodiment of the invention.
Figure 26:
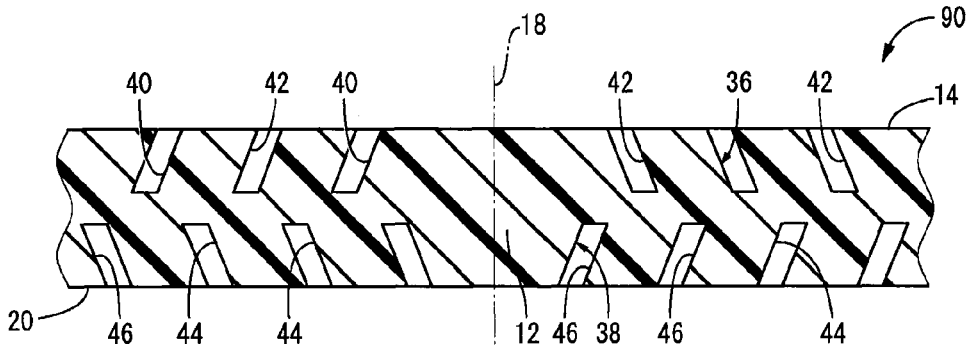
[FIG. 26] It is a vertical cross sectional view of a polishing pad of construction according to another embodiment of the invention.

Referring next to FIGS. 25 and 26 shown are polishing pads 88, 90 of construction according to another embodiment of the present invention as defined in any one of claims 1, 3, 4, 5 and 8-13. In the interest of brevity and simplification, the same reference numerals as used in the foregoing embodiment will be used in the following embodiments to identify the corresponding components, and redundant description of these components will not be provided.

More specifically, in the polishing pads 88, 90, the front surface 14 has front-side grooves 36 composed of a plurality of slant grooves extending circumferentially and coaxially about the center axis 18 as its center of curvature, and the back surface 20 has a plurality of back-side grooves 38 composed of a plurality of slant grooves extending circumferentially and coaxially about the center axis 18 as its center of curvature.

In the polishing pad 88 as shown in FIG. 25, the front-side grooves 36 are formed opening toward diagonally outward in the diametric direction, and the back-side grooves 38 are formed opening toward diagonally outward in the diametric direction.

In the polishing pad 90, as shown in FIG. 26, the front-side grooves 36 are formed opening toward diagonally inward in the diametric direction, and the back-side grooves 38 are formed opening toward diagonally inward in the diametric direction.

The polishing pads 88, 90 of construction according to the present embodiment is able to solve (Problem 1), (Problem 2) and (Problem 4) selected from among the conventional problems as stated above.

Figure 27:
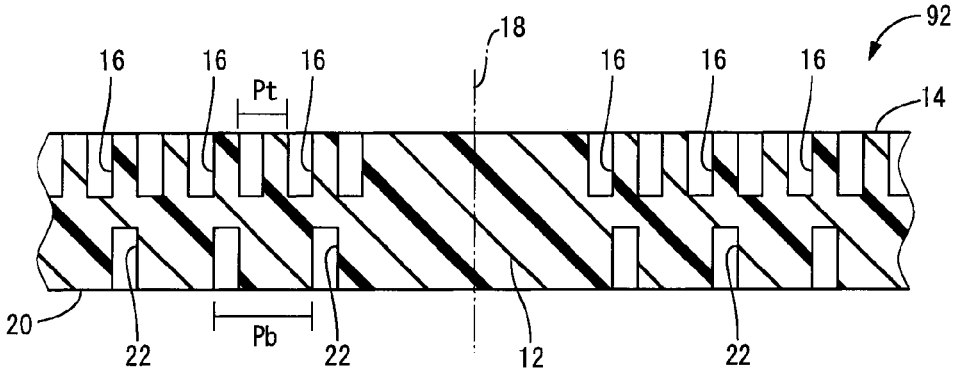
[FIG. 27] It is a vertical cross sectional view of a polishing pad of construction according to another embodiment of the invention.
Figure 28:
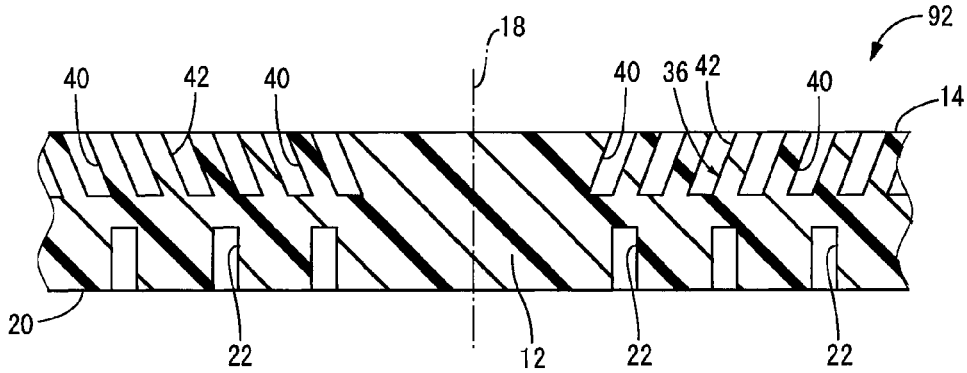
[FIG. 28] It is a vertical cross sectional view of a polishing pad of construction according to another embodiment of the invention.
Figure 29:
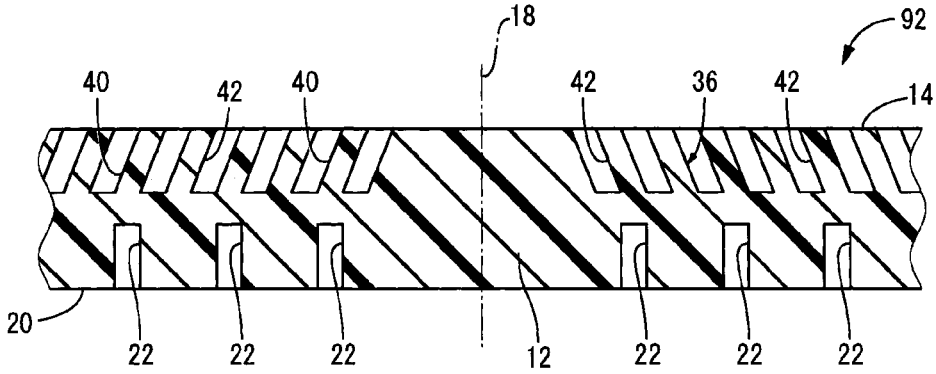
[FIG. 29] It is a vertical cross sectional view of a polishing pad of construction according to another embodiment of the invention.
Figure 30:
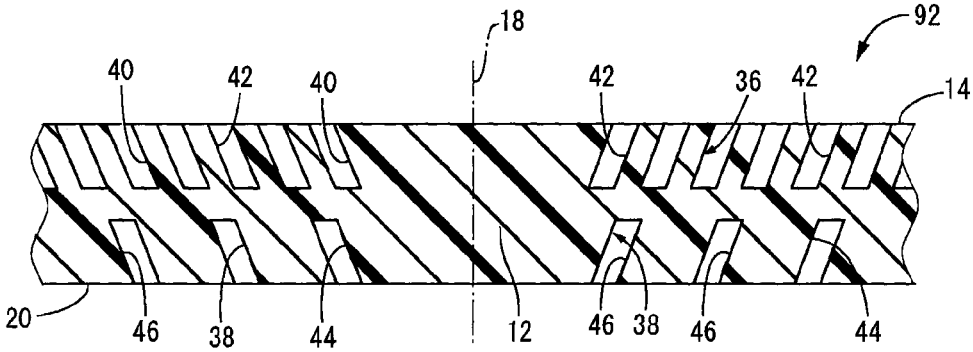
[FIG. 30] It is a vertical cross sectional view of a polishing pad of construction according to another embodiment of the invention.
Figure 31:
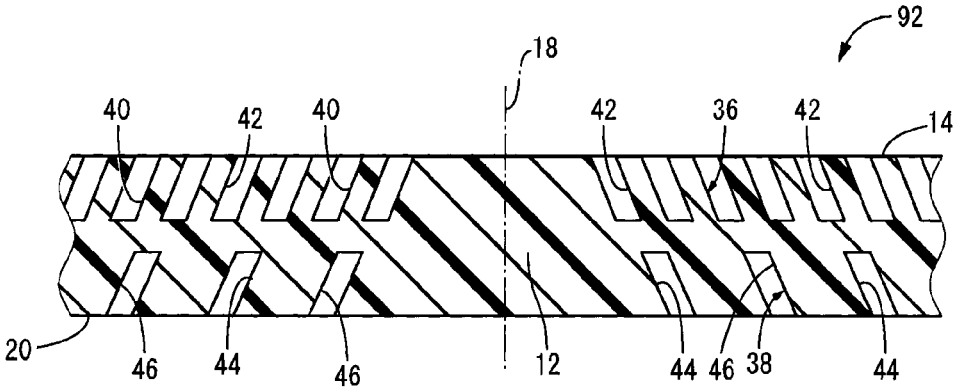
[FIG. 31] It is a vertical cross sectional view of a polishing pad of construction according to another embodiment of the invention.
Figure 32:
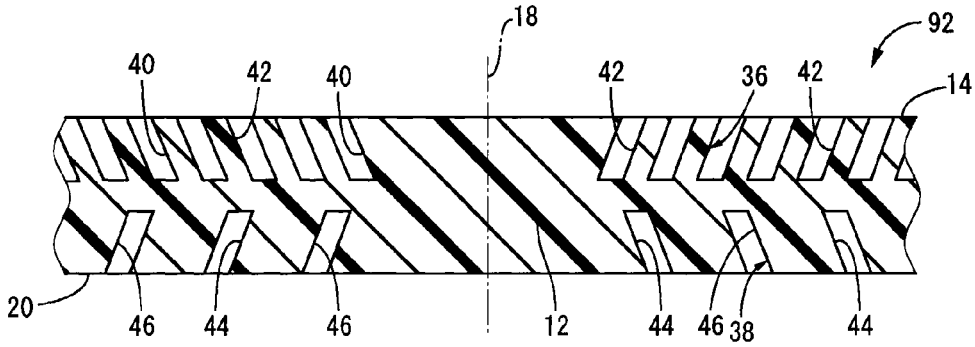
[FIG. 32] It is a vertical cross sectional view of a polishing pad of construction according to another embodiment of the invention.
Figure 33:
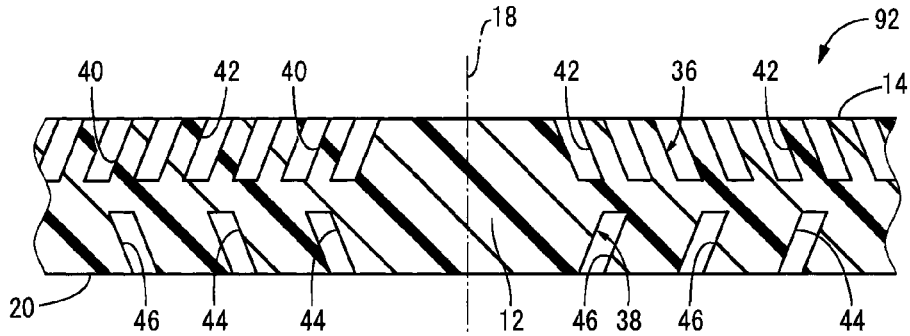
[FIG. 33] It is a vertical cross sectional view of a polishing pad of construction according to another embodiment of the invention.
Figure 34:
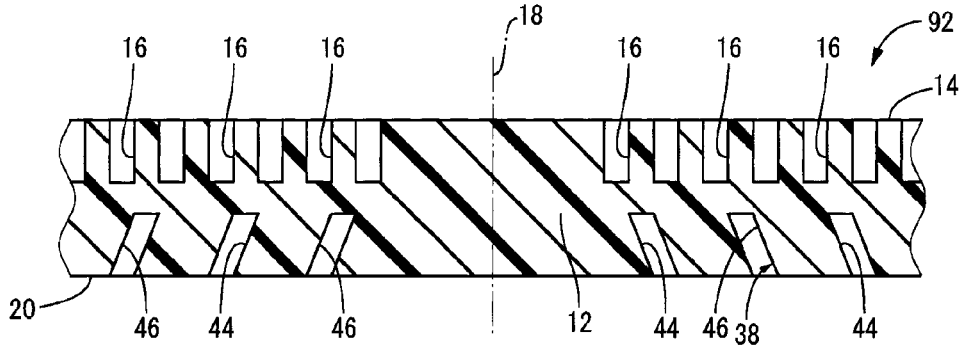
[FIG. 34] It is a vertical cross sectional view of a polishing pad of construction according to another embodiment of the invention.
Figure 35:
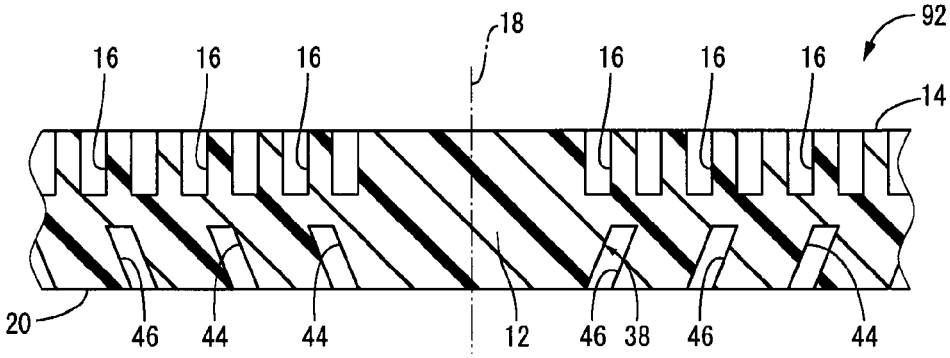
[FIG. 35] It is a vertical cross sectional view of a polishing pad of construction according to another embodiment of the invention.

Referring next to FIG. 27 shown is a polishing pad 92 of construction according to another embodiment of the present invention as defined in any one of claims 3, 8 and 13. In the interest of brevity and simplification, the same reference numerals as used in the foregoing embodiment will be used in the following embodiments to identify the corresponding components, and redundant description of these components will not be provided.

More specifically, in the polishing pad 92, the front surface 14 of the pad substrate 12 has front-side grooves 16 formed about the center axis 18 of the pad substrate 12, and open in the front surface 14, and the back surface 20 of the pad substrate 12 has a plurality of back-side grooves 22 formed about the center axis 18, and open in the back surface 20.

In the present embodiment, the radial pitch Pt for the front-side grooves 16 is made smaller than the radial pitch Pb for the back-side grooves 22. More specifically, the back-side grooves 22 are formed at the substantially double radial pitch than the front-side grooves 16, so that the front-side grooves 16 are formed at the number larger than that of the back-side grooves 22.

The polishing pad 92 of construction according to the present embodiment is able to solve (Problem 1) and (Problem 4) selected from among the conventional problems as stated above.

In the polishing pad 92 shown in FIG. 27, the front-side grooves and the back-side grooves are formed as the front-side grooves 16 and the back-side grooves 22 both composed of circular grooves having no inclined angle with respect to the center axis. Alternatively, in each embodiment, the front-side grooves may be formed as the front-side grooves 36 composed of the slant grooves slant with respect to the center axis, as shown in FIGS. 28-33. Likewise, the back-side grooves may be formed as the back-side grooves 38 composed of the slant grooves slant with respect to the center axis as shown in FIGS. 30-35.

Figure 36:
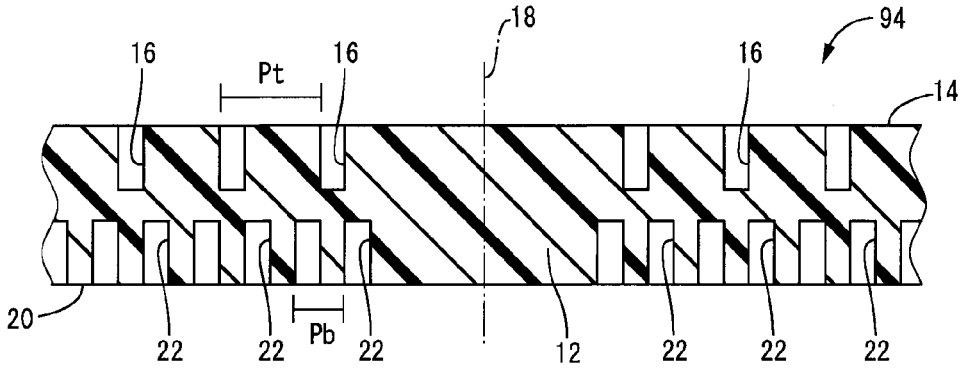
[FIG. 36] It is a vertical cross sectional view of a polishing pad of construction according to another embodiment of the invention.
Figure 37:
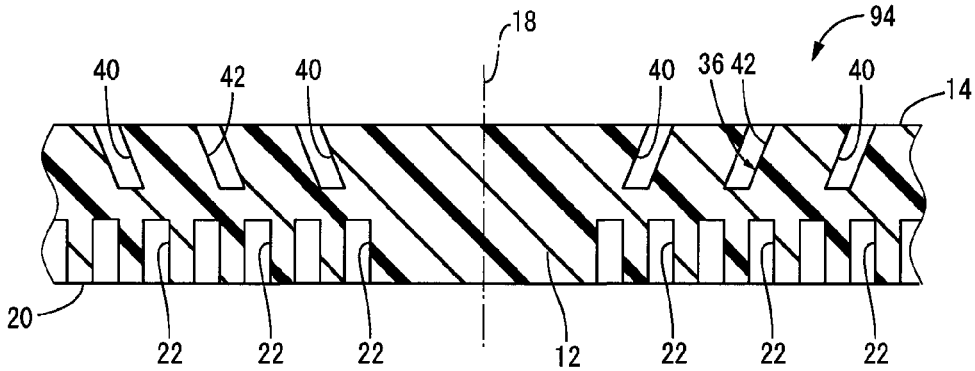
[FIG. 37] It is a vertical cross sectional view of a polishing pad of construction according to another embodiment of the invention.
Figure 38:
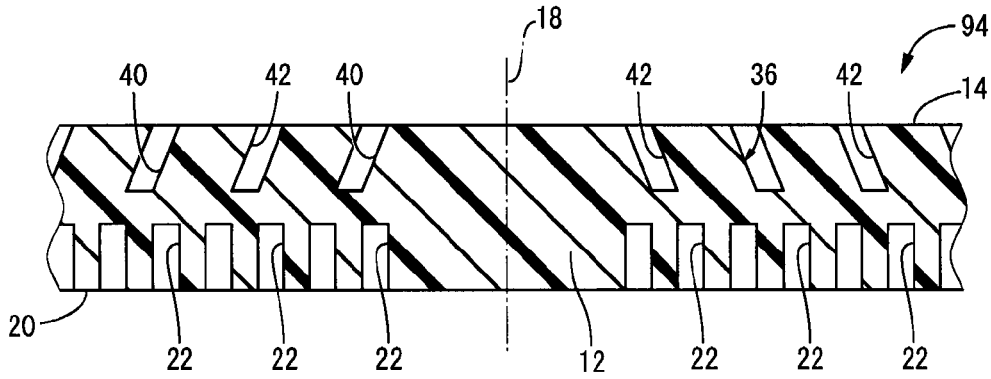
[FIG. 38] It is a vertical cross sectional view of a polishing pad of construction according to another embodiment of the invention.
Figure 39:
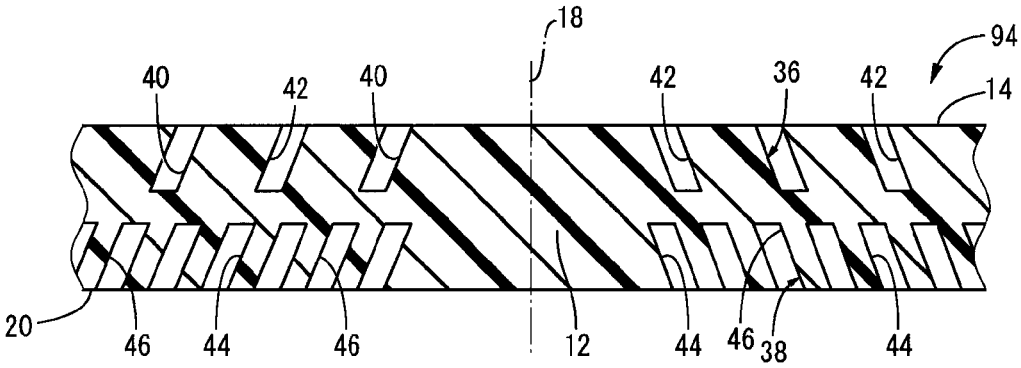
[FIG. 39] It is a vertical cross sectional view of a polishing pad of construction according to another embodiment of the invention.
Figure 40:
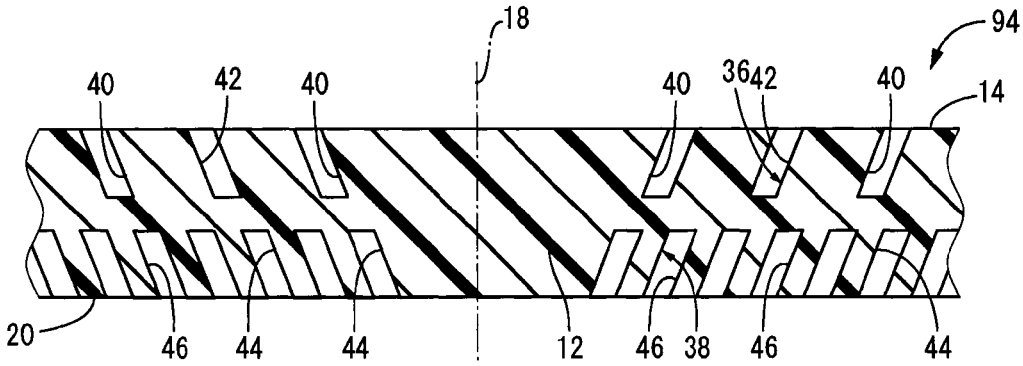
[FIG. 40] It is a vertical cross sectional view of a polishing pad of construction according to another embodiment of the invention.
Figure 41:
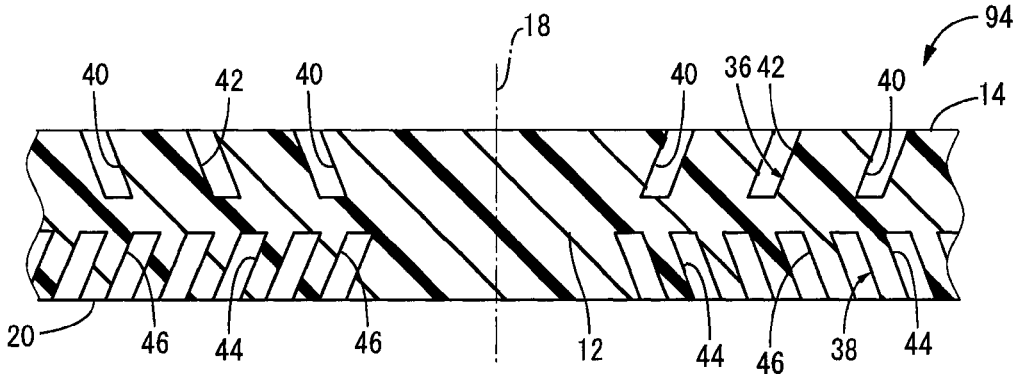
[FIG. 41] It is a vertical cross sectional view of a polishing pad of construction according to another embodiment of the invention.
Figure 42:
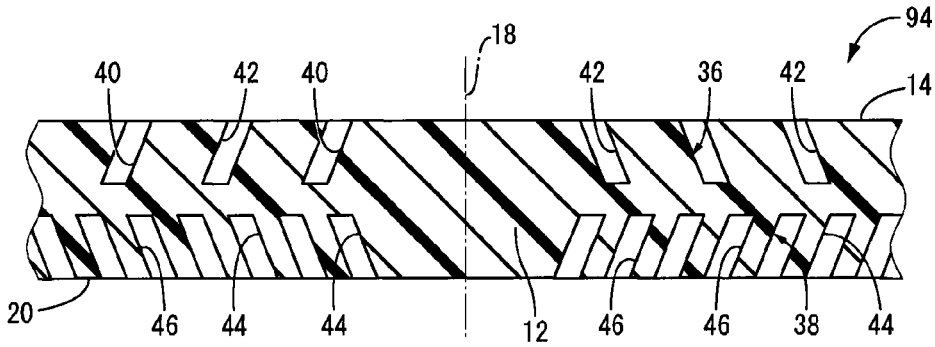
[FIG. 42] It is a vertical cross sectional view of a polishing pad of construction according to another embodiment of the invention.
Figure 43:
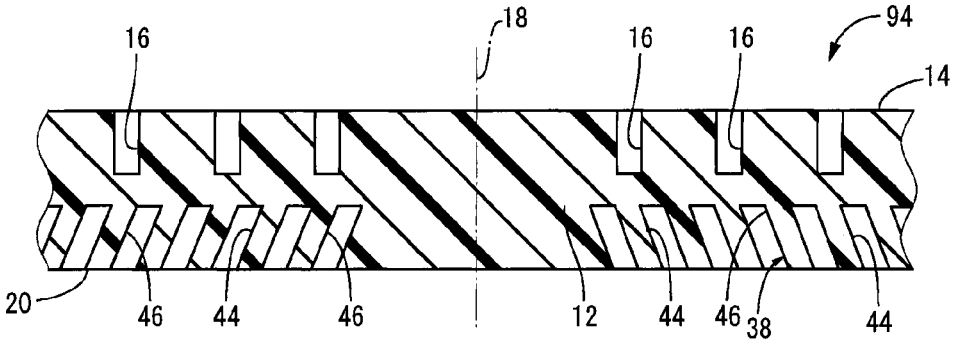
[FIG. 43] It is a vertical cross sectional view of a polishing pad of construction according to another embodiment of the invention.
Figure 44:
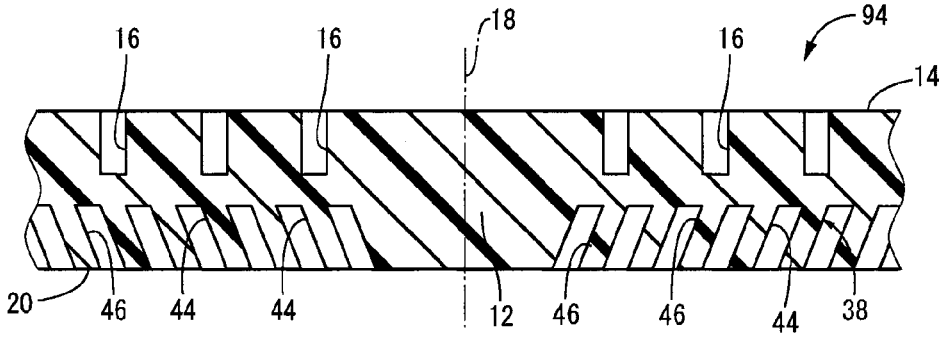
[FIG. 44] It is a vertical cross sectional view of a polishing pad of construction according to another embodiment of the invention.

Referring next to FIG. 36 shown is a polishing pad 94 of construction according to another embodiment of the present invention as defined in any one of claims 3, 6, 8 and 13. The same reference numerals as used in the foregoing embodiment will be used in the following embodiments to identify the corresponding components, and redundant description of these components will not be provided.

More specifically, in the polishing pad 94, the front surface 14 of the pad substrate 12 has front-side grooves 16 formed about the center axis 18 of the pad substrate 12, and open in the front surface 14, and the back surface 20 of the pad substrate 12 has a plurality of back-side grooves 22 formed about the center axis 18, and open in the back surface 20.

In the present embodiment, the radial pitch Pt for the front-side grooves 16 is made larger than the radial pitch Pb for the back-side grooves 22. More specifically, the back-side grooves 22 are formed at the substantially half radial pitch than the front-side grooves 16, so that the back-side grooves 22 are formed at the number larger than that of the front-side grooves 16.

With this arrangement, the elasticity given to the polishing pad 92 by means of the back-side grooves 22 formed on the back surface 20 can be effectively exhibited.

The polishing pad 94 of construction according to the present embodiment is able to solve (Problem 1) and (Problem 4) selected from among the conventional problems as stated above.

In the polishing pad 94 shown in FIG. 36, the front-side grooves are formed as the front-side grooves 16 composed of circular grooves having no inclined angle with respect to the center axis. Alternatively, in each embodiment, the front-side grooves may be formed as the front-side grooves 36 composed of the slant grooves slant with respect to the center axis, as shown in FIGS. 37-44. With this arrangement, the polishing pad is of construction according to claim 11, whereby (Problem 1) and (Problem 4) in the conventional problems as stated above can be effectively solved.

In the polishing pad 94 shown in FIG. 36, the back-side grooves are formed as the back-side grooves 22 composed of circular grooves having no inclined angle with respect to the center axis. Alternatively, in each embodiment, the front-side grooves may be formed as the back-side grooves 22 composed of the slant grooves slant with respect to the center axis, as shown in FIGS. 39-44. With this arrangement, the polishing pad is of construction according to claim 9, whereby (Problem 2) in addition to (Problem 1) and (Problem 4) in the conventional problems as stated above can be effectively solved.

Figure 45:
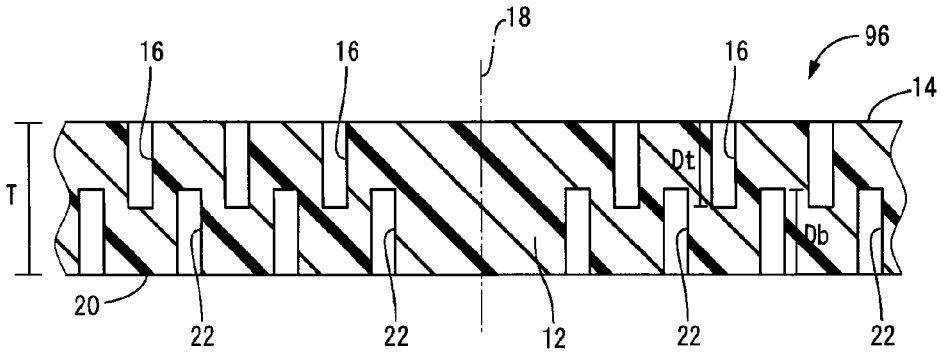
[FIG. 45] It is a vertical cross sectional view of a polishing pad of construction according to another embodiment of the invention.
Figure 46:
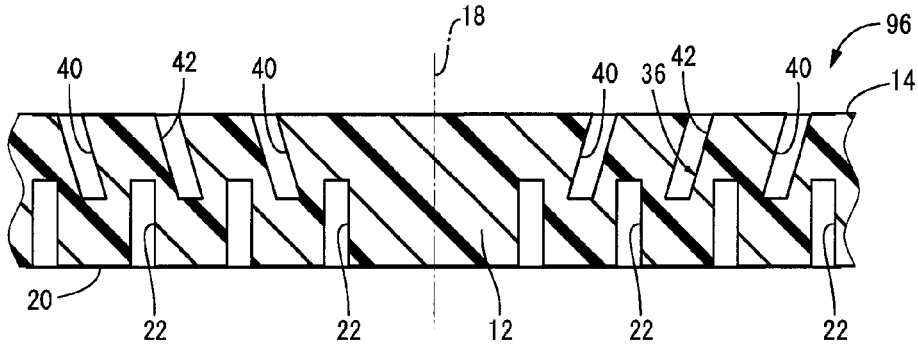
[FIG. 46] It is a vertical cross sectional view of a polishing pad of construction according to another embodiment of the invention.
Figure 47:
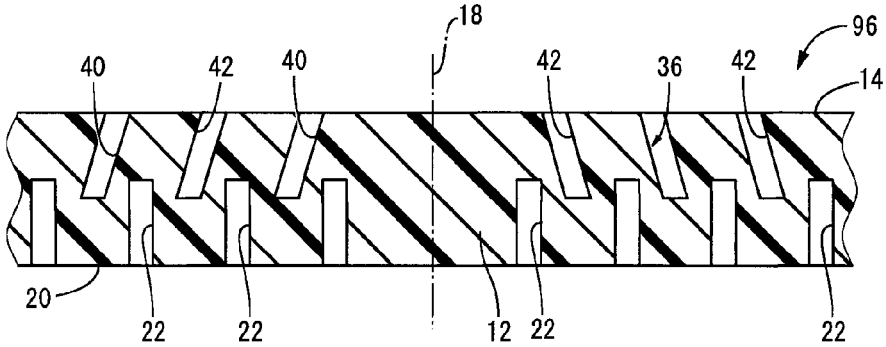
[FIG. 47] It is a vertical cross sectional view of a polishing pad of construction according to another embodiment of the invention.
Figure 48:
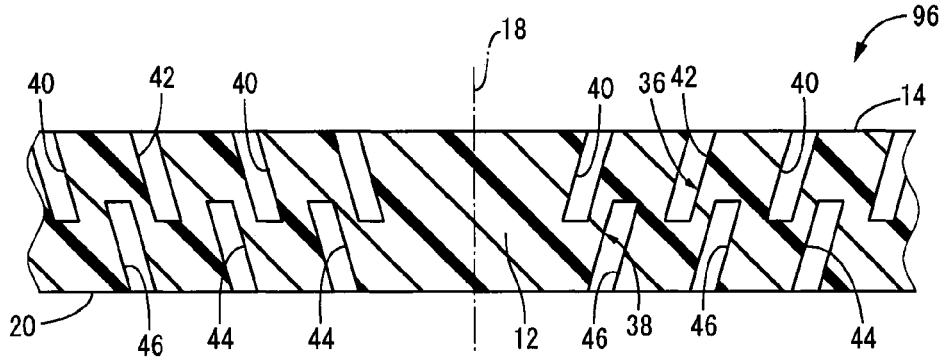
[FIG. 48] It is a vertical cross sectional view of a polishing pad of construction according to another embodiment of the invention.
Figure 49:
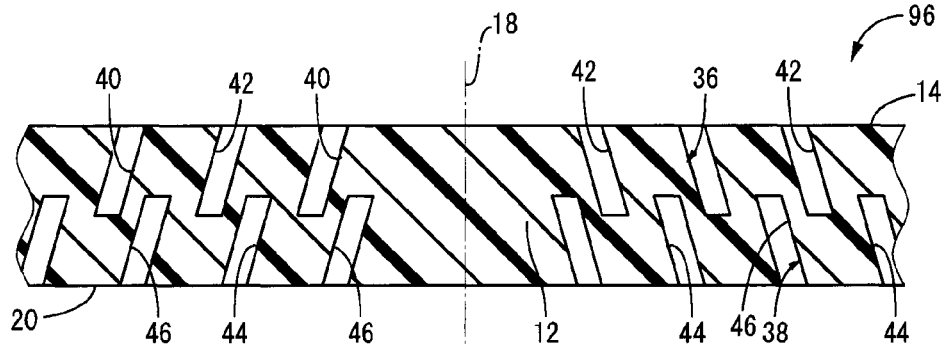
[FIG. 49] It is a vertical cross sectional view of a polishing pad of construction according to another embodiment of the invention.
Figure 50:
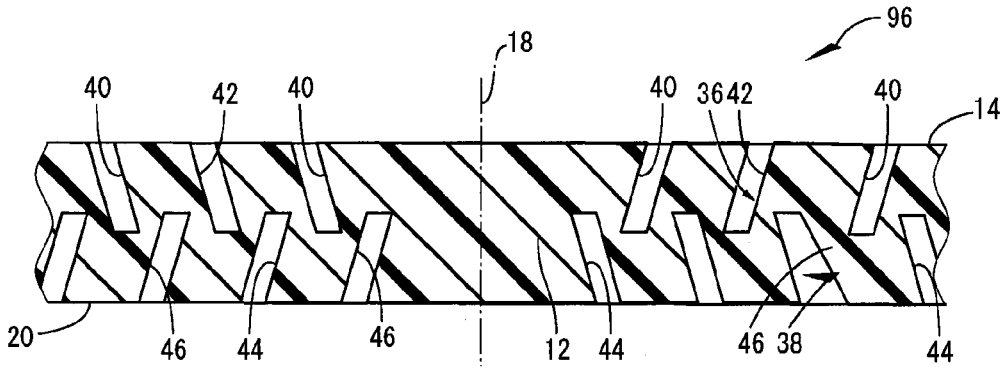
[FIG. 50] It is a vertical cross sectional view of a polishing pad of construction according to another embodiment of the invention.
Figure 51:
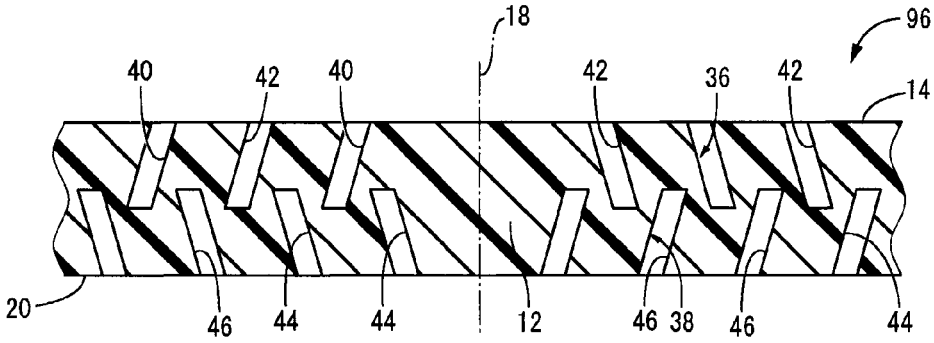
[FIG. 51] It is a vertical cross sectional view of a polishing pad of construction according to another embodiment of the invention.
Figure 52:
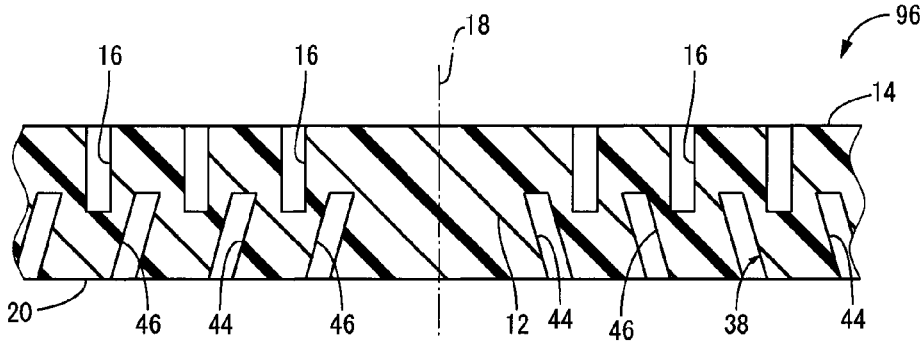
[FIG. 52] It is a vertical cross sectional view of a polishing pad of construction according to another embodiment of the invention.
Figure 53:
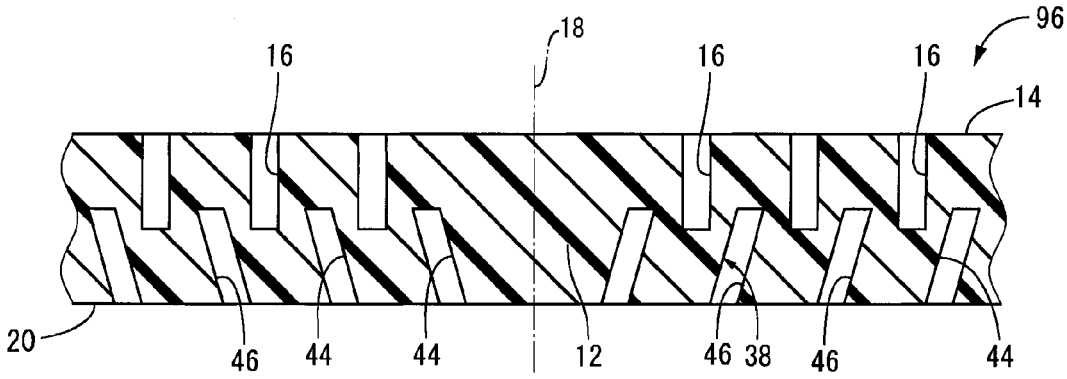
[FIG. 53] It is a vertical cross sectional view of a polishing pad of construction according to another embodiment of the invention.

Referring next to FIG. 45, shown is a polishing pad 96 of construction according to another embodiment of the present invention as defined in any one of claims 3, 4, 7 and 13. The same reference numerals as used in the foregoing embodiment will be used in the following embodiments to identify the corresponding components, and redundant description of these components will not be provided.

More specifically, in the polishing pad 96, the front surface 14 of the pad substrate 12 has front-side grooves 16 formed about the center axis 18 of the pad substrate 12, and open in the front surface 14, and the back surface 20 of the pad substrate 12 has a plurality of back-side grooves 22 formed about the center axis 18, and open in the back surface 20.

Moreover, the sum of the groove depth Dt for the front-side grooves 16 and the groove depth Db for the back-side grooves 22 (i.e. the total value of (Dt+Db)) is made larger than the thickness T of the pad substrate 12. This makes it possible to give greater elasticity to the polishing pad 96 efficiently.

The polishing pad 96 of construction according to the present embodiment is able to solve (Problem 1) and (Problem 4) selected from among the conventional problems as stated above.

In the polishing pad 96 shown in FIG. 45, the front-side grooves are formed as the front-side grooves 16 composed of circular grooves having no inclined angle with respect to the center axis. Alternatively, in each embodiment, the front-side grooves may be formed as the front-side grooves 36 composed of the slant grooves slant with respect to the center axis, as shown in FIGS. 46-51. With this arrangement, the polishing pad is of construction according to claim 11, whereby (Problem 1) and (Problem 4) in the conventional problems as stated above can be effectively solved.

In the polishing pad 96 shown in FIG. 45, the back-side grooves are formed as the back-side grooves 22 composed of circular grooves having no inclined angle with respect to the center axis. Alternatively, in each embodiment, the front-side grooves may be formed as the back-side grooves 22 composed of the slant grooves slant with respect to the center axis, as shown in FIGS. 48-53. With this arrangement, the polishing pad is of construction according to claim 9, whereby (Problem 2) in addition to (Problem 1) and (Problem 4) in the conventional problems as stated above can be effectively solved.

Embodiment D

Figure 54:
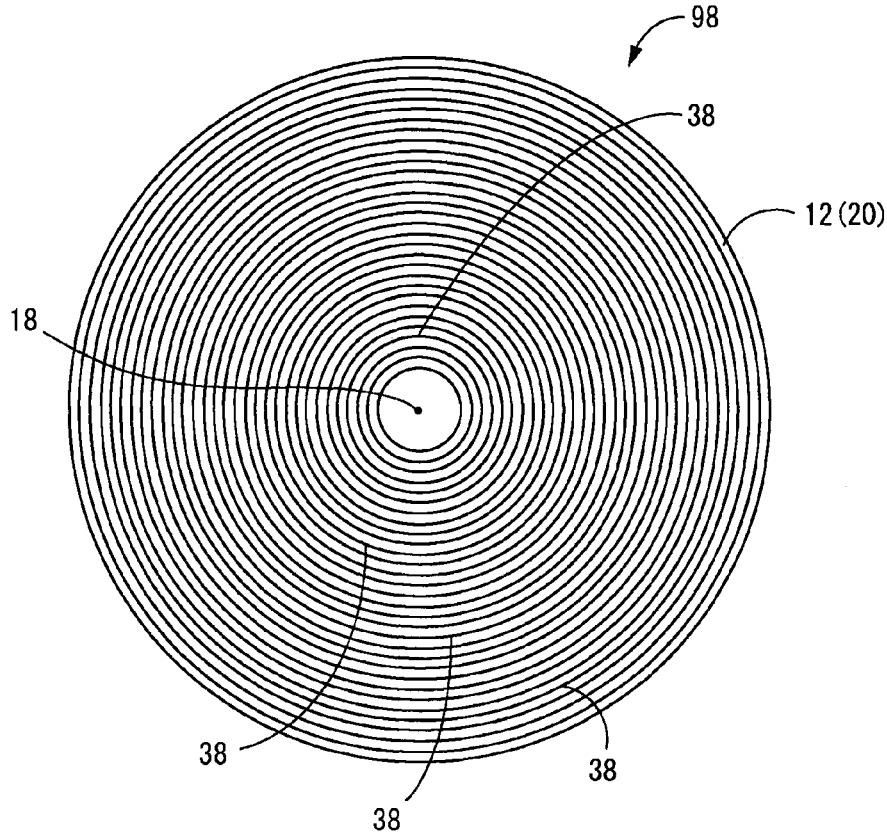
[FIG. 54] It is a top plane view showing a polishing pad of construction according to one embodiment of the invention.
Figure 55:
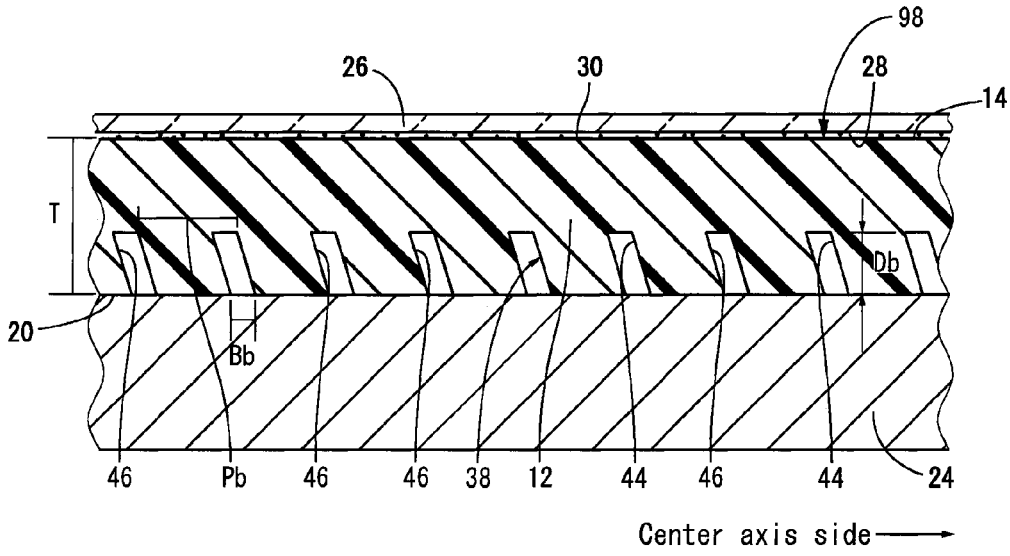
[FIG. 55] It is a vertical cross sectional view of the polishing pad shown in FIG. 54 in a state of being mounted on a polishing apparatus.
Figure 56:
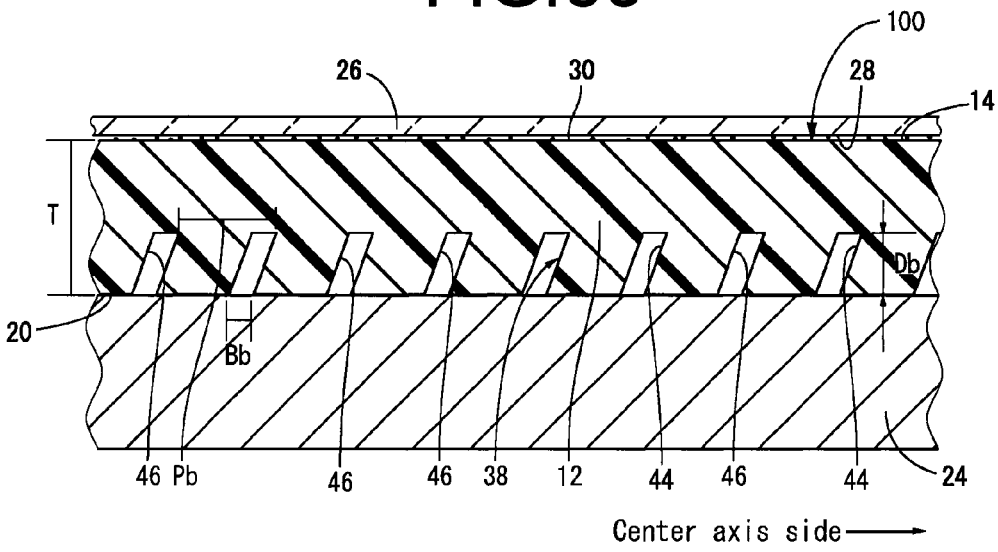
[FIG. 56] It is a vertical cross sectional view of the polishing pad shown in FIG. 54 in a state of being mounted on a polishing apparatus.

Referring next to FIGS. 54-56, shown are polishing pads 98, 100 of construction according to another embodiment of the present invention as defined in claim 9 or 13.

More specifically, each of the polishing pads 98, 100 is constituted by a thin disk shaped pad substrate 12 having a constant thickness dimension T overall. The pad substrate 12 is advantageously formed of rigid expanded or non-expanded synthetic resin material, rigid rubber material, textile material, inorganic material, or other possible material. In the present embodiment, the polishing substrate 12 is formed of an expanded urethane, for example. The pad thickness dimension is not particularly limited, and may be selected appropriately depending not only on the material of the pad substrate 12 but also the material of the wafer being polished, the required degree of polishing precision, and the like.

One surface of the pad substrate 12, i.e. the front surface 14 is formed as a flat surface with no grooves formed.

On the other hand, the other surface of the pad substrate 12, i.e. the back surface 20 has a plurality of back-side grooves 38 composed of a plurality of circular grooves extending in the circumferential direction about the center axis 18 of the pad substrate, and to be open in the back surface 20.

In the present embodiment, the back-side grooves 38 are composed of a plurality of circular grooves 38, 38, 38 . . . extending coaxially about the center axis 18 with respective radii of curvatures different from each other.

Figure 57:
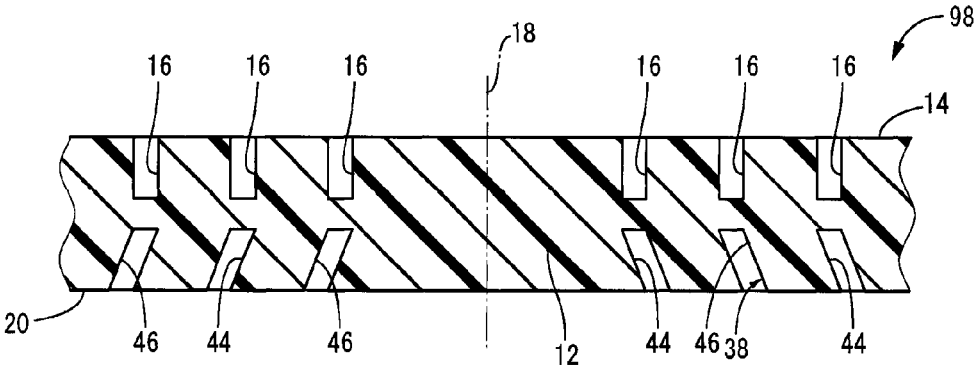
[FIG. 57] It is a vertical cross sectional view of a polishing pad of construction according to another embodiment of the invention.
Figure 58:
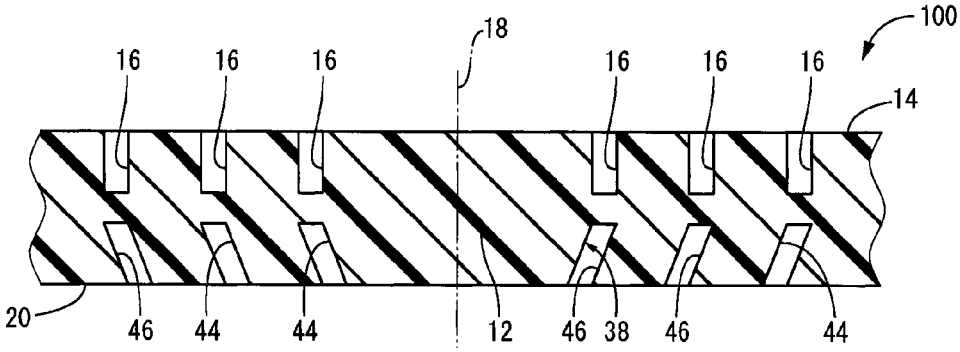
[FIG. 58] It is a vertical cross sectional view of a polishing pad of construction according to another embodiment of the invention.
Figure 59:
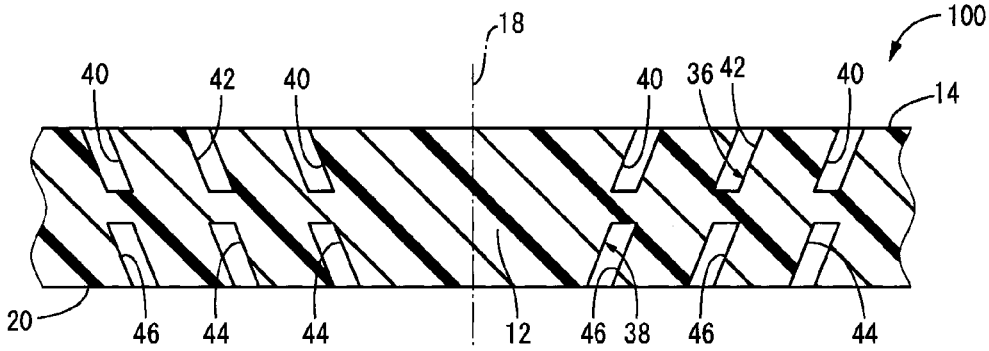
[FIG. 59] It is a vertical cross sectional view of a polishing pad of construction according to another embodiment of the invention.

In the present embodiment, the back-side grooves 38 are formed as slant grooves that are slant with a constant slant angle with respect to the center axis 18 of the pad substrate. More specifically, as shown in FIGS. 55, 56 of vertical cross sectional enlarged views, an inner circumferential face 44 of each back-side groove 38 (hereinafter referred to as "back inside wall face") 44, and an outer circumferential face 46 of each front-side groove 38 (hereinafter referred to as "back outside wall face") 46 are both made slant faces that are slant by a given angle $\alpha b$ with respect to the center axis 18 (i.e. $\alpha b$=an angle of intersection against the straight line parallel to the center axis 18). In short, in the back-side grooves 38 shown in FIGS. 57, 58, the back inside wall face 44 and the back outside wall face 46 are mutually parallel faces, with the back-side grooves 38 having a substantially constant width dimension Bb over the entirety of groove 38, not only in the circumferential direction but also in the depthwise direction thereof. In the polishing pad 98 as shown in FIG. 55, the back-side grooves 38 going towards the opening thereof moves gradually further away toward the outer diameter side from the center axis 18 to open diagonally outward in the diametric direction of pad substrate 12. In the polishing pad 100 as shown in FIG. 56, the back-side grooves 38 going towards the opening thereof moves gradually away from the center axis 18 to the outer circumferential side to open diagonally outward in the diametric direction of pad substrate 12.

Specific design values for the various dimensions, for the back-side grooves 38 may be selected giving overall consideration to the material, thickness dimension, and outside diameter dimension of the pad substrate 12, as well as the material of the wafer being polished, the configuration and material of metallization deposited on the wafer, the required polishing precision and the like, and as such are not particularly limited. Preferably, however, values for the back-side grooves 38, e.g., the groove width Bb, the groove depth Db, and the radial pitch Pb may fall within the following ranges.

[For Circumferential Groove of Generally Circular Shape]

$0.005\ \text{mm} \leqq Bb \leqq 3.0\ \text{mm}$ $0.1\ \text{mm} \leqq Db \leqq 2.0\ \text{mm}$ $0.1\ \text{mm} \leqq Pb \leqq 5.0\ \text{mm}$ $-50° \leqq \alpha b \leqq 50°$ More preferably, the values may fall within the following range.

[For Circumferential Groove of Generally Circular Shape]

$0.005\ \text{mm} \leqq Bb \leqq 2.0\ \text{mm}$ (Yet more preferably $0.005\ \text{mm} \leqq Bb \leqq 1.0\ \text{mm}$)

$0.1\ \text{mm} \leqq Db \leqq 1.0\ \text{mm}$ $0.2\ \text{mm} \leqq Pb \leqq 2.0\ \text{mm}$ $-45° \leqq \alpha b \leqq -20°$ or $20° \leqq \alpha b \leqq 45°$ Namely, if the groove width Bb, and the groove depth Db for the back-side grooves 38 is too small, it become difficult to provide the polishing pads 98, 100 with sufficient elasticity, making it difficult to realize desired polishing precision. On the other hand, if the groove width Bb, and the groove depth Db for the back-side grooves 38 are too large, the elasticity exhibited on the back surface 20 of each of the polishing pads 98, 100 will become large excessively, leading to a likelihood of deterioration in polishing precision.

If the radial pitch Pb for the back-side grooves 38 is too small, the pad becomes difficult to manufacture, and will tend to become damaged easily, making it difficult to achieve consistent polishing. If on the other hand the radial pitch Pb for the back-side grooves 38 is too large, the number of the circular grooves 38, 38, 38, . . . composing the back-side grooves 38 get reduced. Therefore, elasticity generated on the back surface 20 of each of the polishing pads 98, 100 will vary depending on the radial position of each of the polishing pads 98, 100, making it difficult to carry out uniform polishing efficiently.

If the slant angle $\alpha b$ for the back inside and outside wall faces 44, 46 is too small, it becomes difficult to give sufficient elasticity to the polishing pads 98, 100, leading to a likelihood of malfunction of the pads. On the other hand, if the slant angle $\alpha b$ for the back inside and outside wall faces 44, 46 is too large, the pads become difficult to manufacture. In addition, the strength of side wall portions of the front-side grooves 38 become lower, leading to unstable surface pressure distribution, or insufficient durability of the polishing pads 98, 100.

Bottom faces of the back-side grooves 38 may have a variety of shapes including a curved face and a flat face, but not limited to a specific shape. In the present embodiment, the bottom faces of the back-side grooves 38 are flat faces perpendicular to the center axis 18 of the polishing pads 98, 100. By forming the bottom faces of the back-side grooves 38 to be parallel to the surface of the polishing pads 98, 100, a gap between bottom wall portions of the back-side grooves 38 is effectively obtained to ensure excellent rigidity of the pad, even if the effective depth for the back-side grooves 38 is made large.

Each of the polishing pads 98, 100 having the front surface 14 and the back surface 20 as discussed above, is used for polishing a wafer or the like in the conventional manner. More specifically, as shown in FIGS. 55, 56, for example, each of the polishing pads 98, 100 is arranged on the support face of a rotation plate (support plate) 24 of a polishing apparatus, and clamped against the rotation plate by air-reduced negative pressure suction, double-sided bonding or other means. Next, while rotating each of the polishing pads 98, 100 about its center axis 18, a wafer 26 is juxtaposed against the front surface 14 for polishing. Generally, during this polishing process, an abrasive liquid (slurry) 30 is supplied to the opposing faces, i.e. the front surface 14 of the polishing pad 98, 100 and the process face 28 of the wafer 26, like the conventional manner, while also rotating the wafer 26 itself about its center axis. The slurry 30 is supplied, for example, to the surface of the polishing pad 98, 100 from the vicinity of the central portion of the polishing pad 98, 100 so as to be spread out over the surface of the polishing pad 98, 100 due to the action of centrifugal force created by rotation of polishing pad 98, 100 about the center axis 18.

Each of the polishing pads 98, 100 of construction according to the present embodiment is able to solve (Problem 2) and (Problem 4) selected from among the conventional problems as stated above.

Namely, by forming the back-side grooves 38 as slant grooves that are slant with respect to the center axis, the elasticity given to the polishing pads 98, 100 by means of the grooves formed thereon can be effectively obtained, making it possible to surely realize a variety of required capabilities. In addition, by employing slant grooves of annular shape, it is effectively prevented that the pad substrate 12 undergoes shear elastic deformation in one direction due to a load applied to the contact surface (processing surface) that is brought into contact with the object to be processed, since the grooves are made slant. This makes it possible to support the object to be processed, such as a wafer, while being fixedly positioned in the axis-perpendicular direction, whereby high precision polishing can be executed with stability.

Also, the back-side grooves 38 are the annular grooves extending in the circumferential direction. This makes it possible to effectively prevent that the slurry 30 supplied on the front surface 14 is led along an outer circumferential surface of the pad into the back surface 20. This arrangements may prevent occurrence of problems such as dislodging of the polishing pads 98, 100 from the rotation plate 24, or displacement of the polishing pad on the rotation plate 24, making it possible to execute polishing process with high stability.

In addition, by setting for the back-side grooves 38 the groove width Bb, the depth Db, and the radial pitch Pb, $\alpha b$ within the given ranges, a sufficient elasticity of the polishing pads 98, 100 can be realized, while a sufficient bonding force between the back surface 20 and the rotation plate 24, thereby realizing high reliability.

Figure 63:
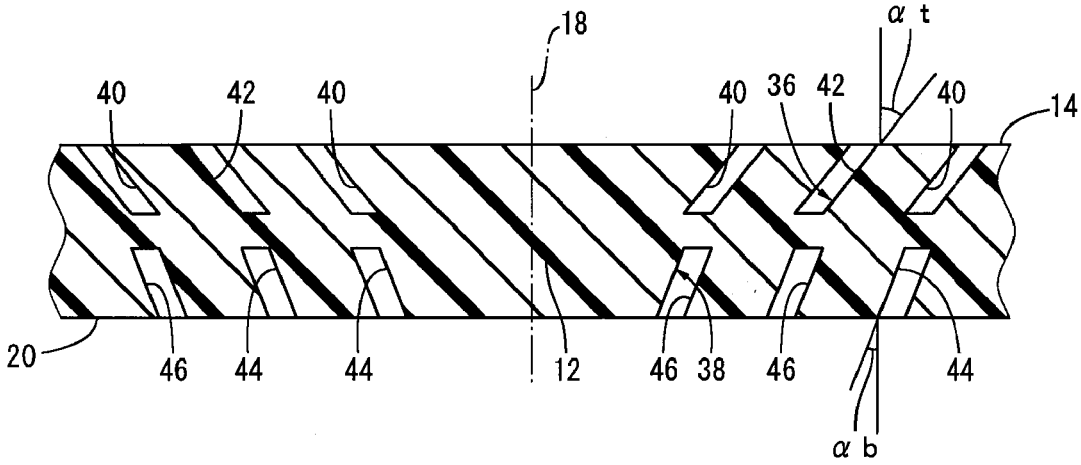
[FIG. 63] It is a vertical cross sectional view of a polishing pad of construction according to another embodiment of the invention.
Figure 64:
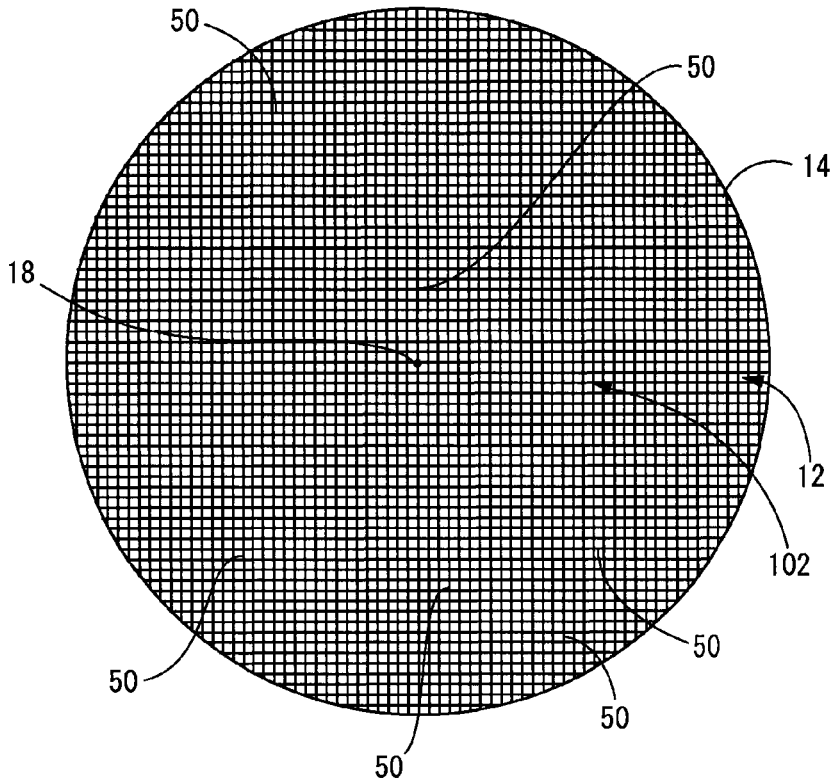
[FIG. 64] It is a top plane view showing a polishing pad of construction according to another embodiment of the invention.
Figure 65:
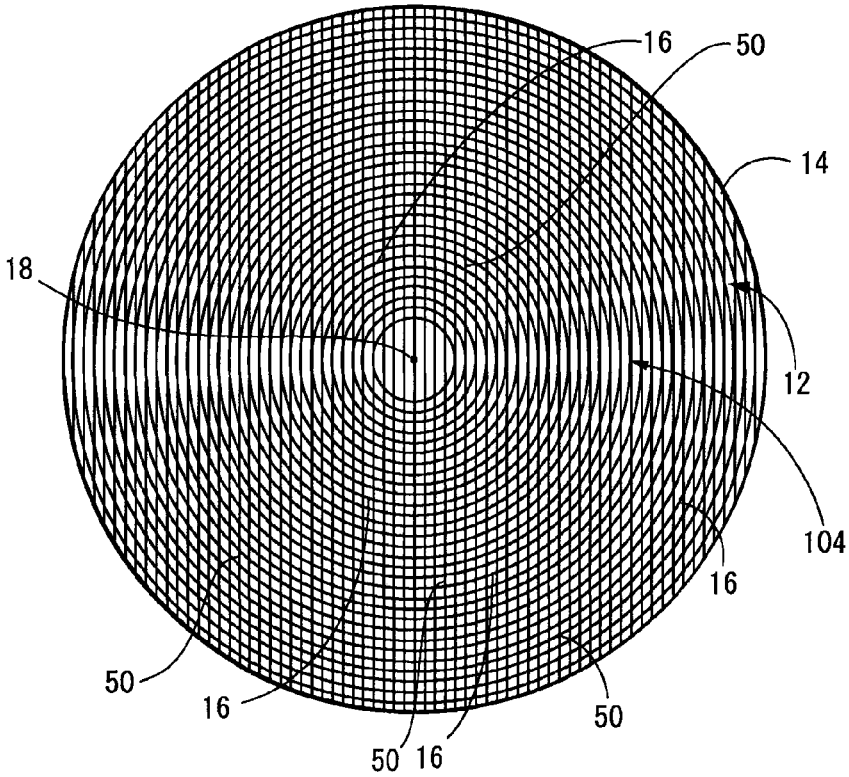
[FIG. 65] It is a top plane view of a polishing pad of construction according to another embodiment of the invention.
Figure 66:
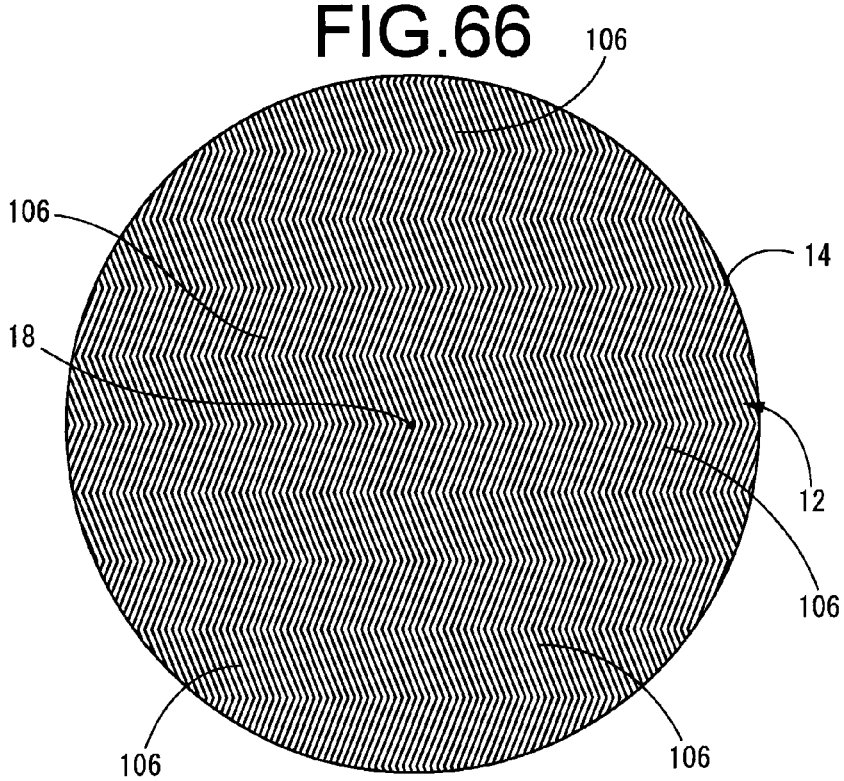
[FIG. 66] It is a top plane view of a polishing pad of construction according to another embodiment of the invention.
Figure 67:
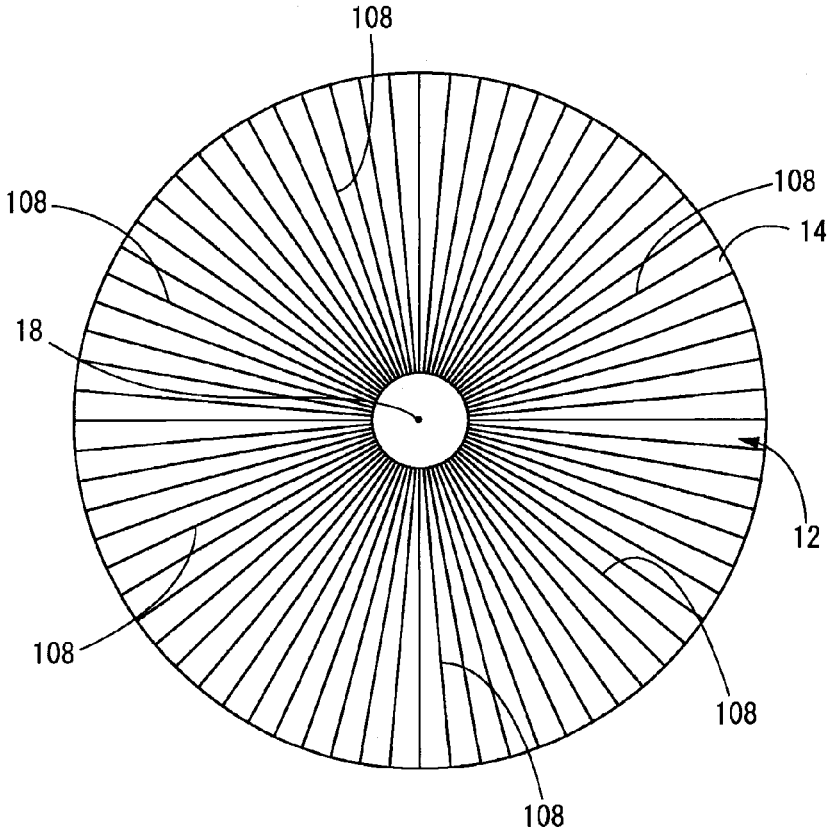
[FIG. 67] It is a top plane view of a polishing pad of construction according to another embodiment of the invention.

In the present embodiment, the front surface 14 is a flat surface having no groove formed, but it may be possible to form front-side grooves thereon having a variety of shapes as shown in FIGS. 57-60, and FIGS. 2-4, 8-15, 18-49 and 61-67. More specifically, it is possible to employ: the front-side grooves 16 composed of a plurality of circular grooves extending circumferentially about the center axis 18 as a center of curvature; the front-side grooves 50 composed of a plurality of linear grooves extending straightly in one diametric direction; the front-side grooves 36 composed of a plurality of circular grooves slant with respect to the center axis 18 (straight line parallel to the center axis 18) having a given slant angle; the front-side grooves 60 composed of a plurality of linear slant grooves slant with respect to the center axis 18 (straight line parallel to the center axis 18) having a given slant angle; front-side grooves 102 composed of the plurality of linear grooves extending in two diametric direction orthogonal to each other as shown in FIG. 64; front-side grooves 104, shown in FIG. 65, having the front-side grooves 16 (36) composed of annular grooves and the front-side grooves 50 (60) composed of linear grooves in combination; front-side grooves 106, shown in FIG. 66, which are bent so as to extend in a zigzag form; and front-side grooves 108, shown in FIG. 67 extending in a radial form from the center axis 18.

As will be understood from the aforementioned description, respective embodiments shown in FIGS. 3, 4, 10-15, 21-26, 30-35, 41-44 and 48-53 include the structure as defined in claim 9 of the present invention, and will solve (Problem 2) and (Problem 4) selected from among the conventional problems as stated above with respect to the present embodiment.

Embodiment E

Figure 68:
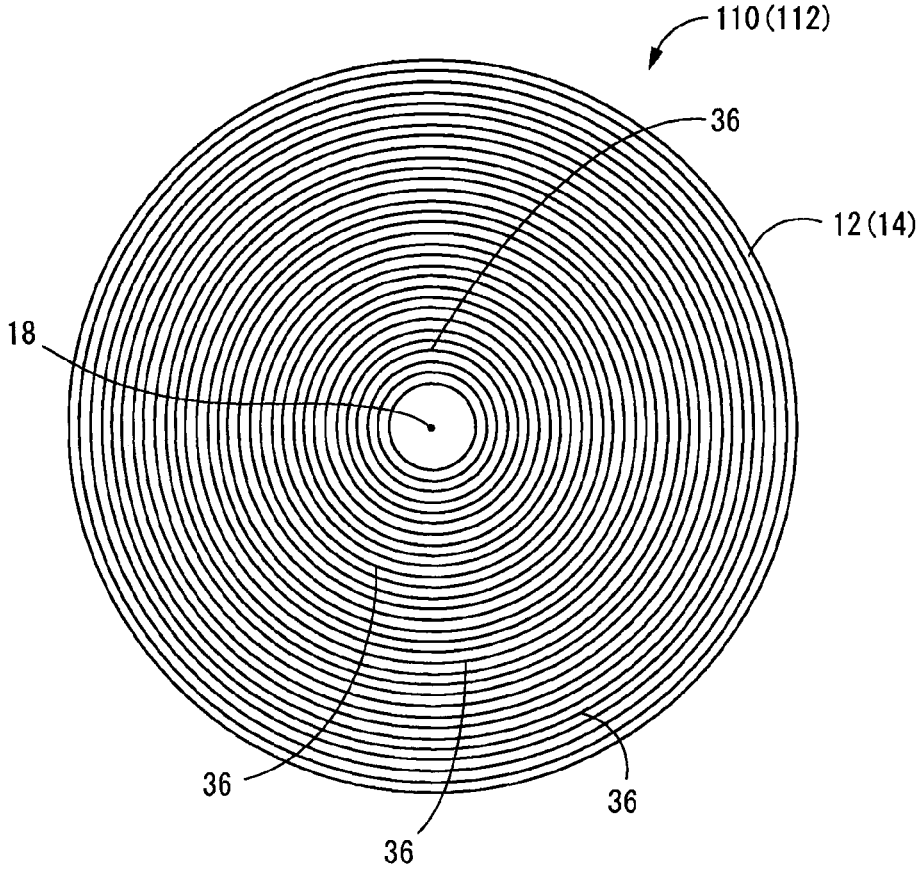
[FIG. 68] It is a top plane view showing a polishing pad of construction according to one embodiment of the invention.
Figure 69:
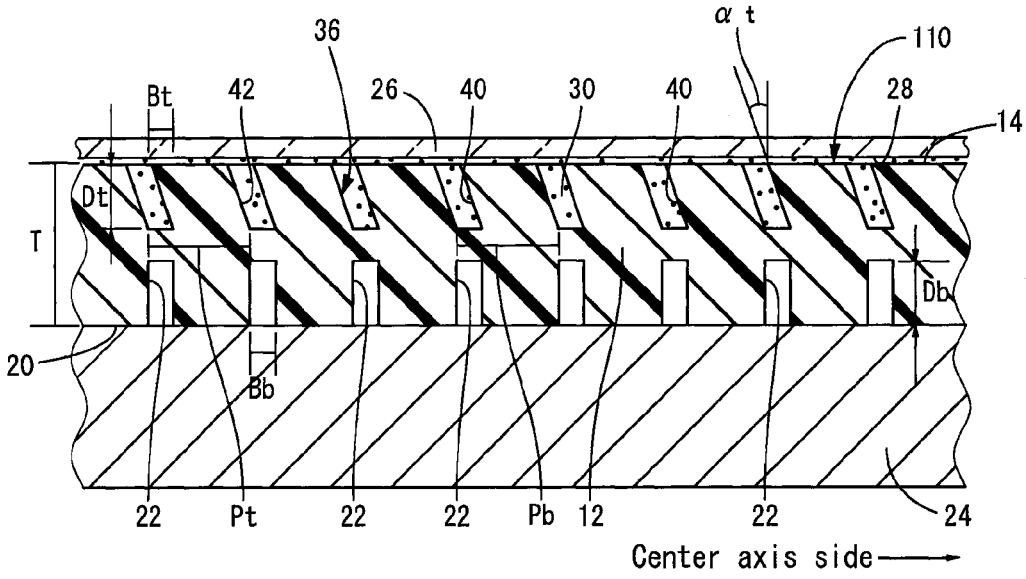
[FIG. 69] It is a vertical cross sectional view of the polishing pad shown in FIG. 68 in a state of being mounted on a polishing apparatus.
Figure 70:
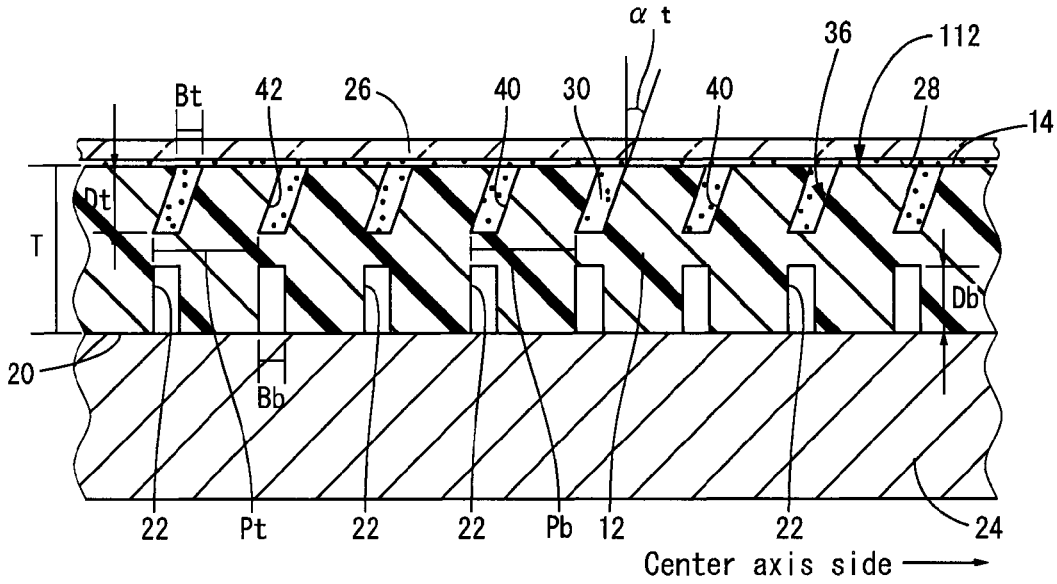
[FIG. 70] It is a vertical cross sectional view of the polishing pad shown in FIG. 68 in a state of being mounted on a polishing apparatus.

Referring next to FIGS. 68-70, shown are polishing pads 110, 112 of construction according to another embodiment of the present invention as defined in any one of claims 11, 12 and 13.

More specifically, each of the polishing pads 110, 112 is constituted by a thin disk shaped pad substrate 12 having a constant thickness dimension T overall. The pad substrate 12 is advantageously formed of rigid expanded or non-expanded synthetic resin material, rigid rubber material, textile material, inorganic material, or other possible material. In the present embodiment, the pad substrate 12 is formed of an expanded urethane, for example. The pad thickness dimension is not particularly limited, and may be selected appropriately depending not only on the material of the pad substrate 12 but also the material of the wafer being polished, the required degree of polishing precision, and the like.

More specifically described, on the front surface 14 of the pad substrate 12 constituting the polishing pads 110, 112, there are formed front-side grooves 36 composed of a plurality of circular grooves formed about the center axis 18, and open in the front surface 14.

In the present embodiment, as shown in FIG. 68, the front-side grooves 36 are composed of a plurality of circular grooves 36, 36, 36 . . . extending coaxially about the center axis 18 with respective radii of curvatures different from each other.

In the present embodiment, the front-side grooves 36 are formed as slant grooves that are slant by a given angle with respect to the center axis 18 of the pad substrate. More specifically, an inner circumferential face 40 of each front-side groove 36 (hereinafter referred to as "front inside wall face 40"), and an outer circumferential face 42 of each front-side groove 36 (hereinafter referred to as "front outside wall face 42") are both made slant faces that are slant by an given angle $\alpha t$ with respect to the center axis 18. In short, in the front-side grooves 36 in the present embodiment, the front inside wall face 40 and the front outside wall face 42 are mutually parallel faces, with the front-side grooves 36 having a substantially constant width dimension Bt over the entirety of the front-side grooves 36, not only in the circumferential direction but also the depthwise direction thereof. In the polishing pad 110 as shown in FIG. 69, the front-side grooves 36 going towards the opening thereof moves gradually further away toward the outer diameter side from the center axis 18 to open diagonally outward in the diametric direction of pad substrate 12. In the polishing pad 112 as shown in FIG. 70, the front-side grooves 36 going towards the opening thereof moves gradually closer to the center axis 18 to open diagonally inward in the diametric direction of pad substrate 12.

Specific design values for the various dimensions, for the front-side grooves 36 may be selected giving overall consideration to the material, thickness dimension, and outside diameter dimension of the pad substrate 12, as well as the material of the wafer being polished, the configuration and material of metallization deposited on the wafer, the required polishing precision and the like, and as such are not particularly limited. Preferably, however, values for the front-side grooves 36, e.g., the groove width Bt, the depth Dt, the radial pitch Pt, and the slant angle $\alpha t$ may fall within the following ranges.

[For Circumferential Groove of Generally Circular Shape]

$0.005\ \text{mm} \leqq Bt \leqq 3.0\ \text{mm}$ $0.1\ \text{mm} \leqq Dt \leqq 2.0\ \text{mm}$ $0.1\ \text{mm} \leqq Pt \leqq 10.0\ \text{mm}$ $-30° \leqq \alpha t \leqq 30°$ More preferably, the values may fall within the following range.

[For Circumferential Groove of Generally Circular Shape]

$0.005\ \text{mm} \leqq Bt \leqq 2.0\ \text{mm}$ (Yet more preferably $0.005\ \text{mm} \leqq Bt \leqq 1.0\ \text{mm}$)

0.1 mm≦Dt≦1.0 mm 0.2 mm≦Pt≦2.0 mm

−30°≦αt≦10° or 10°≦αt≦30°

Namely, if the groove width Bt for the front-side grooves 36 is too small, the front-side grooves 36 will tend to become clogged with polishing residues and the like, so that consistent effect is not readily achieved. On the other hand, if the groove width Bt for the front-side grooves 36 is too large, the elasticity given to the polishing pads 110, 112 by means of the front-side grooves 36 become too large. In addition, the edge portions (edges of the opening) of the front-side grooves 36 will have increased contact pressure against the wafer, tending to bite into the workpiece during polishing, making it difficult to achieve consistent polishing.

If the groove depth Dt, for the front-side grooves 36 is too small, the rigidity in the front surface 14 of the polishing pads 110, 112 will become too large to exhibit elasticity of the polishing pads 110, 112 in the front surface 14 effectively, whereby it will tend to become difficult to execute precise polishing. On the other hand, if the groove depth Dt for the front-side grooves 36 is too large, not only is the pad difficult to manufacture, but the front surface 14 of the polishing pads 110, 112 will tend to deform easily, and there is a risk of stick slip, whereby polishing tends to be inconsistent.

If the radial pitch Pt for the front-side grooves 36 is too small, the pad becomes difficult to manufacture, and the front surface 14 of the polishing pads 110, 112 will tend to deform or become damaged easily, making it difficult to achieve consistent polishing. If on the other hand radial pitch Pt for the front-side grooves 36 is too large, there is a risk of deterioration in polishing precision and polishing efficiency.

If the slant angle αt for the front inside and outside wall faces 40, 42 is too small, it becomes difficult to give sufficient elasticity to the polishing pads 110, 112, leading to a likelihood of malfunction of the pads. On the other hand, if the slant angle αt for the back front inside and outside wall faces 40, 42 is too large, the pads become difficult to manufacture. In addition, the strength of side wall portions of the front-side grooves 36 become lower, leading to unstable surface pressure distribution, or insufficient durability of the polishing pads 110, 112.

On the other hand, the other surface of the pad substrate 12, i.e. a back surface 20 has back-side grooves 22 extending in a circumferential direction about the center axis 18 of the pad substrate 12, and to be open in the back surface 20.

In the present embodiment, the back-side grooves 22 are composed of a plurality of circular grooves 22, 22, 22 . . . each extending about the center axis 18 as its center of curvature, but at mutually different radii of curvature.

Specific design values for the various dimensions, for the back-side grooves 22 may be selected giving overall consideration to the material, thickness dimension, and outside diameter dimension of the pad substrate 12, as well as the material of the wafer being polished, the configuration and material of metallization deposited on the wafer, the required polishing precision and the like, and as such are not particularly limited. Preferably, however, values for the back-side grooves 22, e.g., the groove width Bb, the depth Db, and the radial pitch Pb may fall within the following ranges.

[For Circumferential Groove of Generally Circular Shape]

0.005 mm≦Bb≦3.0 mm 0.1 mm≦Db≦2.0 mm 0.1 mm≦Pb≦5.0 mm

More preferably, the values may fall within the following range.

[For Circumferential Groove of Generally Circular Shape]

0.005 mm≦Bb≦2.0 mm (Yet more preferably 0.005 mm≦Bb≦1.0 mm)

0.1 mm≦Db≦1.0 mm 0.2 mm≦Pb≦2.0 mm

Namely, if the groove width Bb, Db for the back-side grooves 22 is too small, it become difficult to provide the polishing pads 110, 112 with sufficient elasticity, making it difficult to realize desired polishing precision. On the other hand, if the groove width and depth Bb, Db for the back-side grooves 22 are too large, the back surface 20 of each of the polishing pads 110, 112 will exhibit excess elasticity, leading to a likelihood of deterioration in polishing precision.

If the radial pitch Pb for the back-side grooves 22 is too small, the pad becomes difficult to manufacture, and will tend to become damaged easily, making it difficult to achieve consistent polishing. If on the other hand radial pitch Pb for the back-side grooves 22 is too large, the number of the circular grooves 22, 22, 22, . . . composing the back-side grooves 22 get reduced. Therefore, elasticity generated on the back surface 20 of the polishing pad 110, 112 will vary depending on the radial position of the polishing pads 110, 112, making it difficult to carry out uniform polishing efficiently.

Bottom faces of the front-side grooves 36 and the back-side grooves 22 may have a variety of shapes including a curved face and a flat face, but not limited to a specific shape. In the present embodiment, the bottom faces of the front-side grooves 36 and the back-side grooves 22 are flat faces perpendicular to the center axis 18 of the polishing pads 110, 112. By forming the bottom faces of the front-side and back-side grooves 36, 22 to be parallel to the surface of the polishing pads 110, 112 a gap between bottom wall portions of the front-side and back-side grooves 36, 22 is effectively obtained to ensure excellent rigidity of the pad, even if the effective depth for the front-side and back-side grooves 36, 22 is made large.

Moreover, the sum of the groove depth Dt for the front-side grooves 36 and the groove depth Db for the back-side grooves 22 is made smaller than the thickness T of the pad substrate 12. In the present embodiment, the thickness T may fall within the following ranges.

0.5 mm≦T≦10.0 mm

More preferably, the value may fall within the following range.

1.0 mm≦T≦3.0 mm

Each of the polishing pads 110, 112 having the front surface 14 and the back surface 20 as discussed above, is used for polishing a wafer or the like in the conventional manner. More specifically, as shown in FIGS. 69, 70, for example, each of the polishing pads 69, 70 is arranged on the support face of a rotation plate (support plate) 24 of a polishing apparatus, and clamped against the rotation plate by air-reduced negative pressure suction, double-sided bonding or other means. Next, while rotating each of the polishing pads 110, 112 about its center axis 18, a wafer 26 is juxtaposed against the front surface 14 for polishing. Generally, during this polishing process, an abrasive liquid (slurry) 30 is supplied to the opposing faces, i.e. the front surface 14 of each of the polishing pads 110, 112 and the process face 28 of the wafer 26, like the conventional manner, while also rotating the wafer 26 itself about its center axis. The slurry 30 is supplied, for example, to the surface of each of the polishing pads 110, 112 from the vicinity of the central portion of the polishing pads 110, 112 so as to be spread out over the surface of the polishing pads 110, 112 due to the action of centrifugal force created by rotation of polishing pads 110, 112 about the center axis 18.

The polishing pads 110, 112 of construction according to the present embodiment is able to solve (Problem 1) and (Problem 4) selected from among the conventional problems as stated above.

Namely, by providing not only the back-side grooves 22 on the back surface 20 but the front-side grooves 36 on the front surface 14 also, the elasticity of the polishing pads 110, 112 can be effectively provided. In addition by forming the front-side grooves 36 as the slant grooves slant with respect to the center axis, the elasticity given to the polishing pads 110, 112 by means of the grooves formed thereon can be effectively obtained, making it possible to surely realize a variety of required capabilities for the polishing pads 110, 112.

Also, the back-side grooves 22 are the annular grooves extending in the circumferential direction. This makes it possible to effectively prevent that the slurry 30 supplied on the front surface 14 is led along an outer circumferential surface of the pad into the back surface 20. This arrangements may prevent occurrence of problems such as dislodging of the polishing pad 110, 112 from the rotation plate 24, or displacement of the polishing pads 110, 112 on the rotation plate 24, making it possible to execute polishing process with high stability.

Respective embodiments shown in FIGS. 3, 4, 10-15, 19, 20, 23-26, 28-33, 37-42, 46-53, 59, 60 and 63 include the structure as defined in claim 11 of the present invention, and will exhibit advantages of the present embodiment as discussed above.

Namely, by forming the front-side grooves 36 as slant grooves that are slant with respect to the center axis, it is effectively prevented that the pad substrate 12 undergoes shear elastic deformation in one direction due to a load applied to the contact surface (processing surface) that is brought into contact with the object to be processed, since the grooves are made slant. This makes it possible to support the object to be processed, such as a wafer, while being fixedly positioned in the axis-perpendicular direction, whereby high precision polishing can be executed with stability.

Further, values for the front-side grooves 36 and the back-side grooves 22, e.g., the groove width Bb, the depth Db, and the radial pitch Pb are fall within the above-indicated given ranges. This makes it possible to give a sufficient elasticity to the polishing pads 110, 112, while ensuring sufficient bonding strength between the back surface 20 and the rotation plate 24. Thus, high reliability can be realized.

Moreover, the sum of the groove depth Dt for the front-side grooves 36 and the groove depth Db for the back-side grooves 22 (i.e. the total value of (Dt+Db) is made smaller than the thickness of the pad substrate 12. This makes it possible to give appropriate elasticity to the polishing pads 110, 112, while keeping sufficient rigidity, whereby polishing precision can be realized advantageously.

While the presently preferred embodiments of this invention have been described above in detail for the illustrative purpose only, it is to be understood that the present invention is not limited to the details of the illustrated embodiments.

Figure 60:
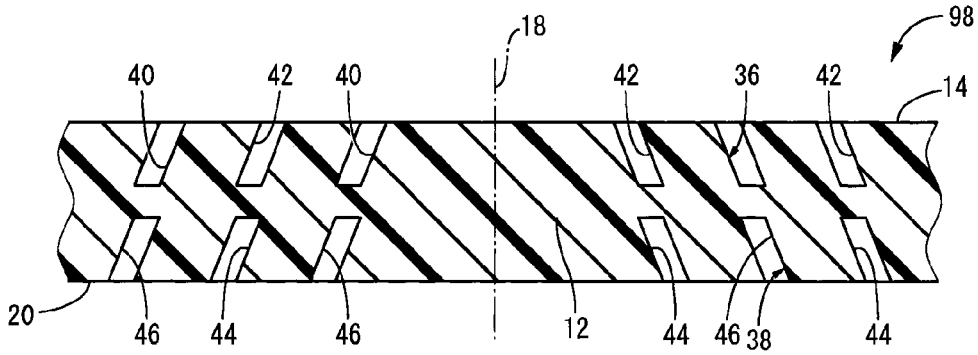
[FIG. 60] It is a vertical cross sectional view of a polishing pad of construction according to another embodiment of the invention.
Figure 61:
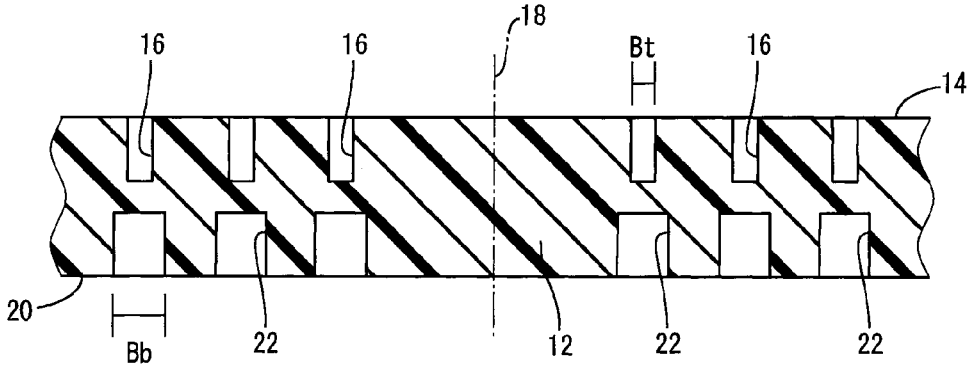
[FIG. 61] It is a vertical cross sectional view of a polishing pad of construction according to another embodiment of the invention.
Figure 62:
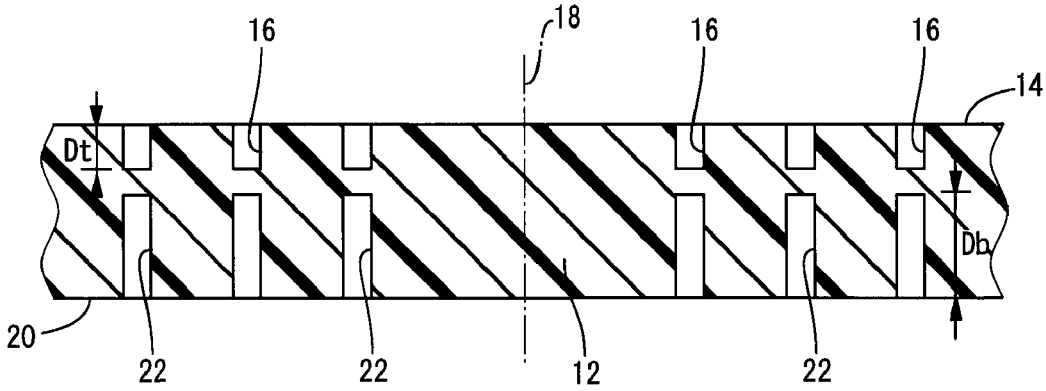
[FIG. 62] It is a vertical cross sectional view of a polishing pad of construction according to another embodiment of the invention.

For instance, in respective embodiments shown in FIGS. 4-60, namely, in the embodiments B, C and D, the groove width Bt, the depth Dt, the radial pitch Pt, and the inclined angle $\alpha t$ for the front-side grooves formed on the front surface 14 may be different from the groove width Bb, the depth Db, the radial pitch Pb, and the inclined angle $\alpha b$ for the back-side grooves formed on the back surface, respectively. More specifically, as shown in FIG. 61, the front-side grooves 16 and the back-side grooves 22, which have different groove depths may be employed in combination. Further, as shown in FIG. 62, the front-side grooves 16 and the back-side grooves 22, which have different groove depths may be employed in combination. Furthermore, as shown in FIG. 63, the front-side grooves 36 and the back-side grooves 38, which have different slant angles may be employed in combination.

In each embodiment as shown in FIGS. 5-15, namely the embodiment B of a polishing pad, the front-side grooves formed on the front surface 14 have a variety of shapes without limited to any one shown in the illustrated embodiments. More specifically, it may be employed the front-side grooves 102 arranged at a grid pattern composed of linear grooves extending in two orthogonal diametric directions shown in FIG. 65, and the front-side grooves 104 composed of circular grooves extending in the circumferential direction and linear grooves extending straightly in combination, appropriately.

Figure 71:
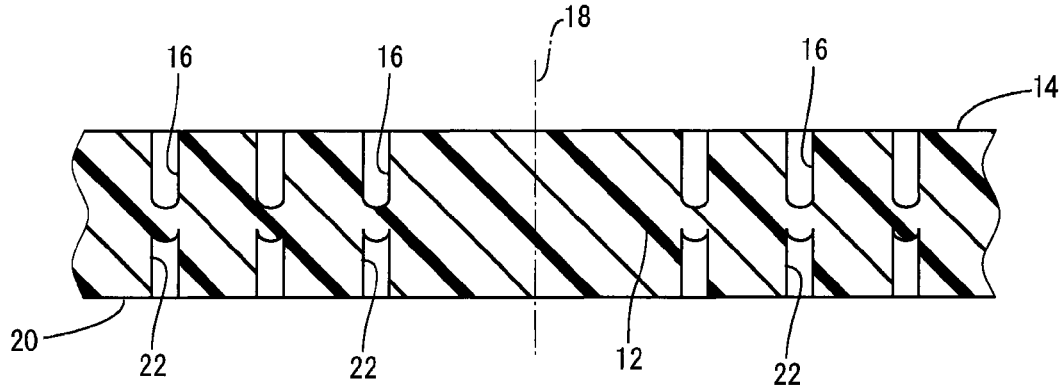
[FIG. 71] It is a vertical cross sectional view of a polishing pad of construction according to another embodiment of the invention.

In the respective embodiment illustrated above, the bottom faces of the front-side grooves 16, 36, 50, 60 and the back-side grooves 22, 38 are formed as flat surfaces extending parallel to the front surface 14 and the back surface 20. It may be possible as shown in FIG. 71 to employ a curved surface.

The polishing pads disclosed in the illustrated embodiments may be preferably employed for polishing of a glass substrate in addition to polishing of silicon wafer or the like.

It is also to be understood that the present invention may be embodied with various other changes, modifications and improvements, which may occur to those skilled in the art, without departing from the spirit and scope of the invention defined in the following claims.

The invention claimed is:

1. A polishing pad having a thin-disk shape, adapted to be mounted on a polishing apparatus with a back surface thereof bonded on a support surface of the polishing apparatus, and adapted to perform a polishing action with a front surface thereof on a processing object like a semiconductor wafer, the polishing pad comprising:

a plurality of annular grooves are formed concentrically about a center axis of the polishing pad on both of the front surface and the back surface of the polishing pad, with a same cross-sectional shape, at a same radial pitch and at a same number, such that the annular grooves on the front surface of the polishing pad are aligned and overlay the grooves on the back surface of the polishing pad.

2. The polishing pad according to claim 1, wherein each of the plurality of annular grooves formed on the back surface of the polishing pad has a width dimension B, a depth dimension D, and a radial pitch P which are defined in following equalities:

$0.005\ \text{mm} \leqq B \leqq 3.0\ \text{mm}$ $0.1\ \text{mm} \leqq D \leqq 2.0\ \text{mm}$ $0.1\ \text{mm} \leqq P \leqq 5.0\ \text{mm}$.

3. The polishing pad according to claim 1, wherein the plurality of annular grooves formed on both the front surface and the back surface of the polishing pad do not intersect with one another at an angle along the radial surface of the pad.

* * * * *